US008050854B1

(12) United States Patent
Chandra et al.

(10) Patent No.: US 8,050,854 B1
(45) Date of Patent: Nov. 1, 2011

(54) ADAPTIVE CONTROL SYSTEMS AND METHODS

(75) Inventors: Reggie J. Chandra, Leawood, KS (US); James W. Bley, Lawrence, KS (US); Stephen S. Penrod, Kansas City, MO (US); Arthur S. Parker, Lawrence, KS (US)

(73) Assignee: Rhythm Engineering, LLC, Lenexa, KS (US)

( * ) Notice: Subject to any disclaimer, the term of this patent is extended or adjusted under 35 U.S.C. 154(b) by 636 days.

(21) Appl. No.: 12/236,701

(22) Filed: Sep. 24, 2008

Related U.S. Application Data

(60) Provisional application No. 61/004,297, filed on Nov. 26, 2007.

(51) Int. Cl.
*G06G 1/00* (2006.01)
*G08G 1/07* (2006.01)

(52) U.S. Cl. ..... 701/117; 701/118; 701/119; 340/917; 340/918

(58) Field of Classification Search ..... 701/117–119; 340/917–918
See application file for complete search history.

(56) References Cited

U.S. PATENT DOCUMENTS 4,122,994 A 10/1978 McReynolds et al.
4,167,784 A 9/1979 McReynolds et al.
4,322,801 A 3/1982 Williamson et al.
4,370,718 A 1/1983 Chasek
4,847,772 A 7/1989 Michalopoulos et al.
5,330,278 A 7/1994 Raswant
5,357,436 A 10/1994 Chiu
5,448,484 A 9/1995 Bullock et al.
5,535,314 A 7/1996 Alves et al.
5,621,645 A 4/1997 Brady
5,734,116 A 3/1998 Schaeffer
5,757,286 A 5/1998 Jonsson et al.
5,757,287 A 5/1998 Kitamura et al.
5,761,326 A 6/1998 Brady et al.
5,777,564 A 7/1998 Jones
(Continued)

OTHER PUBLICATIONS

FHWA Office of Operations, Appendix F: Actuated Signal Control; printed from Internet Aug. 27, 2008, http://ops.fhwa.dot.gov/trafficanalysistools/tat_vol4/app_f.htm, Published in: US.

(Continued)

*Primary Examiner* — Hussein A. Elchanti
(74) *Attorney, Agent, or Firm* — Law Offices of Grady L. White, LLC

(57) ABSTRACT

An adaptive control system controls a traffic signal at a critical intersection that has a most conflicting volume of traffic among volumes of traffic at intersections in a traffic network. The adaptive control system determines a plan identifying a guaranteed green light time and a minimum green duration and a period for the plan. The adaptive control system determines, based on the plan, a non-linear schedule with one or more states corresponding to one or more individual phases with each state having a state start time and a state duration. Queues for individual traffic movements at the critical intersection also may be used to determine the non-linear schedule. The adaptive control system controls the traffic signal according to the non-linear schedule. The adaptive control system transmits its plan to one or more other adaptive control systems for other intersections. The other adaptive control systems determine other plans based on the plan from the adaptive control system and an expected travel time between the critical intersection and the corresponding intersection.

60 Claims, 18 Drawing Sheets

U.S. PATENT DOCUMENTS

| | | | | |
|---|---|---|---|---|
| 5,821,878 | A | 10/1998 | Raswant | |
| 5,822,711 | A | 10/1998 | Ochoa-Chavez | |
| 5,896,190 | A | 4/1999 | Wangler et al. | |
| 6,075,874 | A | 6/2000 | Higashikubo et al. | |
| 6,100,819 | A * | 8/2000 | White | 340/933 |
| 6,124,807 | A | 9/2000 | Heckeroth et al. | |
| 6,137,531 | A | 10/2000 | Kanzaki et al. | |
| 6,172,617 | B1 | 1/2001 | Bullock | |
| 6,317,058 | B1 * | 11/2001 | Lemelson et al. | 340/910 |
| 6,339,383 | B1 * | 1/2002 | Kobayashi et al. | 340/907 |
| 6,470,261 | B1 | 10/2002 | Ng et al. | |
| 6,539,300 | B2 | 3/2003 | Myr | |
| 6,587,778 | B2 | 7/2003 | Stallard et al. | |
| 6,633,438 | B2 * | 10/2003 | Anhalt | 359/694 |
| 6,734,896 | B2 | 5/2004 | Nobori et al. | |
| 6,760,061 | B1 | 7/2004 | Glier et al. | |
| 6,774,816 | B1 | 8/2004 | Raswant | |
| 6,847,307 | B2 | 1/2005 | Thao et al. | |
| 6,909,380 | B2 * | 6/2005 | Brooke | 340/906 |
| 6,937,161 | B2 | 8/2005 | Nishimura | |
| 6,999,004 | B2 | 2/2006 | Comaniciu et al. | |
| 7,068,815 | B2 | 6/2006 | Chang et al. | |
| 7,127,083 | B2 | 10/2006 | Han et al. | |
| 7,205,902 | B2 | 4/2007 | Kiribayashi | |
| 7,274,404 | B1 | 9/2007 | He et al. | |
| 7,313,183 | B2 | 12/2007 | Bazin et al. | |
| 7,347,464 | B2 | 3/2008 | Tanabe | |
| 2002/0008637 | A1 * | 1/2002 | Lemelson et al. | 340/907 |
| 2002/0026277 | A1 * | 2/2002 | Kerner et al. | 701/117 |
| 2003/0006909 | A1 * | 1/2003 | Basson et al. | 340/906 |
| 2004/0196162 | A1 * | 10/2004 | Brooke | 340/906 |
| 2006/0066472 | A1 * | 3/2006 | Janssen | 342/104 |
| 2006/0274917 | A1 | 12/2006 | Ng et al. | |
| 2008/0167795 | A1 * | 7/2008 | Bisdikian et al. | 701/118 |
| 2008/0238720 | A1 * | 10/2008 | Lee | 340/909 |
| 2009/0051568 | A1 * | 2/2009 | Corry et al. | 340/935 |

OTHER PUBLICATIONS

State of New Jersey Dept. of Transportation, Metric Specifications for Software, N.J. Specification No. EBM-TSC-170E-ISOFT; Jul. 1, 2001, Publisher: State of New Jersey Dept. of Transportation, Published in: US.

Lawrence A. Klein, Sensor Technologies and Data Requirement for ITS; 2001, Publisher: Artech House, Published in: US.

McShane, et al., Traffic Engineering; 1990, Chapters 20-25, Publisher: Prentice Hall, Inc., Published in: US.

University of California Berkeley, Traffic Signal Control, printed from Internet: Aug. 26, 2008, www.calccit.org/itsdecision/serv_and_tech/Traffic_signal_control/traffsigrep_print..., Published in: US.

Hajjiri, et al., Urban Congestion Reduction for Energy Conservation—Control Strategies for Urban Street Systems a State of the Art; Jan. 1988, Published in: US.

* cited by examiner

PRIOR ART FIG. 1

PRIOR ART FIG. 3

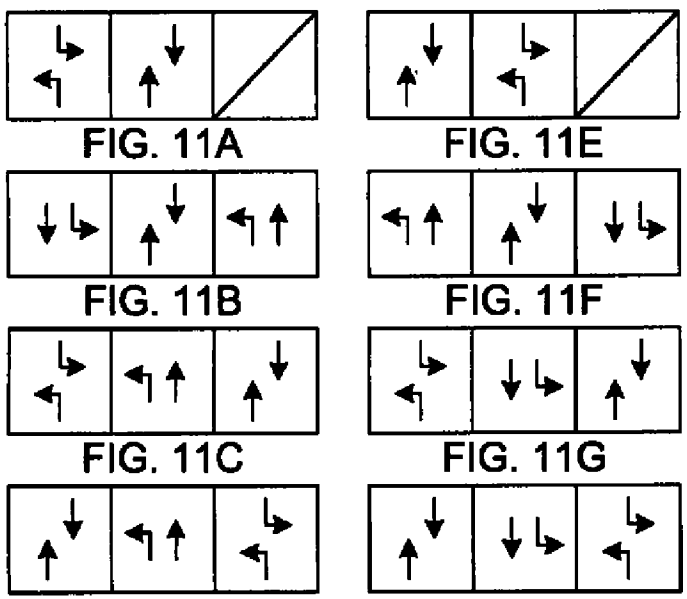
FIG. 11A FIG. 11B FIG. 11C FIG. 11D
FIG. 11E FIG. 11F FIG. 11G FIG. 11H
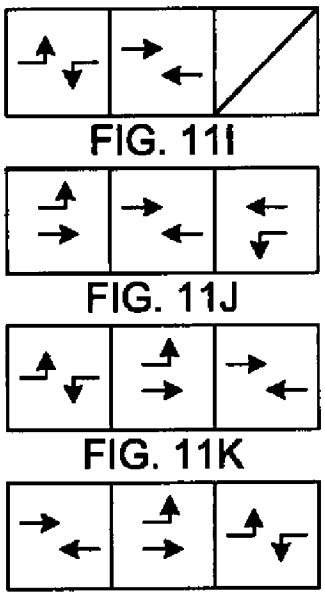
FIG. 11I FIG. 11J FIG. 11K FIG. 11L
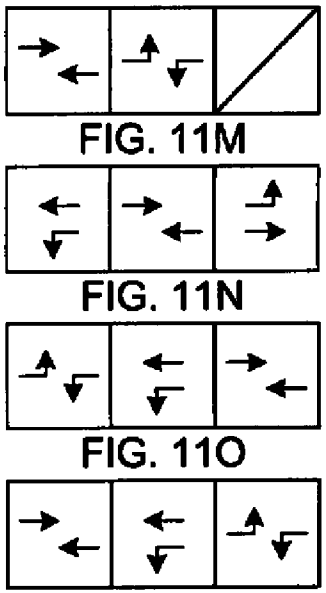
FIG. 11M FIG. 11N FIG. 11O FIG. 11P

ADAPTIVE CONTROL SYSTEMS AND METHODS

RELATED APPLICATIONS

This application takes priority to U.S. Patent Application Ser. No. 61/004,297, filed Nov. 26, 2007, and entitled Method for Externally Controlling the Initiation, Duration, and Sequence of Vehicle Phases at Signalized Traffic Intersections, the entire contents of which are incorporated herein by reference. This application also is related to U.S. patent application Ser. No. 12/236,693, entitled External Adaptive Control Systems and Methods, and U.S. patent application Ser. No. 12/236,698, entitled External Adaptive Control Systems and Methods, all filed the same date as the present application and all incorporated fully herein by reference.

FEDERALLY SPONSORED RESEARCH OR DEVELOPMENT

Not Applicable.

COMPACT DISK APPENDIX

Not Applicable.

BACKGROUND

Traffic intersections may have multiple lanes of traffic moving in multiple directions, including passing through the intersection and turning at the intersection. Signalized traffic intersections help control these traffic movements in a safe and efficient manner by enabling a traffic signal to control the movements of traffic through the intersections.

A signal indication is one of the traffic lights at a signalized traffic intersection. The right-of-way, which enables a particular traffic movement to pass through the intersection or turn at the intersection, is assigned using the signal indications, where a green light indicates a right-of-way, and a red light indicates no right-of-way.

Traffic movements at an intersection have been standardized and designated with movement codes according to the National Electric Manufacturer's Association (NEMA). The individual traffic movements also are referred to as individual phases or vehicle phases herein.

In the conventional art, a phase is defined as any single combination of one or more individual traffic movements that simultaneously receive the right-of-way. Herein, the terms "individual phase" and "vehicle phase" are distinguished from the term "phase." The terms "individual phase" and "vehicle phase" herein are equivalent to an individual traffic movement as identified by the NEMA codes. Whereas, the term "phase" or "combination phase" as used herein means a combination of more than one traffic movement that simultaneously receive the right-of-way.

An example of the NEMA codes for the individual traffic movements or individual phases of an eight phase intersection is depicted in FIG. 1, where individual traffic movement 1 or individual phase 1 is the northbound left turn traffic movement. Individual phase 2 is the southbound through individual traffic movement. Individual phase 3 is the eastbound left turn individual traffic movement. Individual phase 4 is the westbound through individual traffic movement. Individual phase 5 is the southbound left turn individual traffic movement. Individual phase 6 is the northbound through individual traffic movement. Individual phase 7 is the westbound left turn individual traffic movement, and individual phase 8 is the eastbound through individual traffic movement.

Left turning traffic movements may occur in several different ways at various intersections. In one example, a left turn is not permitted. In another example, a left turn is permitted, but the left turn traffic must yield to opposing through traffic. In another example, a protected left turn occurs when an individual traffic movement is given a left turn green arrow signal. These are referred to as not permitted, permitted, and protected traffic movements.

A leading phase is a protected left turn individual traffic movement before an opposing traffic movement is released. For example, a northbound left turn traffic movement may be a protected left turn that leads coordinated northbound through and southbound through traffic movements.

A lagging phase is a protected left turn individual traffic movement after an opposing traffic movement is released. For example, the protected northbound left turn described above may be released after, and therefore lag, the coordinated northbound through and southbound through traffic movements.

An overlap includes a protected left turn traffic movement and a through traffic movement. For example, a northbound left turn overlap includes individual phases for a protected northbound left turn traffic movement and a northbound through traffic movement. Other examples exist.

When an intersection is signalized, a signal controller assembly controls the traffic movements at the traffic signal according to a timing plan. The timing plan identifies the order, start time, and duration of traffic movements at the intersection and prevents conflicting movements from having a right-of-way at the same time. For example, individual phase 2 and individual phase 3 conflict. Therefore, they could not both have the right-of-way at the same time.

Referring to FIGS. 2A-2B, in the conventional signal controller assembly, the timing plan has a cycle 202, which is a complete sequence of traffic movements for the intersection. The cycle 202 has a defined linear 204 order for each signal controller assembly. Therefore, each cycle 202 has a defined linear order of traffic movements.

Each cycle has a cycle length 206, which is the time it takes to complete one cycle with reference to a fixed point in the cycle. This fixed point sometimes is referred to as a yield point 208 and typically is the beginning or end of a main street green. Thus, the cycle length 206 is the time required to serve all individual phases at an intersection within a linear order with respect to the fixed reference point. This often is described in a short form as the time to serve a complete sequence of phases at an intersection. A cycle split is the percentage of cycle length allocated to one phase of a cycle. A phase split or individual phase split is the portion of the cycle length allocated to an individual phase. A signal phase or individual signal phase is a right of way for an individual phase.

As indicated above, a cycle has a predefined linear order of individual phases or combination phases with respect to a fixed point, sometimes referred to as a yield point. In the conventional signal controller assembly, the order in which the individual phases or combination phases are output are not changed from the linear order. One or more individual phases or combination phases may be skipped. Therefore, the sequence may appear to change in some instances. However, the linear order of the cycle does not change. If the controller assembly determines that a particular individual phase is to be generated, the signal controller assembly must first go through all the other phases in the linear cycle before reaching the particular individual phase that is to be generated. The interim phases may be skipped, thus appearing as if the linear order of the individual phases in the cycle has been changed or dynamically determined. However, it is only the pattern of the individual phases that has changed, not the linear order. The conventional systems emulate an analog mechanical cycle and do not select an order of states for a schedule or an order for signal phases for a timing plan.

Moreover, a conventional signal controller assembly cannot change the linear order of the individual phases in the cycle with respect to the fixed reference point. If the conventional signal controller assembly determines to generate a particular individual phase, it must wait until it reaches the point in the cycle where the individual phase can be served. If a signal controller assembly serves a first individual phase at a point in the cycle and then serves a second individual phase, it cannot again serve the first individual phase until the next cycle. Moreover, if the signal controller assembly serves all phases before the cycle length ends, it must wait until it reaches the fixed reference point to start a new cycle.

FIG. 2C illustrates a two ring architecture for serving an eight phase intersection. Ring one includes phases 1-4, and ring two includes phases 5-8. A barrier 210 exists as a safety mechanism to prevent interfering traffic movements. An individual phase on one side of the barrier 210 cannot receive a green light at the same time as an individual phase on the other side of the barrier. Additionally, once the barrier is crossed in the cycle, the signal controller assembly cannot serve any individual phase on the other side of the barrier again until the next cycle.

For example, multiple combinations of individual phases are generated for a timing plan in the cycle of FIGS. 2A-2B. In this example, individual phases 1 and 5 are generated, followed by individual phases 2 and 6, individual phases 3 and 7, and individual phases 4 and 8. The cycle 202 starts at the yield point 208, which is the beginning of the main street green, and the phases are output in the order identified in FIGS. 2A and 2B. A combination phase 1 and 6 may exist, but it is not identified in a timing plan for the cycle of FIG. 2. Similarly, the combination of individual phases 2 and 5 is not indicated in the cycle of FIG. 2. Thus, these combination phases are skipped. Therefore, it appears that the combination phases in the example of FIG. 2 are dynamically determined. However, the combination phase 2 and 6 cannot be generated as an output before the combination phase 1 and 5. Similarly, the combination phase 3 and 7 cannot be generated before the combination phase 2 and 6. Additionally, no combination of individual phases 1-2 and 5-6 can be served after the cycle crosses the barrier 210. Therefore, a true dynamic selection of individual phases or combination phases is not presented in the conventional signal controller assembly.

When multiple signal controller assemblies exist in a traffic network, the signal controller assemblies typically have a common cycle length. The cycles for each signal controller assembly are based on the fixed reference point. An offset between successive traffic signals is the time difference between the start of a green phase at an upstream intersection as related to the start of the green phase at an adjacent downstream intersection, which is determined from the fixed reference point. Therefore, each cycle in the traffic network is based on the fixed reference point.

Some traffic signal controller assemblies rely on a fixed timing plan that does not change. Other signal controller assemblies have a semi-actuated or fully actuated mode that enables the signal controller assembly to determine a timing plan based on traffic at the signal and traffic approaching the signal. Traffic waiting at the signal typically is identified using one or more types of detectors (also known as vehicle sensors), such as a loop detector, a puck (magnetic) detector, a video camera or other video detection device, a microwave detection device, and/or other detection devices. An example of a puck detector is the pavement mounted magneto-resistive sensor with wireless communication detection system from Sensys Networks. Traffic approaching the intersection may be identified by an upstream detector or a detector at an upstream intersection.

An example of such a conventional signal controller assembly is identified in FIG. 3. The signal controller assembly 302 of FIG. 3 includes a fixed mode, a semi-actuated mode, and a fully actuated mode. In the fixed mode, the signal controller assembly 302 executes a pre-determined timing plan. In the semi-actuated mode, the signal controller assembly 302 maintains a continuous right-of-way on a major street except when a demand is registered by a minor street detector. After the minor street is served, the right-of-way returns to the major street, such as when the detector on the minor street does not register any vehicles or a timing limit for the minor street has been reached. In the fully actuated mode, the signal controller assembly 302 measures traffic flow on all approaches to the intersection and makes assignments of the right-of-way in accordance with traffic demand. Detectors on the approaches to the intersection enable the signal controller assembly 302 to determine the single phases or combination phases to be generated in the timing plan to serve the major and minor streets. The fully actuated mode also is known as the "free" mode.

The semi-actuated and fully actuated modes are sometimes identified as adaptive control modes because the signal controller assembly 302 considers traffic flow when determining a timing plan. Therefore, the signal controller assembly 302 adapts to current conditions of traffic volume.

The signal controller assembly 302 includes an input/output (IO) board or interface 304 through which signals and/or communications are received or transmitted at or from the signal controller assembly 302. For example, signals identifying traffic volume approaching the intersection will be received by the signal controller assembly 302 through the IO board 304. A detector card 306 receives inputs from one or more detectors, such as detector 1 308 through detector N 310, where N represents a selected number of detectors at the intersection. For example, an intersection may have eight detectors, four detectors, or another number of detectors. The inputs from the detectors 308-310 to the detector card 306 are sometimes called detector calls, where one detector call represents the presence of at least one vehicle in a particular lane for an individual phase or individual traffic movement.

A controller unit 312 determines a timing plan and outputs the timing plan to the traffic signal 314 via the signal switches 316. The timing plan will vary depending on whether the signal controller assembly 302 is in the fixed mode, a semi-actuated mode, or the fully actuated mode. In addition, the timing plan will vary depending on whether detector calls are received from one or more detectors 308-310 corresponding to one or more individual phases. A conflict monitor (not shown) prevents traffic signal indications of conflicting traffic movements from being illuminated simultaneously to prevent hazardous conditions from occurring.

Even in the fully actuated mode, the cycle is constrained as being linear with a fixed reference point. The signal controller assembly cannot change the linear order of the cycle, i.e. the order in which individual phases or combination phases occur in its cycle. It can skip individual phases or combination phases in its timing plan, therefore changing the pattern in which the phases occur. However, the signal controller assembly 302 is limited by starting the cycle for the timing plan at the yield point and constraining the timing plan with the linear order of individual phases and combination phases in the cycle.

Moreover, multiple manufacturers of signal controller assemblies exist. While some commonalities occur between the various manufacturers, not all signal controller assemblies are manufactured the same way. Therefore, modifications made to one signal controller assembly type may not necessarily work for another signal controller assembly type. In addition, a processing system or other change to one type of signal controller assembly may not work for another type of signal controller assembly.

Several controller assemblies also have closed architectures so that the hardware and/or software cannot be changed by a traffic engineer. These include the NEMA TS-1 and the NEMA TS-2 standard models, whereas, the Caltrans 170 standard model has multiple hardware and/or software vendors without consistent hardware and software components. Further, current traffic controllers that are presently installed at intersections are not powerful enough to effectively run optimizations required by existing algorithms. Further, the conventional systems emulate an analog mechanical cycle and do not select an order of states for a schedule or an order for signal phases for a timing plan.

SUMMARY

In one aspect, an adaptive control system and method controls a traffic signal at a critical intersection that has a most conflicting volume of traffic among volumes of traffic at intersections in a traffic network. The adaptive control system determines a plan identifying a guaranteed green light time and a minimum green duration and a period for the plan. The adaptive control system determines, based on the plan, a non-linear schedule with one or more states corresponding to one or more individual phases with each state having a state start time and a state duration. Queues for individual traffic movements at the critical intersection also may be used to determine the non-linear schedule. The adaptive control system controls the traffic signal according to the non-linear schedule. The adaptive control system transmits its plan to one or more other adaptive control systems for other intersections. The other adaptive control systems determine other plans based on the plan from the adaptive control system and an expected travel time between the critical intersection and the corresponding intersection.

In another aspect, a system and method control traffic movements for a plurality of traffic intersections each having a volume of traffic. An adaptive control system at a critical intersection having a most conflicting volume from among the volumes is configured to determine at least one guaranteed green time and at least one minimum green duration for at least one direction of traffic movement at the critical intersection and determine at least one non-linear schedule for the critical intersection based at least on the at least one guaranteed green time and the at least one minimum green duration. The adaptive control system controls at least one traffic signal at the critical intersection according to the at least one non-linear schedule. A plurality of other adaptive control systems each are configured to determine another guaranteed green time and other minimum green duration for another intersection based on the at least one guaranteed green time and the at least one minimum green duration at the critical intersection and an expected travel time between the critical intersection and the other intersection and determine another non-linear schedule for the other intersection based on the other guaranteed green time and other minimum green duration. The plurality of other adaptive control systems each are configured to control another traffic signal at the other intersection according to the other non-linear schedule.

In another aspect, the adaptive control system receives progression data for at least one progression. The progression data comprises at least one number of vehicles approaching the intersection and at least one progression time for the at least one number of vehicles approaching the intersection. The adaptive control system is configured to process the progression data with the at least one plan and the queue lengths for the individual phases to determine the non-linear schedule.

In still another aspect, the adaptive control system comprises an emergency mode operational when at least some of the detector data is not received at the adaptive control system. The adaptive control system is configured to process at least some of the historical data in place of at least some of the queue length data in the emergency mode to determine the non-linear schedule.

In still another aspect, the adaptive control system is configured to determine a schedule comprising a plurality of states having a variable state order, each state having a state start time and a state duration.

BRIEF DESCRIPTION OF THE DRAWINGS

FIG. 1 is a diagram of individual phases at an eight phase traffic intersection.

FIG. 3 is a block diagram of a conventional signal controller assembly.

FIGS. 11A-11P are examples of sequences of states with individual phases.

DETAILED DESCRIPTION

Figures 2A, 2B, 2C:
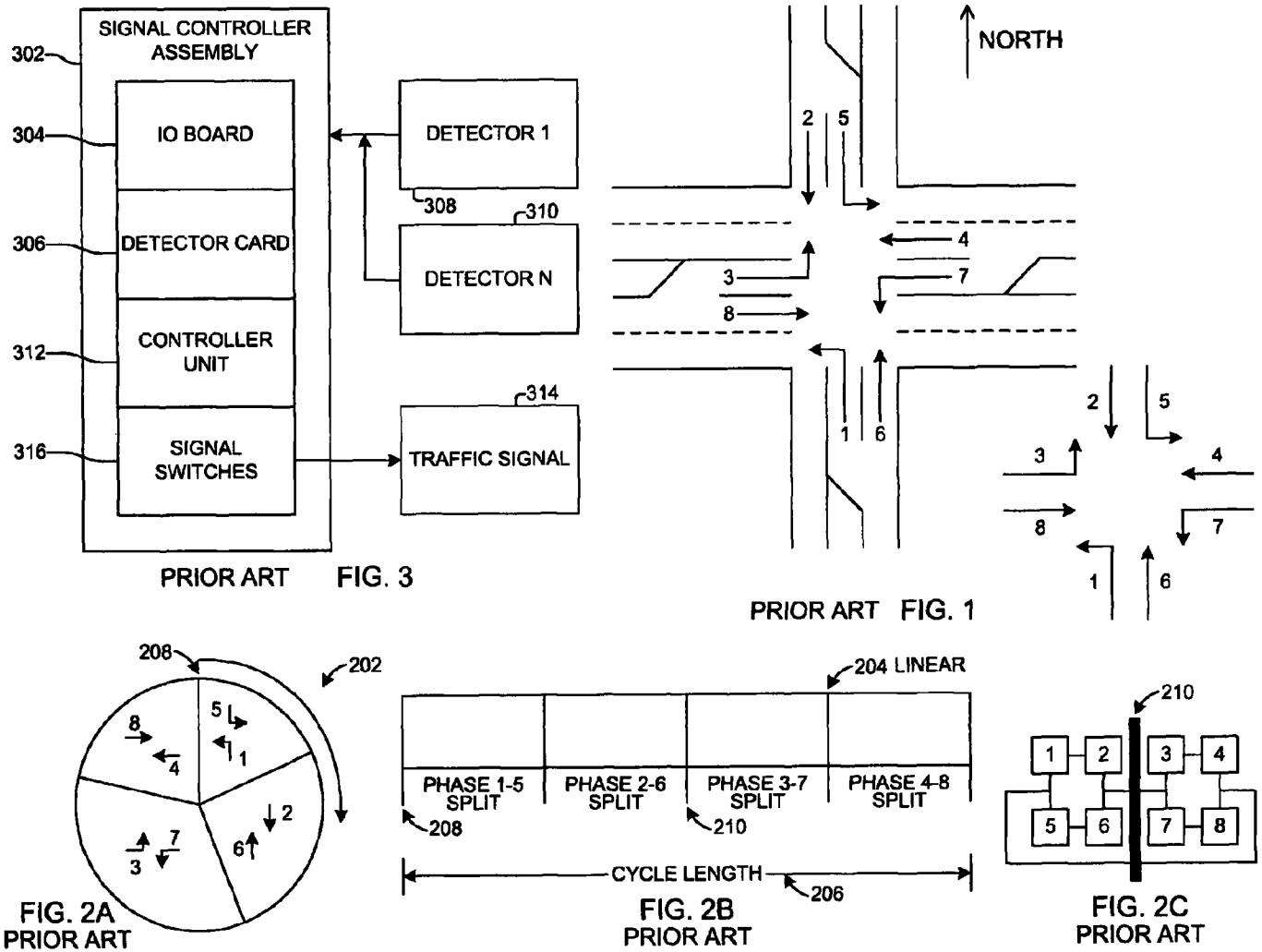
FIG. 2A PRIOR ART
FIG. 2B PRIOR ART
FIG. 2C PRIOR ART
FIG. 2 is an example of a cycle for a timing plan.

As used herein, "non-linear" means not linear. "Variable" means not fixed. A "variable order" means an order that is not fixed. A "variable state order" means an order of states that is not fixed. A "variable schedule" means a schedule having one or more states having a variable order. A "non-linear schedule" means a schedule having one or more states having a variable order and no fixed reference point. A "variable state sequence" means a sequence of multiple states having a variable order. A "non-linear state sequence" means a sequence of multiple states having a variable order and no fixed reference point.

Systems and methods of the present invention dynamically determine states in a variable state order for a schedule for controlling a traffic signal. The schedule has no fixed reference point. Therefore, the schedule is a non-linear schedule. In another aspect, a schedule has a variable state order and, therefore, is a variable schedule.

In one aspect, an adaptive controller system and method are external to a signal controller assembly. The external adaptive control system determines a schedule with one or more states corresponding to one or more individual phases with each state having a start time and a duration. The states may be grouped as one or more sequences. The external adaptive control system generates presence data for reception by the controller assembly for each state and its associated duration.

In another aspect, an external adaptive control system and method receive queue data for one or more traffic lanes at an intersection and determine a non-linear schedule with one or more states corresponding to one or more individual phases with each state having a start time and a duration. The states may be grouped as one or more sequences of states. The entire schedule has a non-linear state order. The external adaptive control system generates presence data for reception by the controller assembly for each state and its associated duration.

In another aspect, an external adaptive control system and method receive queue data for one or more traffic lanes at an intersection and determine a variable schedule with one or more states corresponding to one or more individual phases with each state having a start time and a duration. The states may be grouped as one or more sequences of states. The entire schedule has a variable state order. The external adaptive control system generates presence data for reception by the controller assembly for each state and its associated duration.

In another aspect, an external adaptive control system and method receive progression data from one or more progressions in addition to queue data for one or more traffic lanes at an intersection and determine a non-linear schedule with one or more states corresponding to one or more individual phases with each state having a variable start time and a variable duration. The states may be grouped as one or more sequences of states. The entire schedule has a non-linear state order.

A progression includes a progression number for a number of vehicles that received a right-of-way at the corresponding intersection and a progression time when the vehicles received the right-of-way. In some instances herein, the right-of-way time is referred to as a green light time.

Progressions may occur at the start of a green light time or otherwise during a green light time, and the external adaptive control system 402 may receive one or more messages through the communication network 412 identifying one or more progressions. For example, a progression message with progression data may be transmitted from an upstream intersection signal controller assembly and/or external adaptive control system (sometimes referred to simply as a "controller" herein for simplicity) when the light at the upstream intersection turns green. The progression data would identify the number of cars waiting at the upstream intersection (the progression number), which just received a right-of-way, and the green light time corresponding to the progression (the progression time). If additional cars pass through the intersection at a later time while the signal indication still is green, and those vehicles were not accounted for in the original progression message, another progression message is transmitted from the upstream controller identifying the additional number of vehicles (the progression number) and the time the vehicles are passing though the intersection for the right-of-way (the progression time). The time period between the first progression and the second progression is referred to as a progression gap.

In other aspects, systems and methods of the present invention determine a non-linear schedule of states having a dynamic state order and variable state start times and durations without using progression data and/or queue data.

In another aspect, the external adaptive control system generates presence data to the signal controller assembly for up to two individual phases for each state of a schedule. When the signal controller assembly operates in a fully actuated mode, the presence data for up to two individual phases causes the controller assembly to actuate the traffic signal indicator or indicators for the traffic movements corresponding to the presence data. For example, the external adaptive control system may generate presence data for individual phases 1 and 6 to the signal controller assembly, causing the signal controller assembly to activate the traffic signal indicators for the individual phase 1 (northbound left turn) and individual phase 6 (northbound through) traffic movements. In another example, the external adaptive control system generates presence data for individual phases 4 and 8, thereby causing the signal controller assembly in the fully actuated operating mode to activate the traffic signal indicators for individual phase 4 (westbound through) and individual phase 8 (eastbound through).

In another aspect, systems and methods of the present invention determine a bandwidth of traffic along a corridor, such as a main street or an arterial, by determining a critical intersection having a most conflicting movement from among the intersections in the arterial system and identifying a guaranteed green light time for a right-of-way in a selected direction through the critical intersection. The selected direction may be a through-through individual phase, such as individual phases 2, 4, 6, and 8, or a turning direction, such as for individual phases 1, 3, 5, and 7. The system identifies a travel time between the critical intersection at the guaranteed green light time and another intersection in the arterial for a distance between the intersections at an expected speed and, therefore, an expected travel time. The system determines a guaranteed green light time for the second intersection based on those factors. In still another aspect, the critical intersection may change based on traffic volumes at the intersections in the arterial.

In still another aspect, a plan data identifying guaranteed green light times for intersections and minimum green durations through a traffic network, including guaranteed green light times and minimum green durations for a critical intersection main through direction, is used along with queue data to determine a non-linear schedule with states having a dynamic state order with dynamic state start times and durations. In still another aspect, plan data identifying guaranteed green light times and minimum green durations for intersections through a traffic network, including guaranteed green light times and minimum green durations for a critical intersection main through direction, is used along with queue data, progression data, and/or historical data to determine a schedule with dynamic states having a dynamic state order with dynamic state start times and durations. In still another aspect, a plan identifies guaranteed green light times and minimum green durations for coordinated phases.

In still another aspect, systems and methods in the present invention determine a period for a schedule. The schedule is completed in the period, and a new schedule with a new period starts after the period terminates. Both schedules include a guaranteed green light time and a minimum green duration for a selected direction where the selected direction receives the right-of-way at the guaranteed green light time and for the minimum green duration. Therefore, each schedule includes at least one state to serve the individual phase for the selected direction at the green light time for the minimum green duration. The state may start before the guaranteed green light time and/or extend past the minimum green duration so long as the state serves the individual phase for the selected direction at the guaranteed green light time for the minimum green duration. Additionally, the state may also serve an additional individual phase, so long as the individual phase for the selected direction is served at the guaranteed green light time for the minimum green duration. Moreover, the system may switch to another state that includes another individual phase, so long as the individual phase for the selected direction is served at the guaranteed green light time for the minimum green duration. In this aspect, the schedule has a non-linear state sequence (a sequence of states not having a linear order) that guarantees the periodic recurrence of a certain state or individual phase, where the start time and duration of that recurrence is variable.

In another aspect, the period may change for one or more schedules. In one example of this aspect, the period changes for a schedule based on the traffic volume at the intersection.

Figure 4:
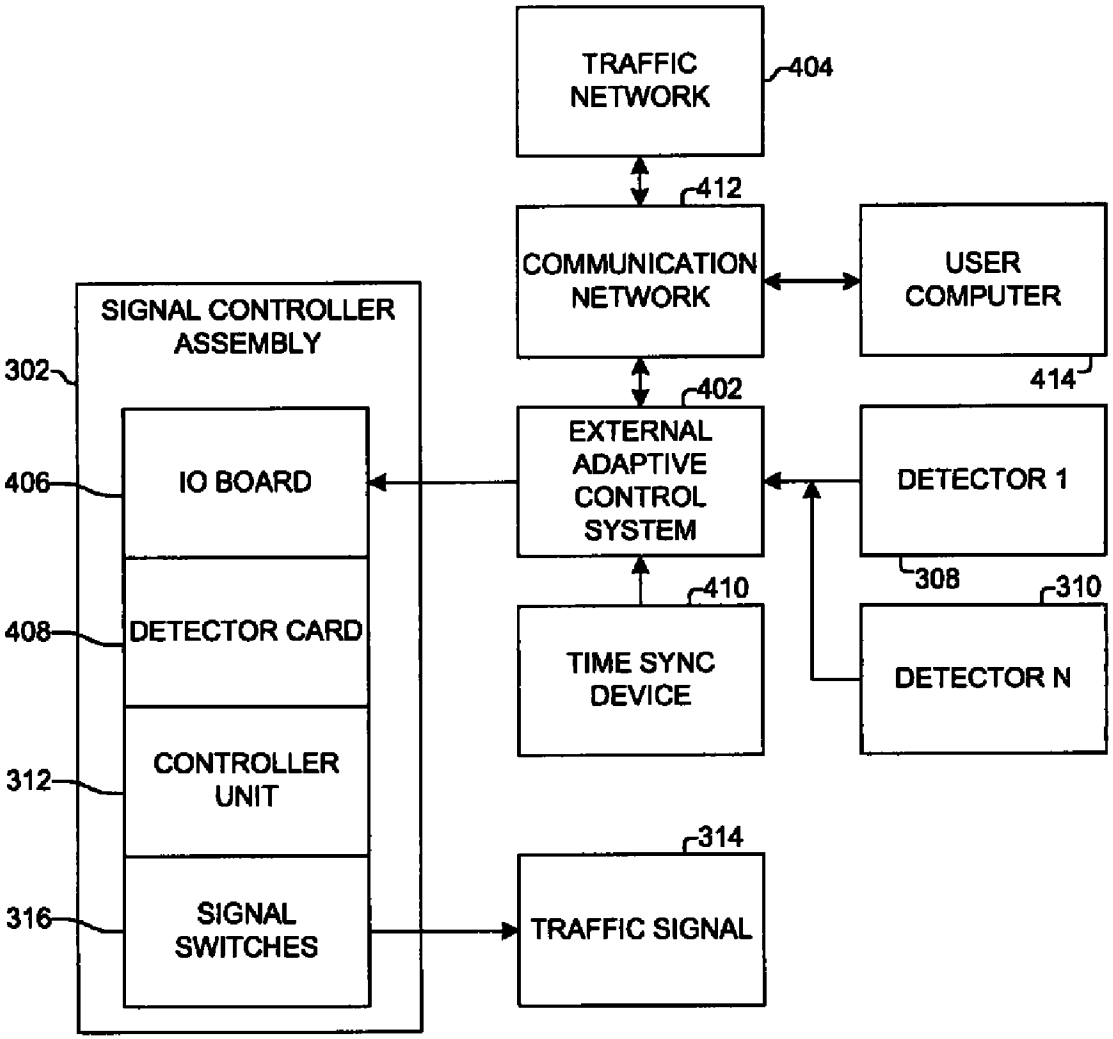
FIG. 4 is a block diagram of an external adaptive control system and a signal controller assembly.

FIG. 4 depicts an exemplary embodiment of an external adaptive control system 402. The external adaptive control system 402 is a fully adaptive control system that dynamically determines one or more non-linear schedules, each with one or more states of individual traffic movements or combinations of individual traffic movements. Each state has a start time and a duration. One or more states may be grouped as one or more sequences. The order of the states is variable, that is not fixed. The order of the states are not predefined or predetermined. The states also are not predefined or predetermined. They are selected in real time. For example, the schedule may include any first state, next include any other state, next include any other state, and so on.

In one embodiment, the external adaptive control system 402 determines a schedule with one or more sequences of states with each state having an individual phase or two individual phases, such as in a coordinated phase, a leading phase, a lagging phase, and/or an overlapping phase. A coordinated phase contains one or more individual traffic movements that are coordinated along a corridor of a traffic network. Typically, a coordinated phase coordinates the traffic movements for opposing through directions, such as north through and south through or east through and west through. The order of the states is variable, that is not fixed. The order of the states are not predefined or predetermined. The states also are not predefined or predetermined. They are selected in real time. For example, the schedule may include any first state, next include any other state, next include any other state, and so on.

The states are dynamically selected (for example, the states and the order of the states are selected in real time) to serve the individual phases at the intersection, are not based on a linear order, and are not based on a fixed reference point. For example, the selected states may include eastbound left through, then northbound through-southbound through, then eastbound left through again. Any order of states can be selected to serve an intersection. A single schedule can include the same state multiple times or otherwise serve a direction multiple times if needed. It is the order of states that changes for each schedule. The schedule is not based on a yield point or other fixed reference point. The states and the schedule are not limited to any linear order and are not limited based on a fixed reference point.

The external adaptive control system 402 also determines a period for the schedule. The period is the time is takes to serve all states in the schedule. A state split is the time allocated to each state in a selected time frame. A phase split as used with reference to the external adaptive control system 402 or the integrated adaptive control system described below is the time allocated to a particular individual phase in a selected time frame.

The period may be increased or decreased for a particular schedule. In one aspect, the period is increased or decreased based on traffic volume. For example, if the traffic volume is higher than an expected threshold, the period is increased. If the traffic volume is lower than an expected threshold, the period is decreased. The period may be increased or decreased for a selected time increment, such as between one and 30 seconds. Though, it may be higher than 30 seconds. A time increment of five or ten seconds is used in some instances. However, other time increments may be used.

In one example of this aspect, if queue data indicates one or more vehicles at the intersection did not receive a right of way in the prior period, the next period is increased, such as by between one and ten seconds. In the same example, if queue data indicates that no vehicles were present at the intersection at a selected time frame before the prior period terminated, the next period is decreased, such as by between one and ten seconds. The selected time frame may be, for example, the end plan time or from zero to ten seconds before the end of the prior period. Other examples exist.

In another example of this aspect, queue data for one or more selected directions or one or more individual phases is used to determine whether the period is increased or decreased. For example, if the queue data for a selected direction, such as the main street through direction, indicates that one or more vehicles for one or more traffic lanes in the selected direction did not receive a right of way in the prior period, the next period is increased, such as by between one and ten seconds. In the same example, if queue data indicates that the no vehicles were present in any traffic lane for the selected direction within a selected time frame before the prior period terminated, the next period is decreased, such as by between one and ten seconds. The selected time frame may be, for example, the end of the prior period or from zero to ten seconds before the end of the prior period. Other examples exist.

In another example of this aspect, queue data for a cross street direction is used to determine whether or not to increase a period. Queue data indicates that one or more vehicles for one or more traffic lanes in the selected direction did not receive a right of way in the prior period, the next period is increased, such as by between one and ten seconds. In the same example, if queue data indicates that the no vehicles were present in any traffic lane for the selected direction within a selected time frame before the prior period terminated, the next period is decreased, such as by between one and ten seconds. The selected time frame may be, for example, the end of the prior period or from zero to ten seconds before the end of the prior period. Other examples exist. Other examples of other selected directions exist for determining the period, such as a combination of one or more directions.

In one embodiment, the external adaptive control system 402 is configured with a plan. The plan identifies a guaranteed right-of-way (i.e. a guaranteed green light time) for a selected direction corresponding to an individual traffic movement. For example, the selected direction may be a northbound through direction. As another example, the selected direction may be a westbound left turn direction. In still another embodiment, a plan identifies guaranteed green light times and minimum green durations for coordinated phases.

The plan may identify a plan time for the guaranteed right-of-way. The time may be an absolute time or a relative time. The plan time specifies the time or time frame when the selected direction is to receive the right-of-way. The time frame includes a guaranteed green light time and a minimum green duration or plan end time. The guaranteed green light time may be a start time. Therefore, a plan time may identify the guaranteed green light time, including a starting time, and a minimum green duration, including an ending time, for the guaranteed right-of-way for the selected direction. In addition, the plan may identify a recurrence time in which the guaranteed green light times for the selected direction will repeat. In some embodiments, the recurrence time is the same as the period.

in one embodiment, the plan includes the guaranteed green time for at least one direction of traffic movement and a minimum green duration for the direction. For example, one plan identifies the guaranteed green time for a right-of-way for a selected direction of traffic movement through an intersection and the duration that direction will receive the right-of-way. The duration of the right-of-way from the guaranteed green time through the minimum green duration is referred to as a tunnel or bandwidth since the selected direction receives the right-of-way for that time frame. In another embodiment, a plan identifies guaranteed green light times and minimum green durations for coordinated phases.

In one embodiment, the guaranteed green light time for a selected direction of traffic movement is at the beginning of each period, such as when the period starts. In other examples, the guaranteed green light time can be at other times in the plan or period, such as a selected number of seconds in the period or a selected fraction of a period.

The minimum green duration for a plan may be increased or decreased from a prior plan. In one embodiment, the minimum green duration for the plan is determined based on the measured traffic flow through the intersection. In one example, the minimum green duration for the plan is determined based on the measured traffic flow through the intersection for the selected direction of traffic movement for the prior plan.

In one example, the flow rate of vehicles passing through the intersection is determined by counting the number of, or determining a traffic count for, the vehicles that pass through the intersection in the selected direction of the plan during a period. For example, a number of cars per second passing through the intersection in the selected direction of a prior period is determined. This rate is multiplied by the prior period of the prior plan to determine the number of vehicles that are expected to pass through the intersection during a current period of a current plan. A clearance time for a vehicle in seconds per vehicle then is multiplied by the number of expected vehicles to determine the number of seconds for the minimum green duration for the current plan. This minimum green duration for the current plan is the time the tunnel should be open for the current plan.

In another example, the flow rate of vehicles passing through the intersection is determined by counting the number of vehicles that pass through the intersection in the selected direction of the plan during the time frame the selected direction has the right-of-way during a period. For example, a number of cars per second passing through the intersection in the selected direction of the plan during the time frame the selected direction has the right-of-way during the prior period of the prior plan is determined. This rate is multiplied by the prior period of the prior plan to determine the number of vehicles that are expected to pass through the intersection in the selected direction during the current plan. A clearance time for a vehicle in seconds per vehicle then is multiplied by the number of expected vehicles to determine the number of seconds for the minimum green duration for the current plan. This minimum green duration for the current plan is the time the tunnel should be open for the current plan.

In another example, a prior plan has a period of 120 seconds. The guaranteed green time for the selected direction of traffic movement always starts at the beginning of the period (time zero) for a plan in this example, and the minimum green duration for the prior plan is 40 seconds. During the prior period, 60 cars passed through the intersection in the selected direction of traffic movement. This results in a flow rate of 0.5 cars per second in the selected direction during the prior plan. In this example, the clearance time is 1 second per car. Therefore, for the next plan, the minimum green time is 60 seconds (120 second×0.5 vehicles per second×1 second per vehicle).

If the period is changed for the current plan, 0.5 cars per second will be moved through the intersection in the selected direction. Thus, for example, if the period is changed to 140 seconds in the current plan, the minimum green duration is 70 seconds for an intersection.

If the intersection has two traffic lanes, each capable of moving 1 car per second through the intersection in the selected direction during the right-of-way, the intersection can move 2 cars per second through the intersection in the selected direction during the period. Therefore, the clearance time is 0.5 seconds per vehicle. In this example, the minimum green time is 35 seconds (140 seconds×0.5 vehicles per second×0.5 seconds per vehicle).

A schedule will include a state having an individual phase or traffic movement for the selected direction. The state may include another individual phase so long as the individual phase for the selected direction is served. For example, if the selected direction is northbound through, the state in the schedule may be only northbound through, northbound through with northbound left turn overlap, or northbound through with southbound through. Additionally, the particular state may change so long as the individual phase for the selected direction is served for the plan time. In the example above where the selected direction is northbound through, the schedule may start in a northbound through with southbound through state and change to a northbound through with northbound left turn overlap state during the plan time.

The state serving the individual phase for the selected direction may start before the guaranteed green time of a plan or another plan start time and/or extend beyond the minimum green duration or another plan end time. Thus, one or more states may be selected to serve one or more individual phases so long as the individual phase corresponding to the selected direction is present in one or more states during the plan time.

A plan might identify a green light time for a main through direction at a particular time of day or at a particular point in a period. Alternately, the plan may specify that the selected direction can be served at any point in a schedule, so long as it is served. In some instances, the plan identifies a guaranteed right-of-way for coordinated directions, such as for a north and south through coordinated direction or an east and west coordinated through direction. In one embodiment, the plan consists of green light times for a single coordinated main direction. In other examples, one or more plans identify guaranteed green light times for coordinated directions for multiple intersections, such as for an arterial.

One or more plans that consist of a range of starting and ending times for guaranteed right-of-way times for a selected direction for multiple intersections along an arterial in a traffic network 404 may be referred to as a tunnel, with the image of traffic moving along the arterial through tunnels of green lights. Messages describing the guaranteed green time and the minimum green duration for these tunnels, and the recurrence time in which they will repeat, are transmitted to one or more other intersections in the traffic network 404 and some embodiments. Alternately, each external adapter controller system 402 is configured with its own plan identifying guaranteed right-of-way times at its own intersection, and no messages are transmitted to other intersections in the traffic network identifying that plan. In another embodiment, one or more communications are transmitted to one or more other controllers in the traffic network identifying one or more plans for the particular external adaptive control system 402 and/or one or more other plans for one or more other external adaptive control systems.

In one aspect, the period determined for the schedule is changed based on traffic volume in the selected direction during the plan time. In this aspect, queue data is used to determine whether the period is increased or decreased. For example, if the queue data for a selected direction, such as the main street through direction, indicates that one or more vehicles for one or more traffic lanes in the selected direction did not receive a right of way during the plan time in the prior period, the next period is increased, such as by between one and ten seconds. In the same example, if queue data indicates that the no vehicles were present in any traffic lane for the selected direction within a selected time frame before the plan time in the prior period terminated, the next period is decreased, such as by between one and ten seconds. The selected time frame may be, for example, the end of the prior period or from zero to ten seconds before the end of the prior period. Other examples exist.

In one embodiment, the external adaptive control system 402 determines a schedule based on one or more plans for the intersection and queue lengths for one or more individual phases at the intersection. A queue length identifies one or more vehicles waiting for a right-of-way in one or more traffic lanes for a particular individual phase. Thus, multiple cars may be waiting at a red light in each of two traffic lanes for the westbound through direction of individual phase 4. Other vehicles may be waiting at a red light for a westbound left turn for individual phase 7. Additional cars may be waiting in one or more lanes for individual phases 3 and 8. Still other vehicles may be waiting in one or more traffic lanes for individual phases 1, 2, 5, and/or 6, depending on which individual phase currently has the right-of-way for the north and south directions. The queue can be identified for each individual phase, one or more traffic lanes for an individual phase, or in another manner.

In another embodiment, the external adaptive control system 402 determines a schedule based on one or more plans for the intersection, queue lengths for one or more individual phases at the intersection, and progressions approaching one or more individual phases at the intersection. In still another embodiment, the external adaptive control system 402 determines the schedule based upon one or more plans for the intersection, one or more plans for one or more other intersections in a traffic network, one or more queue lengths for one or more individual phases at the intersection, and one or more progressions approaching one or more individual phases at the intersection.

The external adaptive control system 402 generates presence data to the signal controller assembly 302 for each state and its associated duration, such as in one or more control signals, messages, or communications. The signal controller assembly 302 then controls the traffic signal 314 at the intersection.

In one embodiment, the signal controller assembly 302 is placed in the fully actuated mode. The external adaptive control system 402 receives signals for one or more detectors 308-310 (also referred to as vehicle sensors) at an intersection. The external adaptive control system 402 determines a schedule and generates presence data to the signal controller assembly 302 for one or more states, with each state having one or more individual phases.

The presence data corresponds to the presence of one or more vehicles at an intersection, such as at an approach to an intersection or waiting at a red light of an intersection. For example, if a state includes individual phases for northbound through and southbound through, the external adaptive control system 402 generates presence data corresponding to vehicles present in the individual phases for northbound through (individual phase 6) and southbound through (individual phase 2). In another example, if a state includes individual phases for westbound left turn and westbound through, the external adaptive control system 402 generates presence data corresponding to the individual phases for westbound left turn (individual phase 3) and westbound through (individual phase 8). Thus, for each state, the external adaptive control system 402 generates and transmits presence data corresponding to up to two individual phases. In some examples, the external adaptive control system 402 generates presence data corresponding to only a single individual phase, such as for a protected left turn or a through direction period. In other examples, the external adaptive control system 402 generates and transmits presence data corresponding to more than two individual phases. For example, for a 5-way or 6-way intersection, the external adaptive control system 402 generates and transmits presence data corresponding to up to three individual phases. Other examples exist.

The presence data may take the form of, and/or be included in, one or more communications or signals, such as detector calls, or other signals or communications transmitted from the external adaptive control system 402 to the signal controller assembly 302. The communications or signals may be wireless or wireline based signals. For example, the presence data may correspond to one or more detector calls from one or more loop detectors, one or more puck (magnetic) detectors, video cameras or other video detection devices, microwave detection devices, and/or other detection devices at the intersection. Alternately, the presence data may otherwise correspond to one or more vehicles detected by one or more loop detectors, one or more puck (magnetic) detectors, video cameras or other video detection devices, microwave detection devices, and/or other detection devices at the intersection. A combination of different types of detectors may be used at an intersection. Alternately, the communications or signals may be network communications, packet based communications, such as internet protocol packet communications, peer to peer communications, serial communications, or other communications that include the presence data. Other examples exist.

Because the signal controller assembly 302 is operating in the fully actuated mode, the presence data received from the external adaptive control system 402 causes the signal controller assembly to activate one more signal indications corresponding to the one or more individual phases corresponding to the presence data. The signal controller assembly 302 considers the presence data generated by the external adaptive control system 402 to be the actual detector data (also referred to as vehicle sensor data) from the detectors 308-310 at the intersection. Therefore, the signal controller assembly 302 processes the presence data as if it was the actual detector data. Thus, for example, if the external adaptive control system 402 generates presence data to the signal controller assembly 302 corresponding to presence data for individual phases 3 and 8, the signal controller assembly processes that presence data as if it was detector data from individual phases 3 and 8. Thus, the signal controller assembly 302 activates the signal indications for individual phases 3 and 8.

In one embodiment, the external adaptive control system 402 generates presence data corresponding to up to two individual phases (i.e. two individual traffic movements). This will then cause the signal controller assembly 302 to activate signal indications for up to two individual phases or traffic movements. This embodiment exists for signalized traffic intersection controllers that allow up to two individual phases or traffic movements to have the right of way simultaneously.

In another embodiment, for signalized traffic intersection controllers that allow more than two individual phases or individual traffic movements to simultaneously have the right-of-way, presence data corresponding to more than two individual traffic movements may be generated by the external adaptive control system 402. In this embodiment, the external adaptive control system 402 is aligned with the configuration of the signal controller assembly 302 and/or the number of individual traffic movements that can simultaneously receive the right-of-way at the intersection. The presence data generated by the external adaptive control system 402 includes presence data for up to the maximum number of individual traffic movements that can simultaneously receive the right-of-way from the signal controller assembly 302 at the signalized traffic intersection. Fewer than the maximum number of individual traffic movements may be served for a particular green light. Therefore, the presence data may correspond to fewer than the maximum number of individual traffic movements that can simultaneously receive the right-of-way at the same time.

The external adaptive control system 402 determines one or more queues from detector data from one or more detectors 308 and 310. For example, the detectors 308 and 310 are video cameras. Video data from the video cameras includes queue data and/or traffic count data for vehicles passing through the intersection. That is, queue data and traffic count data can be determined from the video data. In another example, the detectors 308 and 310 are puck (magnetic) detectors. In one aspect of this example, one puck detector is placed in the intersection for traffic approaching the intersection. Another puck detector is placed in the intersection for traffic departing the intersection, such as at the stop bar. The external adaptive control system 402 receives detector data from both puck detectors. Queues are determined by counting vehicles between the two pucks, and the traffic count for traffic departing the intersection is determined by the puck at the stop bar. Other examples exist.

The external adaptive control system 402 receives light state data from the signal controller assembly 302. The light state data identifies the individual phases that receive a right-of-way and when they receive the right-of-way. The light state data then is stored by the external adaptive control system 402 as historical data. The light state data is saved, rather than or in addition to the states transmitted from the external adaptive control system 402 to the signal controller assembly 302, in case the light states at the signal controller assembly are different than the states sent by the external adaptive control system. This may occur, for example, when an emergency vehicle overrides the signals or a pedestrian crossing is activated. Other examples exist.

The external adaptive control system 402 has an emergency mode that is used when one or more of the detectors 308-210 are not operational. In the emergency mode, the external adaptive control system 402 uses the historical data to determine the schedule. For example, if the detector 308 is not operational, such that queue data is not available, the external adaptive control system 402 determines the number of vehicles for a selected time frame from the historical data and uses that historical number of vehicles as the queue data to determine a schedule.

The historical data may be selected from the same time frame or a similar time frame, such as fifteen minute increments, from one or more prior days, weeks, months, or another selected time frame. For example, if one or more detectors 308-310 are not operational or the external adaptive control system 402 otherwise is not receiving detector data on a Wednesday, the selected time increment for the same time of day for each of the previous five work days may be considered. Alternately, the selected time increment for the same time of day for each Wednesday of the previous four weeks may be considered. In another example, if no data is available for any such Wednesday, then the previous day's data is used. The highest number of vehicles for that selected time increment may be used. Alternately, the historical data for the selected time increment may be averaged or normalized. Other examples exist.

In one embodiment, the IO board 304 and/or the detector card 306 are replaced with a new IO board 406 and/or a new detector card 408. The interface between the detector cards and the controller unit 312 at the signal controller assembly 302 is one of the only standardized pieces of equipment and interfaces throughout the various types of signal controller assemblies. Thus, for example, the detector card interface and/or the IO board are standardized to accept physical connections from loop detectors, video camera detectors, puck detectors, and/or other detectors. Since there are many types of detectors, the conventional signal controller assembly enables the replacement of the detector cards to interface with the various detectors. Therefore, the external adaptive control system 402 can interface with the signal controller assembly 302 without having to change any physical or software systems in the signal controller assembly other than the detector card. The signal controller assembly 302 is placed in the fully actuated mode, and the external adaptive control system transmits presence data to the signal controller assembly through the IO board and/or detector cards.

The IO board 406 communicates with the external adaptive control system 402. For example, the IO board 406 is a physical interface to the external adaptive control system 402. In one example, the external adaptive control system 402 transmits communications to, and receives communications from, the IO board 406 as serial communications.

The detector card 408 converts the communications received by the IO board 406 into a format processable by the controller unit 312 and converts communications from the controller unit for transmission to the IO board. For example, the detector card 408 converts the communications with the presence data to a format processable by the controller unit 312 and converts light state data for transmission to the IO board. The replacement of the IO board 304 and/or the detector card 306 with the new IO board 406 and/or new detector card 408 is optional in some embodiments.

A time synchronization device 410, such as a global positioning system (GPS) device or Internet time server, transmits current time data to the external adaptive control system 402. The time synchronization device 410 is optional in some embodiments.

A communication network 412 includes a wireless and/or wireline network. In one example, the communication network includes a packet network, such as an internet protocol (IP) packet network. The communication network 412 is optional for some embodiments.

In some embodiments, the external adaptive control system 402 optionally receives data from, and transmits data through, the communication network 412. For example, the external adaptive control system 402 optionally may receive a traffic count of vehicles from one or more other intersections in a traffic network, such as for vehicles that will approach the intersection where the external adaptive control system is stationed. The external adaptive controller system 402 also receives the time at which the traffic count of vehicles was released from the corresponding intersection, such that the traffic account of vehicles received a right-of-way. In other instances, a controller assembly from another intersection or another external adaptive control system from another intersection transmits progression data identifying one or more progressions from the corresponding intersection, including one or more progression numbers and/or progressions times.

In some embodiments, the external adaptive control system 402 optionally also transmits progressions for the intersection it controls to one or more other controllers in the traffic network, such as through the communication network 412. For example, the external adaptive control system 402 may transmit progressions to a downstream controller. In one example, the progressions from the external adaptive control system 402 include a progression number for a number of vehicles having a right-of-way and a progression time for the time the vehicles have the right-of-way, such as when the signal light turns green. The external adaptive control system 402 also transmits other progression data for other progressions that occur during the right-of-way, such as when another progression occurs after a progression gap. In some instances, the progression data includes only the progression number and not the progression time. In other instances, the progression data includes only the progression time.

The external adaptive control system 402 optionally transmits and/or receives other communications, including data, through the communication network 412. Examples include plans, maximum and minimum green lights times, and/or other configuration data. Other examples exist.

A user computer 414 enables users to transmit configuration data to the external adaptive control system 402 and to receive configuration data from the external adaptive control system. Detector data from the detectors 208-310 is transmitted through the communication network 412 to user computer 414 in some embodiments. The detector data may be transmitted by the detectors or by the associated external adaptive control system. In one embodiment, the detectors are video cameras. In this embodiment, the user computer 414 also is able to control one or more of the video cameras. The user computer 414 is optional in some embodiments.

The external adaptive control system may be configured as a local controller at a single intersection. It also may be configured in a traffic network, including along an arterial, with other controllers.

Figure 5:
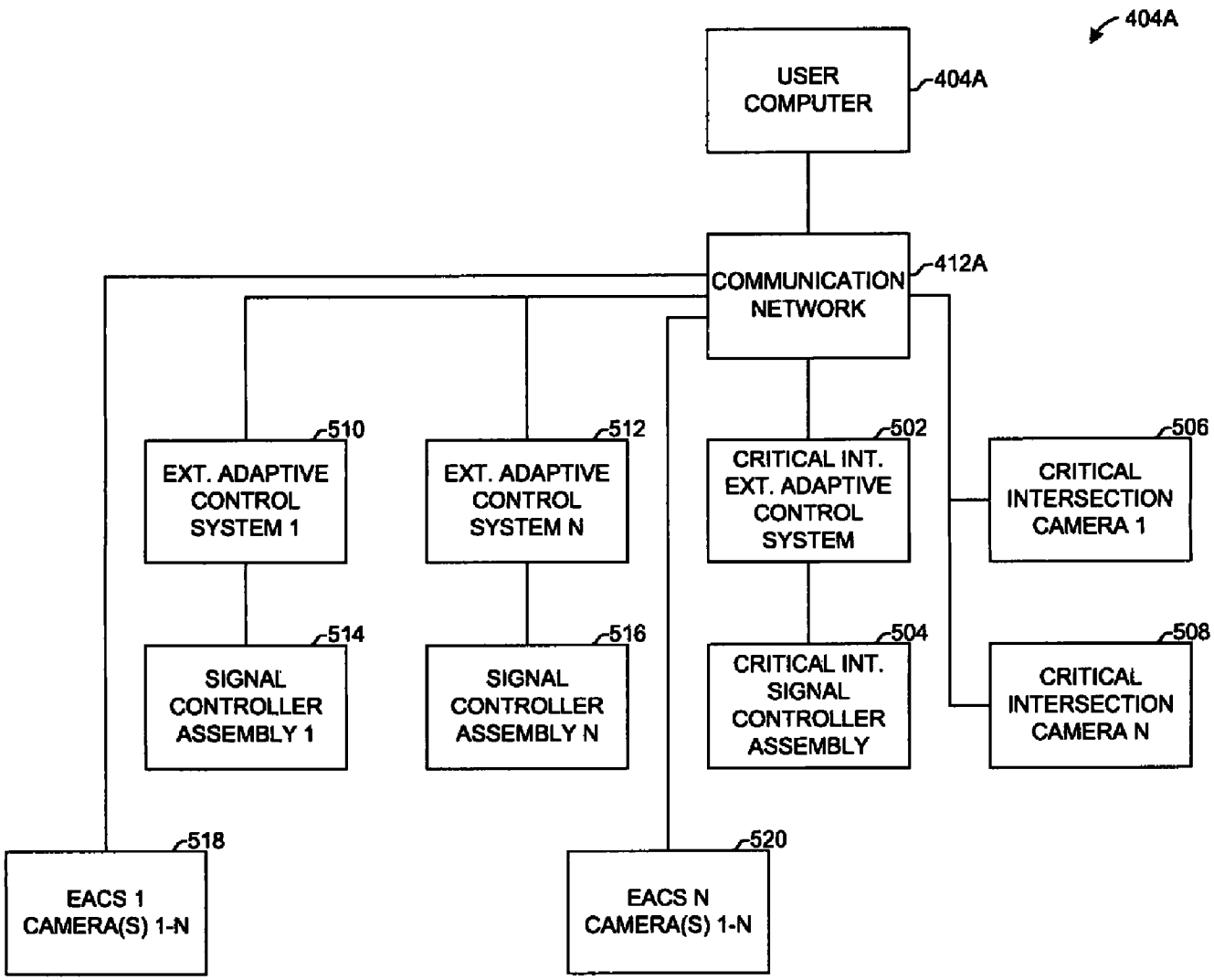
FIG. 5 is a block diagram of external adaptive control systems in a network according to an embodiment of the present invention.

FIG. 5 depicts an embodiment of an external adaptive control system 502 in a traffic network 404A at a critical intersection and communicating with a signal control assembly 504 at the critical intersection. In the embodiment of FIG. 5, the external adaptive control system 502 at the critical intersection has camera 1 506 through camera N 508, where N is a number greater than 1. However, other detectors may be used, such as loop detectors, puck (magnetic) detectors, other detectors, and/or a combination of detectors. The system includes other external adaptive control systems 1-N 510-512, each communicating with a corresponding signal controller assembly 1-N 514-516, where N is a number greater than 1. Each other external adaptive control system 1-N 510-512 has corresponding cameras 1-N 518-520. N represents a different number for different elements and for the same elements at different intersections, such as for N external adaptive control systems and N cameras or N cameras at one intersection and N cameras at another intersection, and need not be the same number. Thus, for example, a particular external adaptive control system 1 510 has corresponding cameras 1-N 518 at a particular intersection. However, other detectors may be used for one or more intersections, such as loop detectors, puck (magnetic) detectors, other detectors, and/or a combination of detectors.

The external adaptive control systems 502, 506, 510, and 512 communicate via the communication network 412A. Therefore, the critical intersection external adaptive control system 502 may receive progression data from the external adaptive control system 1 510 via the communication network 412A, and the critical intersection external adaptive control system may transmit progression data for its intersection to another external adaptive control system N 512. In the embodiment of FIG. 5, the cameras communicate with the corresponding external adaptive control system via the communication network 412A. However, in other embodiments, the cameras may be configured to communicate directly with the external adaptive control system or through another communication network (not shown) and not through the communication network 412A.

Figure 6:
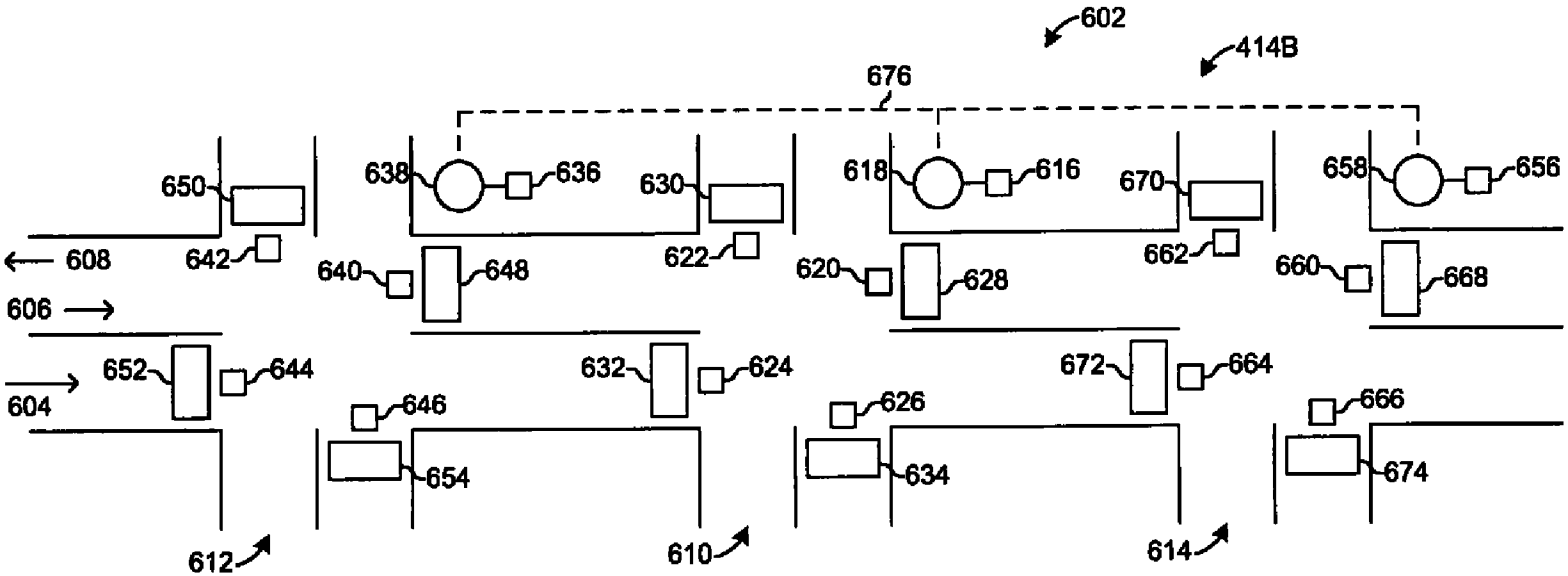
FIG. 6 is a diagram of intersections using external adaptive control systems in accordance with an embodiment of the present invention.
Figure 7:
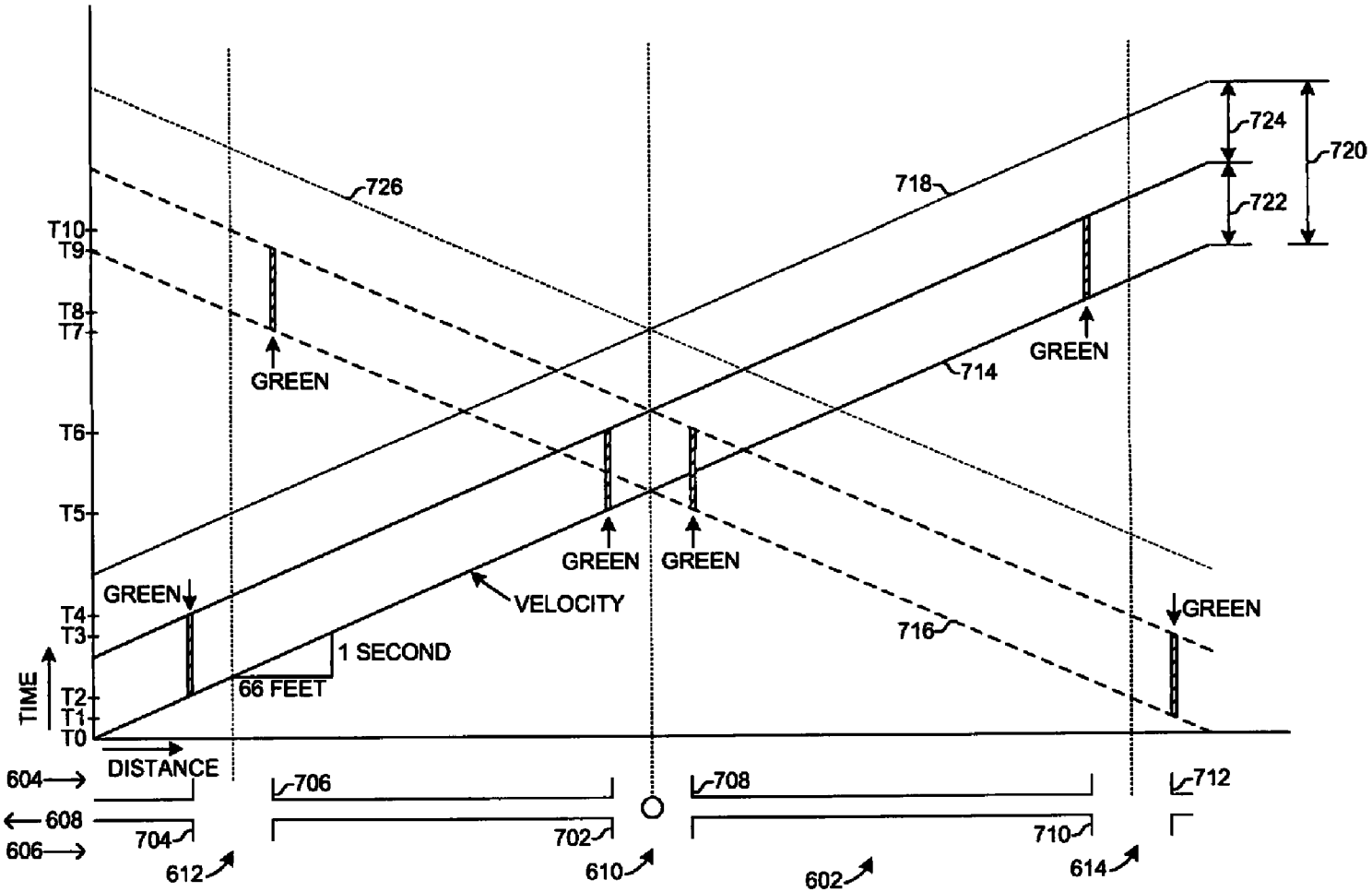
FIG. 7 is a time-space diagram of an arterial control in accordance with an embodiment of the present invention.

FIGS. 6 and 7 depict an exemplary embodiment of multiple external adaptive control systems operating in a traffic network 602. As depicted in FIG. 6, the traffic network includes a corridor, such as a main street 604 or an arterial, that has coordinated directions for northbound 606 and southbound 608. A portion of the traffic network 602 and the main street 604 are depicted in FIG. 6, including a critical intersection 610 and two other intersections 612 and 614. The first intersection 612 is south of the critical intersection 610, and the critical intersection is south of the second intersection 614.

Therefore, for southbound traffic, the first intersection 612 is downstream of the critical intersection 610, and the critical intersection is downstream of the second intersection 614. Conversely, for northbound traffic, the first intersection 612 is upstream of the critical intersection 610, and the critical intersection is upstream of the second intersection 614. Each intersection includes a main direction and a cross street direction.

At the critical intersection 610, a signal controller assembly 616 controls a traffic signal with signal indicators (not shown). An external adaptive control system 618 receives video data from cameras 620-626 collecting video images from corresponding detection zones 628-634. The video data includes queue data and/or traffic count data for vehicles passing through the intersection 610. The external adaptive control assembly 618 determines one or more schedules for the intersection 610 and generates presence data to the signal controller assembly 616 for each state in each schedule, with each state having one or more individual phases. The states may be grouped as one or more sequences of states. In other embodiments, one or more of the cameras 620-626 may be replaced by other types of detectors, such as loop detectors, puck (magnetic) detectors, other detectors, or a combination of the detectors, and the detection zones 628-634 may be larger or smaller.

Similarly, the first intersection 612 has a signal controller assembly 636 controlling a traffic signal (not shown). A corresponding external adaptive control system 638 determines one or more schedules for the intersection 612 and generates presence data to the signal controller assembly 636 for each state in each schedule, with each state having one or more individual phases. The states may be grouped as one or more sequences of states. The external adaptive control system 638 receives video data from cameras 640-646 of corresponding detection zones 648-654 at the first intersection 612. The video data includes queue data and/or traffic count data for vehicles passing through the intersection 612. In other embodiments, one or more video cameras 640-646 may be replaced by other types of detectors, such as loop detectors, puck (magnetic) detectors, other detectors, or a combination of the detectors, and the detection zones 648-654 may be larger or smaller.

The second intersection 614 also includes a signal controller assembly 656 that controls a corresponding traffic signal (not shown). A corresponding external adaptive control system 658 determines one or more schedules for the intersection 614 and generates presence data to the signal controller assembly 656 for each state in each schedule, with each state having one or more individual phases. The states may be grouped as one or more sequences of states. The external adaptive control system 658 receives video data from video cameras 660-666 for detection zones 668-674 at the second intersection 614. The video data includes queue data and/or traffic count data for vehicles passing through the intersection 614. One or more video cameras 660-666 may be replaced by other types of detectors, such as loop detectors, puck (magnetic) detectors, other detectors, or a combination of the detectors, and the detection zones 668-674 may be larger or smaller.

The external adaptive control systems 618, 638, and 658 communicate with each other through one or more communication links 676 of a communication network 414B. The communication link or links 676 may include one or more wireless connections and/or one or more wire line connections in a wireless network, a wire line network, or a combination wireless and wire line network.

The cameras 620-626, 640-646, and 660-666 each communicate with their respective external adaptive control system 618, 638, and 658 through wireless and/or wire line communications. A device is at an individual intersection 610-614 may be configured the same or different than other devices at the other individual intersections. Additionally, devices at one or more of the intersections 610-614 may be configured to communicate via the communication network to one or more user computers, network computers, servers, and/or other devices, including one or more mobile devices or other portable devices using one or more communication methods.

In one example, the critical intersection 610 is identified by comparing the average queue size over the most recent fifteen minutes on the non-arterial phases at each intersection 610-614 in the traffic network 602. Summing the averages produces a total average. Each intersection reports this total value to the current critical intersection 610, which then compares all the values. If another intersection has a significantly higher total than the current critical intersection 610 (for example, a higher total number or percentage), the critical intersection could be shifted to this new intersection. For example, the higher total may be a number within a range, such as between 10 and 40 percent, or a higher or lower value. In one example, the higher total is 25% more than the current critical intersection. This process is repeated periodically to identify changes in traffic conditions that create a different critical intersection. However, other examples exist.

FIG. 7 depicts an exemplary embodiment of multiple plans for multiple intersections 610-614 in the traffic network 602 along the main street 604. The plans taken together create a tunnel of green light or right-of-way times from the first intersection 612, through the critical intersection 610, and to the second intersection 614.

Each intersection 610-614 has locally coordinated individual phases for coordinated directions traveling northbound and southbound resulting in coordinated movements through the main street 604. In this instance, the locally coordinated individual phases at the critical intersection 610 result in the northbound through and southbound through individual phases having a common green light time. However, the first and second intersections 612 and 614 do not have a common green light time for the northbound through and southbound through individual phases.

The external adaptive control system 618 at the critical intersection 610 determines a plan for green light times for the northbound and southbound coordinated individual directions. The plan times are guaranteed green light times for the coordinated directions. The plan times may be preconfigured and/or calculated based upon existing traffic conditions, such as traffic flow through the critical intersection 610 and/or one or more of progressions to and from the critical intersection, queue lengths, and/or historical data. In one example, the plan time is preconfigured for the first schedule upon initialization and start-up of the external adaptive control system 618, and the following plans are determined based on the traffic flow at the critical intersection.

The distance is noted between the critical intersection 610 and the first intersection 612 and between the critical intersection and the second intersection 614. A selected travel velocity (also referred to as travel speed) is expected between each of the intersections 610-614, which may be configured or determined based upon current traffic conditions, such as a posted speed limit, a time of day, progressions, queue lengths, and/or other traffic conditions. The travel velocity may be different between each intersection 610-612 and 610-614.

Since the distance is known and a travel speed is expected between the intersections 610-612 and 610-614, a travel time is determined for a vehicle to travel between the first intersection 612 and the critical intersection 610. Additionally, a travel time therefore is determined between the critical intersection 610 and the second intersection 614.

In an example of FIG. 7, the expected travel speed is 45 miles per hour (MPH) between each of the intersection 610-614, and the distance is known between each of the intersections. The external adaptive controller assembly 618 at the critical intersection 610 has a plan for guaranteed right-of-way times for the northbound through and southbound through coordinated directions starting at Time 5 and ending at Time 6. Since the external adaptive control system 618 is at the critical intersection 610, the plans for the coordinated through directions start and end at the same time or approximately at the same time for the embodiment of FIG. 7. Since the expected travel speed for the main street 604 between the first intersection 612 and the critical intersection 610 is known, an expected travel time is determined between the first intersection 612 and the critical intersection 610. Similarly, since the distance is known between the critical intersection 610 and the second intersection 614, and an expected travel speed is known between the critical intersection and the second intersection, an expected travel time is determined for a progression between the critical intersection and the second intersection.

In one embodiment, the external adaptive control system 618 at the critical intersection 610 has a plan, either through a preconfiguration or a calculation made at the external adaptive control system, and the other external adaptive control systems 638 and 658 at the intersections 610-614 along the main street 604 locally determine plans for the corresponding coordinated directions along the main street. The other external adaptive control systems 638 and 658 base their plans on the plan of the external adaptive control system 618 for the critical intersection 610 and the expected travel time between the critical intersection and the other two intersections 612-614, respectively.

The external adaptive control system 638 at the first intersection 612 determines its plans for the northbound and southbound coordinated directions along the main street 604 based on the plans from the external adaptive control system 618 at the critical intersection 610 and the expected travel time between the first intersection and the critical intersection. In this instance, since the first intersection 612 is south of the critical intersection 610, the external adaptive control assembly 638 configures its guaranteed right-of-way for the northbound direction to be equivalent to the guaranteed right-of-way time for the northbound direction at the critical intersection 610 minus the expected travel time between the intersections, such as between the northbound stop bar 702 at the critical intersection and the northbound stop bar 704 at the first intersection. For the southbound direction, since the first intersection 612 is south of the critical intersection 610, the external adaptive control system 638 at the first intersection determines its guaranteed right-of-way time to be equivalent to the guaranteed right-of-way time for the southbound direction at the critical intersection 610 plus the expected travel time between the intersections, such as between the southbound stop bar 706 at the first intersection and the southbound stop bar 708 at the critical intersection.

Similarly, for the northbound direction, the external adaptive control system 658 at the second intersection 614 determines its guaranteed right-of-way time is equal to the northbound guaranteed right-of-way time at the critical intersection 610 plus the expected travel time, such as between the northbound stop bar 710 at the second intersection and the northbound stop bar 702 at the critical intersection 610. In the southbound direction, the external adaptive control system 658 determines the guaranteed right-of-way time to be equal to the southbound guaranteed right-of-way time at the critical intersection 610 minus the expected travel time, such as between the southbound stop bar 712 of the second intersection and the southbound stop bar 708 of the critical intersection 610.

Therefore, for multiple external adaptive control systems along a main street, the downstream external adaptive control system determines its plan for a direction to be equivalent to the guaranteed right-of-way time at the critical intersection plus the expected travel time. The external adaptive control system upstream from the critical intersection determines it's guaranteed right-of-way time for its plan for the direction to be equal to the guaranteed right-of-way time at the critical intersection minus the expected travel time. Since the intersections will be both upstream and downstream from the critical intersection for a particular coordinated direction, each intersection will have at least two plans, one for the upstream direction guaranteed right-of-way time from the critical intersection and a second plan for the downstream direction guaranteed right-of-way time from the critical intersection.

The duration of the guaranteed right-of-way or green light time is referred to as the bandwidth, and each intersection can have a different bandwidth than another intersection. This is the case, for example, because each external adaptive control system locally determines its own non-linear schedule and the period for the schedule. In addition, each intersection has a red light time where vehicles are not given the right-of-way and a change light time for lights changing from green to red (or from right-of-way to not right-of-way), including a yellow light indicator. The period for a particular schedule includes the green light time, the red light time, and the change light time for the coordinated direction. The next period starts at the next coordinated green light time for the next plan.

Each external adaptive control system locally determines the states for its schedules after the plans are determined. The plans for a particular external adaptive control assembly identify guaranteed right of way times for a direction or multiple directions. For example, the plans may identify guaranteed right of way times for coordinated traffic flow through the intersections 610-614 for two directions, such as northbound through and southbound through. While the critical intersection 610 will have a green light for the northbound and southbound directions at the same time, the other intersections 612 and 614 will not. Thus, the traffic flow is coordinated in this example for the directions. In another example, traffic for one or more directions is coordinated for one or more intersections. For example, a coordinated traffic flow may be two or more coordinated individual phases or individual directions of traffic movements at a single intersection. Alternately, a coordinated traffic flow may be a coordinated flow of traffic between multiple intersections, including for one selected direction or multiple selected directions. Additionally, a traffic flow may be coordinated for changes of direction, such as when an intersection in a network has a bend, a "T", or another change in direction. In this example, one or more directions at each intersection is coordinated for the group of intersections in the traffic network.

Additionally, the external adaptive control system may select one or more states having the green light for the selected direction during the plan times and may change states during the plan times, with each state including at least one individual phase to serve the selected direction. The external adaptive control system determines the other states for the schedule based on current traffic conditions, such as queue data or one or more of queue data, progression data, and/or historical data. The external adaptive control system also determines the period for each schedule. Therefore, each schedule is non-linear and variable.

In one example of the embodiment of FIG. 7, the external adaptive control system 618 at the critical intersection 610 is configured with plans identifying guaranteed green light times for the northbound and southbound coordinated directions along the main street 604. In this example, the plans include green light times for the northbound and southbound coordinated directions starting at time T5 and ending at time T6. The expected travel speed is 45 miles per hour (MPH) between each of the intersections 610-614 and the distance is known between each of the intersections. Therefore, the expected travel time also is known between the corresponding intersections 610-614. In this example, the external adaptive control system 618 at the critical intersection 610 transmits its plans to the external adaptive control systems 638 and 658 at the other intersections 612 and 614. Each of the other external adaptive control systems 638 and 658 are configured with the expected travel time. The external adaptive control system 638 at the first intersection 612 determines the northbound (i.e., downstream) plan to be equal to the northbound plan at the critical intersection minus the expected travel time. Therefore, the northbound plan at the first intersection starts at time T2 and ends at time T4. The external adaptive control system 638 at the first intersection 612 also determines the southbound (downstream) plan as being equal to the southbound plan from the critical intersection 610 plus the expected travel time. Therefore, the southbound plan at the first intersection starts at time T7 and ends at time T9.

The external adaptive control system 658 at the second intersection 614 likewise determines its plans based upon the plans at the critical intersection and the expected travel time. The external adaptive control system 658 determines its northbound (upstream) plan to be equal to the northbound plan at the critical intersection 610 plus the expected travel time. Therefore, the northbound plan at the second intersection 614 starts at time T8 and ends at time T10. Similarly, the external adaptive control system 658 at the second intersection 614 determines its southbound (upstream) plan to be equal to the southbound plan at the critical intersection 610 minus the expected travel time. Therefore, the southbound plan at the second intersection starts at time T1 and ends at time T3.

The plans for the intersections 610-614 therefore create a tunnel of green lights for the coordinated directions. In this example, the guaranteed green light at the first intersection 612 starts at time T2 and ends at time T4. In the same direction, the critical intersection 610 has a green light time starting at time T5 and ending at time T6. In the same direction, the second intersection 614 has a green light time starting at time T8 and ending at time T10. In the southbound direction, the second intersection has a green light time starting at time T1 and ending at time T3. The critical intersection has a green light time starting at time T5 and ending at time T6. Finally, in the same direction, the first intersection has a green light time starting at time T7 and ending at time T9.

The green light times from the first intersection 612, through the critical intersection 610, and to the second intersection 614 in the northbound direction is referred to as a speed line 714, which has a velocity (or speed) and a slope of time over distance. Similarly, the line 716 extending in the southbound direction from the green light time at the second intersection 614, through the critical intersection 610, and to the first intersection 612 is referred to as a speed line having a velocity (or speed) and a slope of the time over distance. The period of time between successive speed lines 714 and 718 at a particular intersection is the period 720 for the schedule at that intersection. The period 720 includes the right-of-way time 722 and the no right-of-way time 724, where the no right-of-way time includes the red light time and the change light time. Similarly, the successive speed lines 716 and 726 in another direction for a particular intersection is the period for the schedule at that particular intersection.

Figure 8:
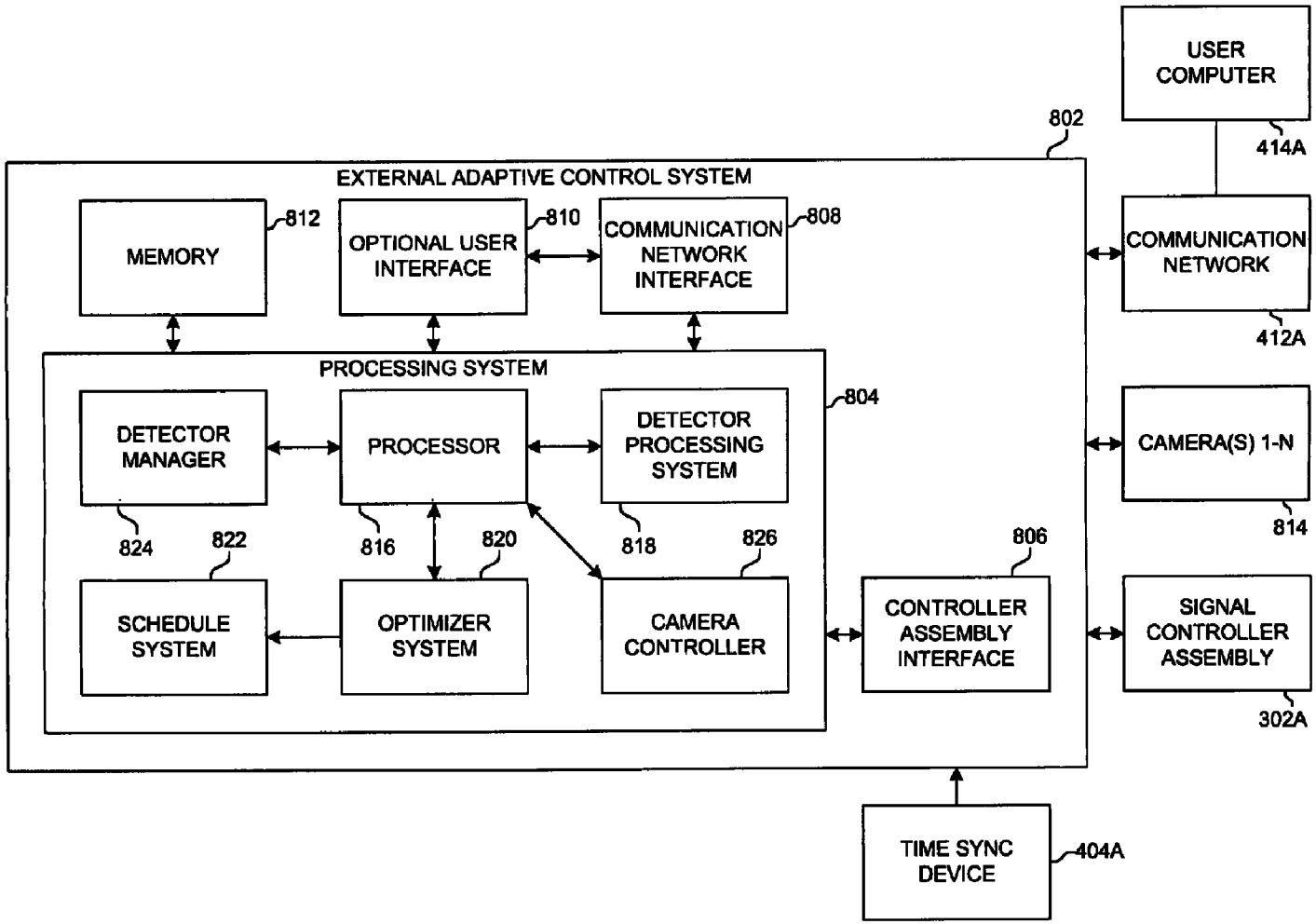
FIG. 8 is a block diagram of an external adaptive control system.

FIG. 8 depicts an exemplary embodiment of an external adaptive control system 802. The external adaptive control system 802 is configured to generate presence data to a signal controller assembly 302A. Since the signal controller assembly 302A is in the fully actuated mode, it believes there are vehicles existent in the one or more traffic lanes for one or more individual phases corresponding to the presence data transmitted by the external adaptive control system 802. Therefore, the external adaptive control system 802 is able to control the signal controller assembly 302A simply by transmitting the particular presence data for the particular individual phase or individual phases that should receive the right-of-way according to the schedule determined by the external adaptive control system. This enables the external adaptive control system 802 to be used with a wide variety of existing signal controller assemblies without having to modify the processing system in the signal controller assembly, software in the signal controller assembly, or hardware in the signal controller assembly. Therefore, cities, counties, states, and traffic engineers do not have to replace the existing signal controller assemblies at existing signalized intersections with new signal controller assemblies. The operation of the existing signal controller assembly is modified by the external adaptive control system.

The external adaptive control system 802 includes a processing system 804, a controller assembly interface 806, a communication network interface 808, a user interface 810, and a memory 812. One or more interfaces may be distributed or integrated.

The processing system 804 processes all data in the external adaptive control system 802 to control the external adaptive control system and its associated devices. The processing system 804 receives video data from one or more video cameras 814. The processing system 804 optionally receives one or more of progression data from other external adaptive control systems, plans from other external adaptive control systems, and the current time from a time synchronization device 410.

The processing system 804 processes that data, as well as configuration data for the signals, indications, and/or intersections or individual phases at the intersection and/or historical data, and determines a non-linear schedule. The schedule includes one or more states, where each state has one or more individual phases. The states may be grouped in one or more sequences. In one example, each state has up to two individual phases. In another example, a sequence of states includes up to three states. For example, for an eight phase intersection, one sequence of states may include two states and another sequence of states may include three states. Other examples exist. In other example, more than two individual states may be provided for a single state, such as for an intersection having more than eight phases. The present system may operate in multiple types of intersections, including 2, 3, 4, 5, and 6 way intersections. Other examples exist.

The processing system 804 transmits the presence data corresponding to each individual phase for the duration of each state in the schedule. For example, where a state has two individual phases, each individual phase has a duration for that state. The processing system 804 generates presence data corresponding to each individual phase for the duration the individual phase receives the right-of-way. After the individual phase no longer receives the right-of-way, the processing system 804 transmits presence data corresponding to the one or more individual phases for the next state for the duration of that state. The processing system 804 continues in this manner for each state in the schedule.

The processing system 804 has one or more processors 816. The processor transmits data for storage on the memory 812 and retrieves data from the memory. The processor 816 operates other systems, such as software, firmware, algorithms, and/or other instructions.

The video processing system 818 is a detector processing system that operates on the processor 816 and that receives raw data from the detectors, which in the case of FIG. 8 are the cameras 814. The video processing system 818 converts the raw data from the detectors into one or more queue counts for one or more individual phases and reports the queue counts to the detector manager 824, for example as queue data. The video processing system 818 also converts the raw data from the detectors into one or more traffic counts of vehicles passing through the intersection for one or more individual phases and reports the traffic counts to the detector manager 824, for example as traffic count data.

In one embodiment, the video processing system 818 receives video data transmitted by the video cameras 814. The video processing system 818 also may process video data received from other devices, including other external adaptive control systems, user computers, and/or other processors.

The video processing system 818 processes the video data to determine one or more queue lengths for one or more traffic lanes for one or more individual phases at an intersection. For example, the video processing system 818 processes video data for a particular camera for a particular detection zone at an intersection. The detection zone may include one or more individual traffic lanes and one or more individual phase. For an eight phase intersection, the video processing system 818 receives video data corresponding to eight individual phases, each with one or more traffic lanes, and processes the video data to determine the queue lengths for each of the eight individual phases. In one example, four video cameras transmit video data to the external adaptive control system 802, which is processed by the video processing system 818. In another example, eight video cameras transmit video data to the external adaptive control system 802, which is processed by the video processing system 818.

The video processing system 818 also may receive and process video data from fewer than all individual phases at the intersection. For example, the video processing system 818 may process video data for only four individual phases at the intersection.

The video processing system 818 determines a queue length, i.e. a number of vehicles waiting for a right-of-way for an individual phase at an intersection. The video processing system 818 also determines a through traffic count, which is a number of vehicles passing through the intersection for a particular individual phase during a right-of-way. The video processing system 818 also determines a left turning traffic count passing through the intersection for individual phases during a right-of-way. The term "traffic count" means a through traffic count and/or a left turning traffic count, depending on the one or more individual phases receiving the right-of-way. Therefore, for a northbound left turn overlap state, the traffic count includes both the through traffic count for the northbound through individual phase and the left turn traffic count for the northbound left turn individual phase. However, the traffic counts may be transmitted separately to downstream intersections corresponding to the individual phase. For example, the portion of the traffic count allocated to the northbound through direction, which is the through traffic count, may be transmitted only to the intersection downstream of the northbound through individual phase. Similarly, the portion of the traffic count allocated to the northbound left turn individual phase, which is the left turn traffic count, may be transmitted only to the intersection downstream of the northbound left turn individual phase. In another embodiment, both portions of the traffic count are transmitted to all downstream intersections for each individual phase. In another embodiment, all traffic counts are transmitted to all downstream intersections for each individual phase, but the portion of the corresponding traffic count for the corresponding individual phase is separately identified to the corresponding downstream intersection.

The optimizer system 820 determines an optimized schedule with one or more states. In one embodiment, the optimizer system 820 determines the schedule having one or more series of states with each series having two or three states and with each state having up to two individual phases. The total of all states for the schedule has a period. The optimizer system 820 operates on the processor 816. In one aspect, the optimizer system 820 determines a non-linear schedule with one or more states. In another aspect, the optimizer system 820 determines a variable schedule with one or more states.

In one embodiment, the optimizer system 820 determines the schedule based on queue lengths of one or more queues at one or more individual phases of an intersection. In another embodiment, the optimizer system 820 determines the schedule based on queue lengths at one or more individual phases and one or more vehicles approaching the intersection from one or more directions. For example, an individual phase may have three vehicles in a queue waiting for the right-of-way and four vehicles approaching the intersection in the same direction. Therefore, it is possible that the schedule optimizer may have to consider that seven vehicles will require the right-of-way for the individual phase before the individual phase receives the right-of-way.

In another embodiment, the optimizer system 820 determines the schedule based on one or more queue lengths for one or more queues at the intersection and one or more progressions approaching the intersection from one or more other intersections. The progression data includes a number of vehicles receiving the right-of-way (progression number) at another intersection and the time the number of vehicles receives the right-of-way (progression time). For example, the progression data may identify a number of vehicles just receiving a green light at an intersection. Alternately, the progression data may identify another number of vehicles passing through the intersection during the same green light.

In another embodiment, the optimizer system 820 determines the optimized schedule based on one or more queue lengths for one or more queues of one or more individual phases at the intersection and one or more plans for the intersection. As discussed above, a plan identifies a guaranteed right-of-way (green) time for a selected direction or guaranteed right-of-way (green) times for coordinated directions. In other embodiments, the optimizer system 820 may consider other data. For example, the external adaptive control system 802 may be configured with other configuration data, such as a maximum and/or minimum green light time for a direction, an individual phase, coordinated directions, and/or coordinated individual directions. The configuration data also may include a clearance time, a cut off time, and/or a light change time.

The clearance time is an amount of time it takes for one or more vehicles to clear an intersection when they have a right-of-way. In one example, the clearance time is calculated as the quantity of the queue length times 2.1 plus 1.1 rounded off to the nearest second. The resulting clearance time is measured in seconds. In another example, the clearance time is calculated as the quantity of the queue length times 2.1 plus 1.1 rounded off to the nearest second plus the clearance time for any progressions for the individual phase. In this embodiment, if there are no queues or progressions for the individual phase, the clearance time is zero.

The light change time is the amount of time it takes to change a signal indicator from one indication to another indication. For example, a light change time may be the time it takes to change a particular signal from a green indicator to a red indicator, including the yellow indicator. Another light change time may be the time it takes to change a signal from a green indicator to a yellow indicator. Similarly, still another light change time may be the time it takes to change a signal from the yellow indicator to a red indicator. In still another example, the light change time is the amount of time it takes to change a signal indicator from a right-of-way to a no right-of-way.

In one embodiment, the cut off time is the beginning of a next plan time, such as the earliest next plan time, minus a light change time for an individual phase. In another embodiment, the cut off time is the beginning of a next schedule minus a light change time for an individual phase.

In one embodiment, the optimizer system 820 queries queue data stored in memory 812 to obtain queue counts for queue lengths of one or more individual phases. In the same or another embodiment, the optimizer system 820 queries progression data stored in memory 812 to obtain progression numbers and/or progression times for one or more progressions. In any one of the above embodiments or another embodiment, the optimizer system 820 queries traffic count data stored in memory 812 to obtain traffic counts for one or more individual phases.

The scheduling system 822 executes the schedule determined by the optimizer system 822. The scheduling system 822 receives the schedule from the optimizer system 822 and generates presence data for one state at a time starting at each state start time and for the associated state duration. When the first state duration ends, the scheduling system 822 generates the presence data for the next state starting at the state start time and for the state duration. The scheduling system 822 sequentially executes each state in the schedule until the schedule is complete. The scheduling system 822 receives the next schedule from the optimizer system 820 and sequentially executes each stat in that schedule. The process continues in a sequential manner. In one embodiment, the scheduling system 822 generates a communication or signal in which the presence data is contained, such as in a format or protocol for transmission from the external adaptive control system 802. The scheduling system 822 operates on the processor 816.

The detector manager 824 receives queue counts and/or queue data for one or more individual phases from the detector processing system, such as the video processing system 818, and stores the queue counts in memory, for example as queue data and/or as one or more objects. The optimizer system 820 may then query the queue data. The detector manager 824 also receives traffic counts and/or traffic count data of vehicles exiting the intersection for one or more individual phases from the detector processing system, such as the video processing system 818, and stores the traffic counts in memory, for example as traffic count data and/or as one or more objects. The optimizer system 820 may then query the traffic count data. Since one or more types of detectors may be present at an intersection, the detector manager 824 may receive queue data identifying queue counts, queue data, traffic counts, and/or traffic count data from a video processing system 818 and/or one or more other detector processing systems operating on the processing system 804.

The detector manager 824 also manages connections to the detectors. The detector manager 824 determines when detector data is not being received from one or more detectors at the intersection. In the example of FIG. 8, the detector manager 824 determines when video data is not being received from one or more cameras 814. The detector manager 824 notifies the optimizer system 820 when detector data is not being received from one or more detectors. In one example, the detector manager 824 transmits a communication to the optimizer system 820 indicating the detector data is not being received from one or more detectors. Alternately, the detector manager 824 notifies the processor 816 when detector data is not being received from one or more detectors. In one example, the detector manager 824 transmits a communication to the processor 816 indicating the detector data is not being received from one or more detectors. Alternately or additionally, the detector manager 824 stores the queue data for the queue lengths and/or traffic count data for the traffic counts in memory and/or transmits a communication or other signal to the optimizer system 820 and/or the processor 816 with the queue data and/or traffic count data.

The camera controller 826 controls one or more of the cameras 814 at the intersection. The camera controller 826 generates signals and/or other communications for the cameras 814, such as to move cameras up, down, left, right, or in another direction. The camera controller 826 also may control focus and camera configurations of one or more of the cameras 814. The camera controller 826 operates on the processor 816.

The controller assembly interface 806 transmits data and other communications to the signal controller assembly 302A and receives data and other communications from the signal controller assembly. For example, the schedule system 822 generates presence data for one or more states of a schedule, and the controller assembly interface 806 transmits the presence data to the signal controller assembly 302A. The controller assembly interface 806 also receives light status data, such as the times when each individual phase receives a right-of-way, from the signal controller assembly 302A. The controller assembly interface 806 also communicates data and other communications to and from the processing system 804.

The controller assembly interface 806 formats the communications it transmits from the external adaptive control system 802 in one embodiment. For example, the controller assembly interface 806 formats presence data into a communication in one embodiment, such as a serial communication. In the same embodiment, the controller assembly interface 806 formats communications received from the signal controller assembly 302A into a form processable by the processing system 804, such as from the serial communication format. In other embodiments, a different type of interface may be used to communicate between the external adaptive control system 802 and the signal controller assembly 302A. In still other embodiments, the controller assembly interface 806 and the communication network interface 808 are integrated.

The communication interface 808 communicates between the external adaptive control system 802 and other devices in the communication network 412A and/or the traffic network (now shown). For example, the communication interface 808 transmits data and other communications from the external adaptive control system 802 to the communication network 412A. The communication interface 808 also receives data and other communications from the communication network 412A.

In one embodiment, video data is transmitted by the cameras 814 through the communication network 412A to the external adaptive control system 802. In this embodiment, the communication interface 808 receives the video data from the communication network 412A. In another embodiment, the camera controller 826 generates control data for the cameras 814, and the processing system 804 transmits the camera control data to the communication interface 808. The communication interface 808 transmits the camera control data through the communication network 412A to the cameras 814.

In one optional embodiment, a user computer 410A communicates with the external adaptive control system 802 through the communication network 412A. The user computer 410A optionally transmits configuration data to the external adaptive control system 802. In addition, the user computer 410A optionally receives the video data generated by the cameras 814. In one example, the video data is transmitted directly from the cameras 814 through the communication network 412A to the user computer 410A. In another example, the video data is transmitted from the cameras 814 through the communication network 412A to the external adaptive control system 802. The external adaptive control system then transmits the video data back through the communication network 412A to the user computer 410A. In still another example, the external adaptive control system 802 enables a router in the communication network 412A to route the video data to both the user computer 410A and the external adaptive control system 802.

In one configuration, one or more progressions are received by the communication interface 808 through the communication network 412A from one or more other external adaptive control systems or other control assemblies. In this embodiment, the communication interface 808 transmits progressions from the external adaptive control system 802 to one or more other external adaptive control systems or other control assemblies at other intersections.

Alternately, the external adaptive control system 802 may transmit only a traffic count and not the time the traffic count has the right-of-way. In this embodiment, the communication interface 808 transmits the traffic count data through the communication network 412A to one or more other external adaptive control systems or control assemblies for other intersections.

The user interface 810 enables a user to configure the external adaptive control system 802, such as setting minimum and the maximum green times, setting plans, setting configurations for clearance times and the cut off times, controlling the cameras 814, and/or other configuration data. In one embodiment, the user interface 810 sets configurations for collecting, storing, and using historical data, such as for determining a schedule. In one embodiment, the user interface 810 is present on the user computer 410A and not the external adaptive control system 802. In this embodiment, the processing system 814 is configured to communicate with user interface 810 through the communication interface 808 and the communication network 412A. In still another embodiment, the external adaptive control system 802 generates data to the user computer 410A through the communication interface 808 and the communication network 412A that enables the user computer to display data for the user interface and/or to display data for one or more screens. In still another embodiment, the user interface 810 operates on the processor 816. The user interface 810 is optional in some of the embodiments.

The memory 812 communicates with the processing system 804 and stores data. For example, the processing system 804 transmits data to the memory 812 for storage or retrieves data from the memory.

The memory 812 stores configuration data, historical data, and/or other data. For example, the configuration data may include maximum and minimum green light times for one or more individual phases or combination phases, clearance time data for calculating clearance times, light change time data for light change times of one or more individual phases or combination phases, and/or other configuration data used to determine a schedule. The memory may also include historical data/light state data identifying one or more numbers of vehicles that received a right-of-way for one or more individual phases for a selected time frame. The historical data may include all traffic moving through all individual phases or combination phases for a selected period of time, such as a day, a week, a month, or another selected time period. Alternately, the historical data may include numbers of vehicles for fewer than all individual phases for the selected period of time, such as only for coordinated individual phases for an arterial. Other examples exist.

The memory also may include other configuration data, such as camera configuration data, data identifying one or more configurations in the signal controller assembly 302A, and/or other configuration data. Other examples exist.

The memory includes volatile and/or nonvolatile memory that can be embodied in one or more distributed or integrated components. The memory 812 may include computer readable media on which one or more algorithms, software, and/or firmware is loaded and/or operates to implement the systems and/or methods identified herein. The computer readable media may include volatile media, nonvolatile media, removable media, non-removable, and/or other media or mediums that can be accessed by a general purpose or special purpose computing device or system. For example, computer readable media may include computer storage media and communication media. Computer storage media further may include volatile, nonvolatile, removable, and/or non-removable media implemented in a method or technology for storage of information, such as computer readable instructions, data structures, program modules, and/or other data. Communication media may, for example, embody computer readable instructions, data structures, program modules, algorithms, and/or other data, including as or in a modulated data signal. The communication media may be embodied in a carrier wave or other transport mechanism and include an information delivery method. The communication media may include wired and/or wireless connections and technologies and be used to transmit and/or receive wired and/or wireless communications, such as through the communication interface 808 and/or the controller assembly interface 806. Combinations and/or sub-combinations of the above and systems and components described herein may be made.

Figure 9:
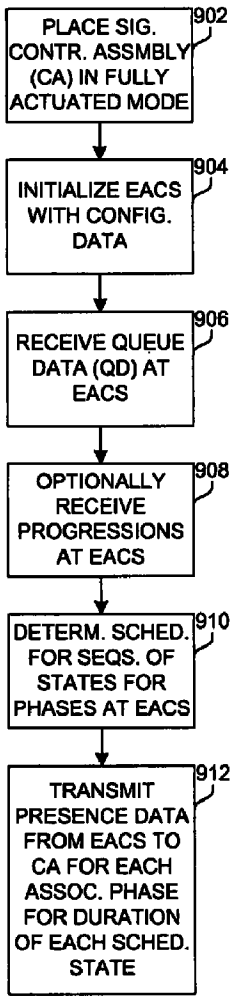
FIG. 9 is a flow diagram of a schedule optimizer in accordance with an embodiment of the present invention.

FIG. 9 depicts an exemplary embodiment of an operation of the external adaptive control system 802. At step 902, the signal controller assembly 302A is placed in the fully actuated mode. The external adaptive control system 802 (EACS) optionally is configured with configuration data, such as one or more plans, at step 904. The external adaptive control system 802 receives queue data (QD) at step 906. In one embodiment, the queue data includes video data received from the cameras 814 through the communication interface 808 and processed by the video processing system 818. In this embodiment, the video processing system 818 processes the video data and determines the queue data, which includes a number of vehicles at one or more individual phases. In other embodiments, other detectors may be used, such as loop detectors, puck (magnetic) detectors, other detectors, or a combination of detectors.

At step 908, the EACS optionally receives progressions for one or more vehicles approaching the intersection from other intersections. The progressions are not received in all embodiments.

The external adaptive control system 802 determines a schedule at step 910 based at least on the queue data. In some instances, the schedule also may be based on one or more plans. In still other instances, progression data may be used to determine the schedule. The schedule includes one or more dynamically selected states with each state having one or more individual phases, and the states may be grouped as one or more sequences. The schedule is a non-linear schedule or a variable schedule. The external adaptive control system 802 optionally determines the period for the schedule.

The external adaptive control system 802 transmits presence data at step 912 to the signal controller assembly 302A for each associated phase of each state in the schedule for the duration of each scheduled state. Step 908 is optional for some embodiments.

Figure 10:
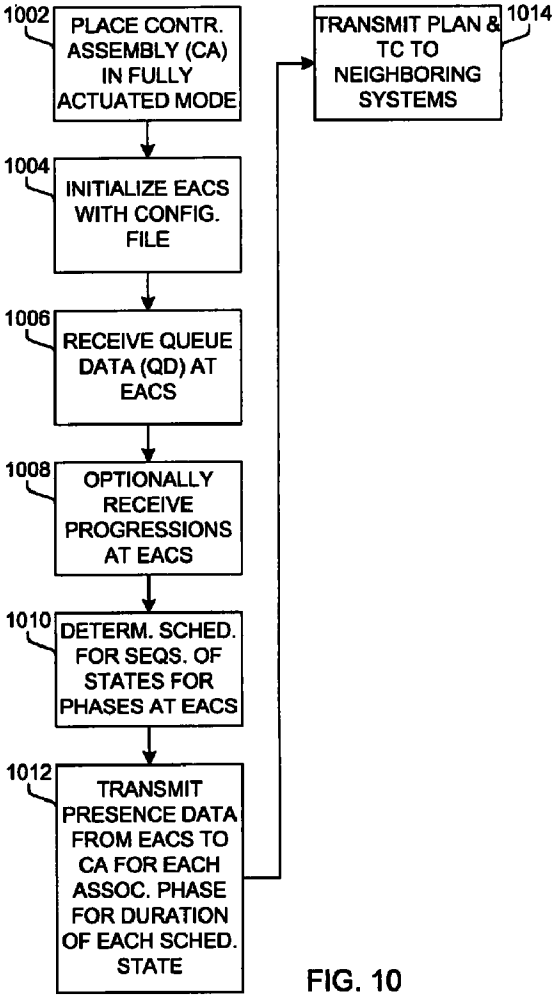
FIG. 10 is a flow diagram of another schedule optimizer in accordance with an embodiment of the present invention.

FIG. 10 depicts another exemplary embodiment of an operation of the external adaptive control system 802. In the embodiment of FIG. 10, the signal controller assembly 302A is placed in the fully actuated mode. The configuration of the external adaptive control system 802 is initialized with configuration data in step 1004. In some embodiments, step 1004 is optional and the configuration data need not be initialized. At step 1006 queue data is received at the external adaptive control system 802. In one embodiment, the queue data includes video data received from the cameras 814 and processed by the video processing system 818. The video processing system 818 determines a queue length for one or more individual phases at the intersection being controlled by the external adaptive control system 802.

At step 1008, the external adaptive control system 802 receives one or more progressions for one or more approaches to one or more individual phases at the intersection. Step 1008 is optional for some embodiments, and the progressions are not received or used to determine a schedule.

At step 1010, the optimizer system 820 determines a schedule. The schedule includes one or more dynamically selected states with each state having one or more individual phases, and the states may be grouped as one or more sequences. The schedule is a non-linear schedule or a variable schedule. In one example, the states include up to two individual phases for each state. In one embodiment, the schedule is determined based on the queue lengths for one or more individual phases and one or more plans for the intersection. In another embodiment, one or more other plans for one or more other intersections also optionally is used to determine the schedule. In still another embodiment, one or more progressions approaching the intersection optionally are used to determine the schedule. The optimizer system 820 optionally determines the period for the schedule.

At step 1012, the external adaptive control system 802 generates the presence data for each associated phase for the duration of each scheduled state. In this embodiment, a schedule system 822 generates the presence data, and the controller assembly interface 806 transmits the presence data to the signal controller assembly 302A. In one example, the presence data includes presence data for up to two individual phases for each state.

At step 1014, the external adaptive control system 802 transmits its plan or plans and the traffic count for one or more individual phases to one or more other external adaptive control systems or controller assemblies in a traffic network. In this embodiment, the video processing system 818 processed the video data from the cameras 814 to identify the traffic count for the one or more individual phases.

FIGS. 11A-11P depict exemplary embodiments of several north-south and east-west state series (also referred to as sequences of states or state sequences). Each state other than skipped states have two individual phases. The sequences of states are examples of particular groupings of states to serve a direction or coordinated directions. Other examples exist.

FIG. 11A depicts a state sequence for a north-south pure lead, which includes a state for protected north-south left turns, followed by a state for northbound and southbound through coordinated directions. The third state is skipped.

FIG. 11B depicts a state sequence for a southbound lead-lag, which includes southbound through with southbound left turn overlap, a northbound-southbound through state, and a northbound through with northbound left turn overlap state.

FIG. 11C depicts an example of a leading left with northbound left turn overlap state sequence, which includes a leading protected left turn state, a northbound through with northbound left turn overlap state, and a northbound-southbound through state.

FIG. 11D depicts an example of lagging left with northbound left turn overlap state sequence, which includes a northbound-southbound through state, a northbound through with northbound left turn overlap state, and a protected north-south left turn state.

FIG. 11E depicts an example of a north-south pure lag state sequence, which includes a north-south through state followed by a protected north-south left turn state. The third state is skipped in this sequence.

FIG. 11F depicts an example of a northbound lead-lag state sequence, which includes a northbound through with northbound left turn overlap state, a north-south through state, and a south through with southbound left turn overlap state.

FIG. 11G depicts an example of a leading left turn with southbound left turn overlap state sequence, which includes a protected north-south left turn state, a southbound through with southbound left turn overlap state, and a north-south through state.

FIG. 11H depicts an example of a lagging left turn with southbound left turn overlap state sequence, which includes a north-south through state, a southbound through with southbound left turn overlap state, and a protected north-south left turn state.

FIGS. 11I-11P depict similar state sequence for the east-west direction. FIG. 11I depicts an example of an east-west pure lead state sequence. FIG. 11J depicts an example of an eastbound lead-lag state sequence. FIG. 11K depicts an example of a leading left turn with an eastbound left turn overlap state sequence. FIG. 11L depicts an example of a lagging left turn with an eastbound left turn overlap state sequence. FIG. 11M depicts an example of an east-west pure lag state sequence. FIG. 11N depicts an example of a westbound lead-lag state sequence. FIG. 11O depicts an example of a leading left turn with a westbound left turn overlap state sequence. FIG. 11P depicts an example of a lagging left turn with a westbound left turn overlap state sequence.

Figure 11Q:
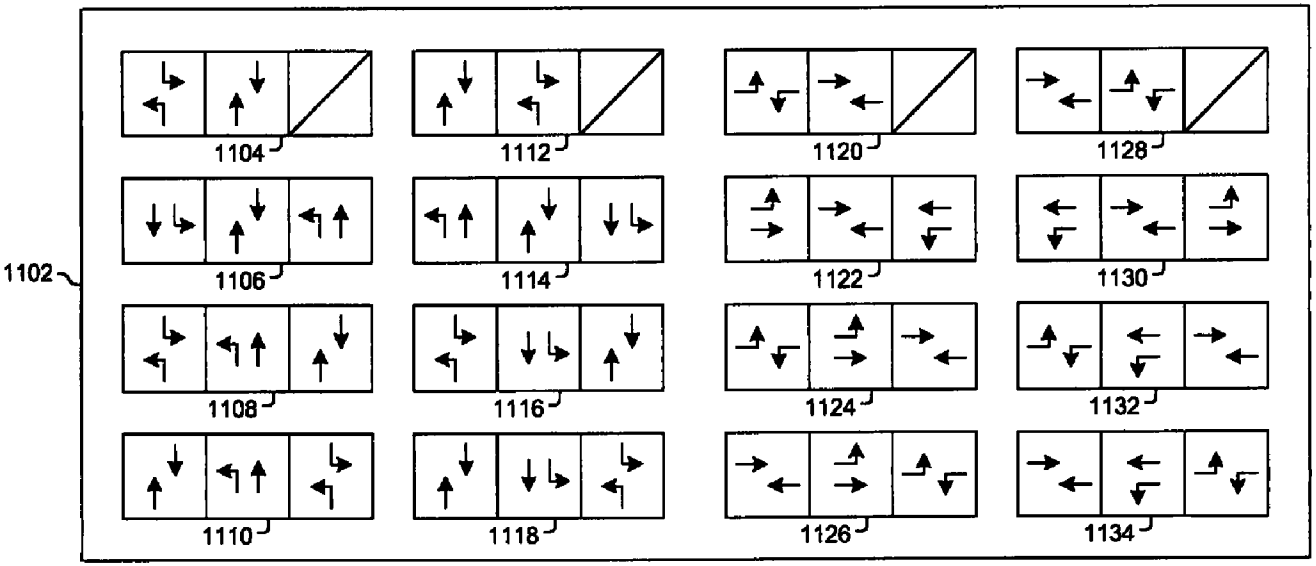
FIG. 11Q is a block diagram of a state machine with state machine state sequences.

FIG. 11Q depicts an exemplary embodiment of a state machine for determining state machine state sequences for a schedule. The state machine 1102 is part of the optimizer system and dynamically determines one or more state machine state sequences 1104-1134 for a schedule. The state machine 1102 determines a schedule starting with one of the state sequences 1104-1134 and including any one or more other state sequences in a variable order. The state machine 1102 therefore determines a schedule having one or more variable state sequences in a variable state sequence order. In one embodiment, the state machine state sequences are one or more of the sequences identified in FIGS. 11A-11P: north-south pure lead, southbound lead-lag, leading left with northbound left turn overlap, lagging left with northbound left turn overlap state, north-south pure lag, northbound lead-lag, leading left turn with southbound left turn overlap, lagging left turn with southbound left turn, east-west pure lead, eastbound lead-lag state sequence, leading left turn with an eastbound left turn overlap, lagging left turn with an eastbound left turn overlap, east-west pure lag, westbound lead-lag, leading left turn with a westbound left turn overlap, and lagging left turn with a westbound left turn overlap. Prior conventional systems emulate an analog mechanical cycle and do not select an order of states for a schedule or an order for signal phases for a timing plan.

Figure 11R:
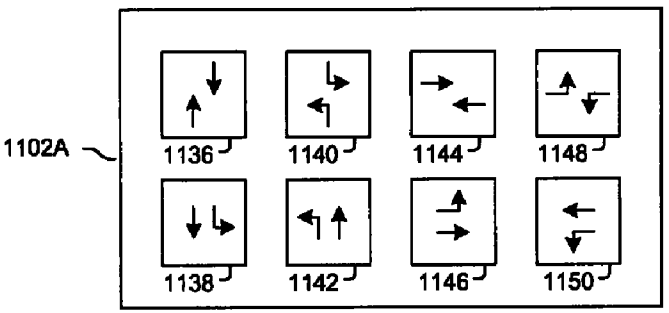
FIG. 11R is a block diagram of a state machine with state machine states.

FIG. 11R depicts an exemplary embodiment of a state machine for determining state machine states for a schedule. The state machine 1102A is part of the optimizer system and dynamically determines one or more state machine states 1136-1150 for a schedule. The state machine 1102 determines a schedule starting with one of the states 1136-1150 and including any one or more other states in a variable order. The state machine 1102A therefore determines a schedule having one or more states in a variable state order. In one embodiment, the state machine states are northbound-southbound through, southbound through with southbound left turn overlap, north-south pure lead, northbound through with northbound left turn overlap, eastbound-westbound through, eastbound through with eastbound left turn overlap, east-west pure lead, and westbound through with westbound left turn overlap. Prior conventional systems emulate an analog mechanical cycle and do not select an order of states for a schedule or an order for signal phases for a timing plan. For example, prior conventional systems have a cycle with predetermined and predefined linear orders.

Figure 12A:
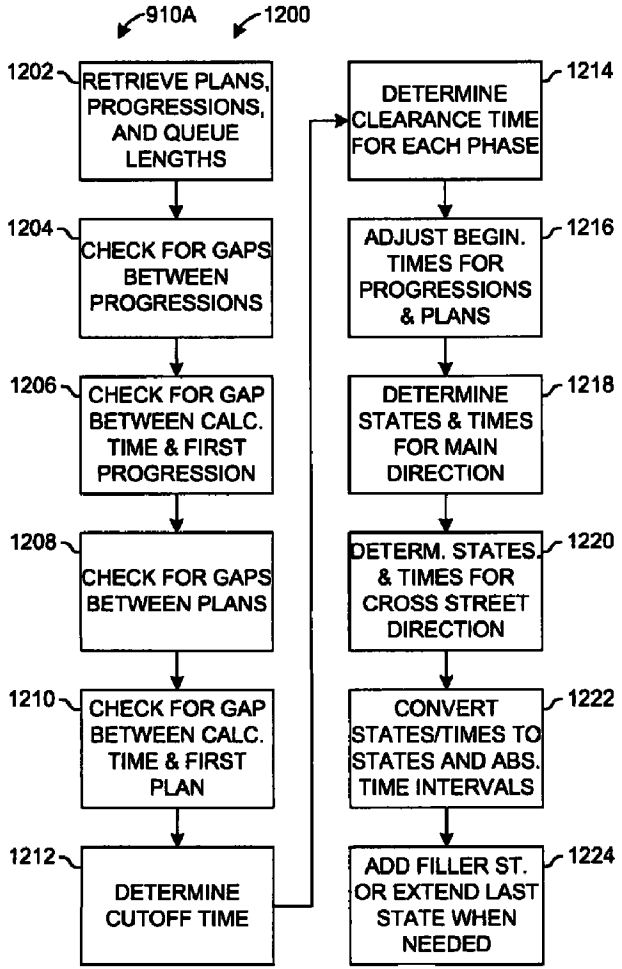
FIG. 12A is a flow diagram of a schedule determination system in accordance with an embodiment of the present invention.

FIG. 12A depicts an exemplary embodiment of a system and method for determining a schedule in an optimizer system, such as determining a non-linear schedule or a variable schedule for one or more sequences of states with each state having up to two individual phases 910A. The schedule process 1200 starts at step 1202 where the optimizer system 820 retrieves the next plans for the corresponding intersection and determines the queue lengths for the individual phases at the intersection. The optimizer system 820 optionally determines the progressions approaching the individual phases at the intersection. The progressions may be identified in one or more messages optionally received at the external adaptive control system 802. In one embodiment of schedule process 1200, progressions are not used, and all steps identifying progressions or progression data are optional.

At step 1204, the optimizer system 820 optionally checks for gaps between progressions. At step 1206 the optimizer system 820 optionally checks for gaps between the current calculation time and the first progression identified in the progressions. In one example, the optimizer system 820 determines if the one or more gaps between progressions or gaps between the calculation time and first progression is greater than 20 seconds. Progressions before the first gap (if a gap exists) are labeled as current progressions. Progressions after the first gap, if existent, are labeled as next progressions.

At step 1208, the optimizer system 820 checks for gaps between one or more plans to be implemented. Gaps between the current calculation time and the first plan are checked at step 1210. In one example, the optimizer system 820 determines if the gap between the plans or the gap between the current calculation time and the first plan is greater than the light change time for the intersection. Plans before the first gap, e.g. either between the current plans and the next plans or between the current calculation time and the first plan, are identified as current plans. Plans after the first gap are identified as next plans. In one example, if the earliest plan is more than 20 seconds after the current calculation time, then all plans are identified as next plans.

A cutoff time is determined at step 1212. The cutoff time is the beginning of the earliest next plan minus the light change time for the main through individual phases. For example, if the northbound and southbound directions are the main through directions for the intersection, the cutoff time is the beginning of the earliest next plan minus the light change time for the northbound through and southbound through individual phases.

At step 1214, the optimizer system 820 determines a clearance time for each individual phase. In one example, the clearance time for each individual phase is calculated as ((the queue length for the individual phase times 2.1) plus 1.1 seconds) rounded off. The clearance time is zero if there are no queues (e.g. no vehicles in the queue or a zero queue length).

In another example, the clearance time for each individual phase is calculated as ((the queue length for the individual phase times 2.1) plus 1.1 seconds) rounded off plus the clearance time for any one or more progressions for that individual phase. The clearance time is zero if there are no queues (e.g. no vehicles in the queue or a zero queue length) and no progressions. If an individual phase has both a queue and a progression, then the clearance time is calculated as (the queue length for the individual phase times 2.1) plus the clearance time for the progression approaching the individual phase.

If the clearance time for an individual phase is greater than zero and less than the minimum green time for that individual phase, then the clearance time is increased to be equal to the minimum green time for the individual phase. Finally, in one embodiment, the clearance times for the individual phases are adjusted by adding the light change time if the clearance time is greater than zero.

At step 1216, the beginning times for plans are adjusted by subtracting the light change time from the plans. If this reduces the beginning time for a plan to be equivalent to a time before the calculation time, the beginning time of the plan is set to the calculation time.

Optionally, the beginning times for progressions (if used for the schedule process 1200) are adjusted by subtracting the light change time from the progressions. If this reduces the beginning time for a progression to be equivalent to a time before the calculation time, the beginning time of the progression is set to the calculation time.

The optimizer system 820 determines one or more states for the main direction with each state having one or more individual phases at step 1218. In one embodiment, the optimizer system 820 calculates one or more sequences of states with each sequence having one or more states and each state having one or more individual phases. In some embodiments, a sequence may have two states. In other embodiments a sequence may have three states. In other embodiments, a sequence may have only one state. Other examples exist. The signal optimizer 820 also determines corresponding start times and durations for the states in the main direction in step 1218.

In step 1220, the optimizer system 820 determines one or more states and corresponding times for the states for the cross direction street. For example, the signal optimizer 820 determines one or more sequences of one or more states with each state having one or more individual phases. The optimizer system 820 also determines corresponding start times and durations for the states for the cross direction street.

At step 1222, the state sequences are converted to states with absolute time intervals (i.e. rather than states determined in reference to a calculation time). For example, for a state sequence having three states, with each state having two phases that start and end at the same time such that a single state has a starting and ending time and a duration, each state in the sequence will have an absolute start time, a duration, and an absolute ending time. The first state has an absolute start time, a duration, and an absolute ending time. The second state has an absolute start time, a duration, and an absolute ending time. The third state has an absolute start time, a duration, and an absolute ending time. The "absolute" time means a particular time of day, such as referenced with a clock such as the time from the time synchronization device, rather than as referenced by a calculation time. Therefore, each state is given an absolute start time, duration, and end time for the time of day. The conversion is made for both the main direction state sequences and the cross direction state sequences. The list of states and absolute time intervals then is compiled into a list.

In one example, the absolute time for the beginning of the first state is the calculation time plus time T0, and the ending time of the first state is the calculation time plus time T1. If T0 is equal to T1, then the first state is skipped. Here, T0, T1, T2, and T3 are calculation transition times in which an internal sequence of states has an internal phase and an internal time interval associated with the internal phase, where the internal phase is intended to be green. An internal phase number is designated with the internal transition times T0-T3. For example, phase01 is green from time T0 to time T1. Phase02 is green from time T0 to time T2. Phase13 is green from time T1 to time T3. Phase23 is green from time T2 to time T3. For example, if a sequence has three states for north through-south through, north through-north left turn overlap, and north left turn-south left turn, then internal phase01 is south through, internal phase02 is north through, internal phase 13 is north left, and internal phase23 is south left. Other assignments may be used. The assignment for two state sequence may be different. For example, for a two state sequence having north through-south through and north left turn-south left turn, internal phase01 is north through, internal phase02 is south through, internal phase13 is north left, and internal phase23 is south left. Other assignments may be used.

The internal phase designations and the internal transition times are internally used as calculations for determining a schedule by the optimizer system 820. They are not the same as the individual phases with the associated start time, duration, and ending time described above for the one or more individual phases in one or more states of one or more sequences of states that are generated to the signal controller assembly as presence data. Further, internal phases, calculation times, symbols, and variables are described below that are used internally by the optimizer system 820 to determine a schedule.

Continuing with step 1222, the second absolute state is determined as starting at the calculation time plus T1 and extending to the calculation time plus T2. If T2 is equal to T1, then the second state is skipped. The third absolute state time is determined as starting at the calculation time plus T2 and extending to the calculation time plus T3. If T3 is equal to T2, then the third state is skipped. For the cross street direction calculation, the ending time of the main street direction solution is added to those times for the cross street calculation.

At step 1224, a filler state is added or the last scheduled state is extended when needed, such as when the currently scheduled states do not last for the entire scheduled period. For example, if the ending time of the last scheduled state is before the cutoff time (or in some instances the cutoff time minus the light change time), then a filler state is added from the end of the last scheduled state to the cutoff time. The filler state is a configured default state in some embodiments and a calculated state in other embodiments. In another example, the last scheduled state is extended to the cutoff time instead of adding a filler state.

The scheduled states are transmitted to the schedule system 822. Each scheduled state then is sequentially transmitted to the signal controller assembly 302A at the associated state start time and for the associated state duration by a timer routine in the schedule system 822. In one example, the timer routine in the schedule system 822 runs once a second.

Figure 12B:
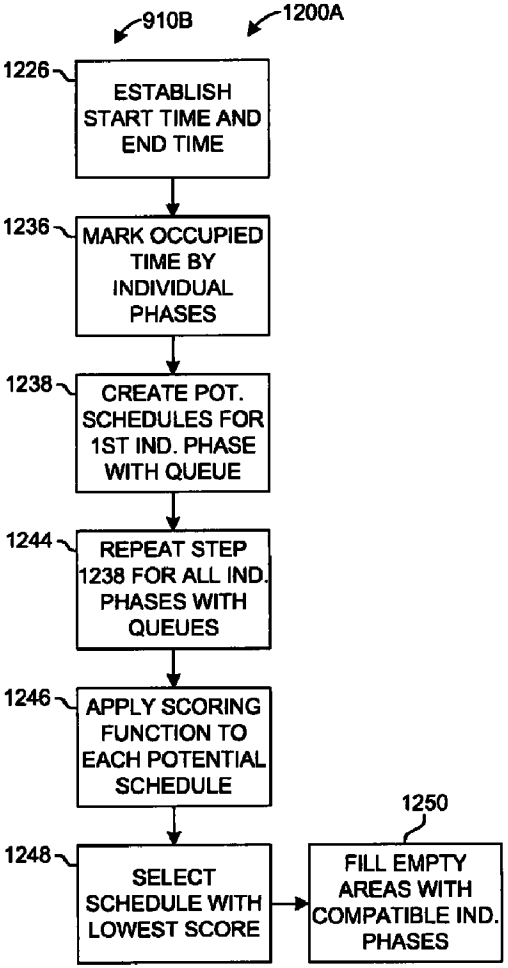
FIGS. 12B-E are diagrams of a method for determining a schedule.
Figure 12C:
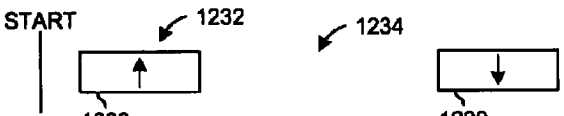

FIGS. 12B-11E depict an exemplary embodiment of a system and method for determining a schedule in an optimizer system, such as determining a non-linear schedule or a variable schedule for one or more sequences of states with each state having up to two individual phases 910B. In this example, the optimizer system determines the schedule to satisfy one or more queues for an individual phases. The schedule process 1200A starts at step 1226 where a start time 1228 and an end time 1230 for the schedule are established. In one example, the start time 1228 and an end time 1230 for the schedule are the start of one period and the start of the next period, respectively. Occupied time 1232 includes time committed to an individual phase, such as for a guaranteed green light time for an individual phase for a main street direction of a plan. Unoccupied time 1234 is empty and not committed. The time occupied by phases in the plan are marked as committed at step 1236. For example, coordinated phases are marked as committed. See FIG. 12C. This is the first partial schedule. Step 1236 is optional for some embodiments.

Figure 12D:
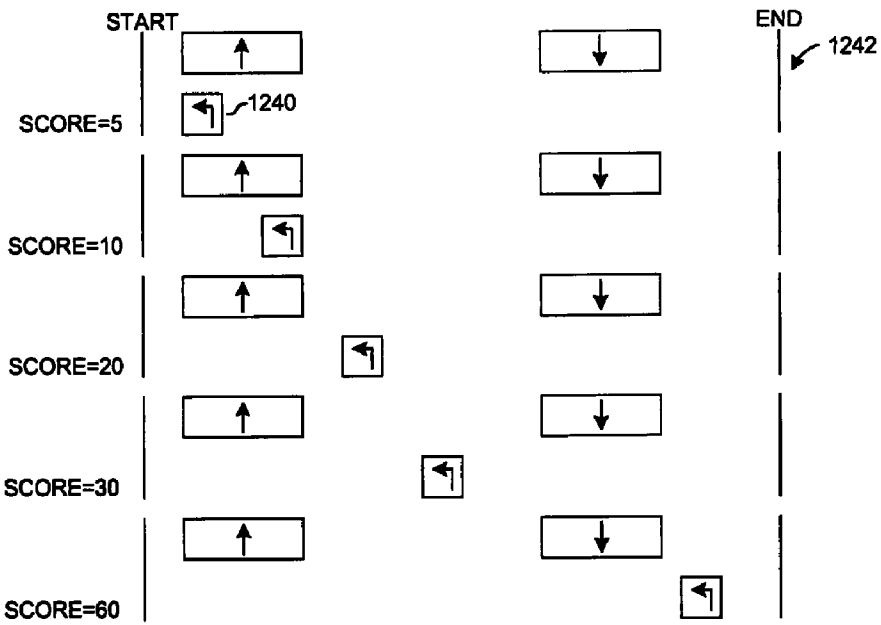
Figure 12E:
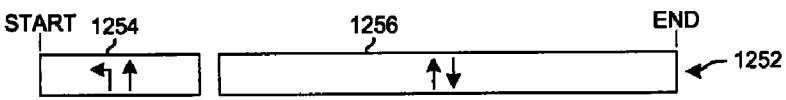

At step 1238, for the first individual phase 1240 with a queue that is still unaccounted, a series of potential schedules 1242 (see FIG. 12D) are created from the first partial schedule by fitting the individual phase into areas where no non-compatible phase already exists. Each of the areas may have a different waiting time. This is the next set of generated schedules. This step of creating potential schedules is repeated at step 1244 until all individual phases with queue have been accounted. A "scoring" function is applied to each potential schedule in the final set of generated potential schedules at step 1246. For example, the queue size for each individual phase is multiplied by its waiting time and each of the multiplied queue size and waiting time values for each individual phase are added to obtain a score for each potential schedule. The schedule with the lowest score is selected at step 1248 as the final schedule. For areas with only one individual phase indicated, the empty area with any compatible phase is filled with one or more individual phases at step 1250. A final state sequence 1252 with the selected states 1254-1256 is produced for the schedule. See FIG. 12E.

In one example, the clearance time per car is 2 seconds, and change times and plans are ignored for simplicity. Phase 6 for Southbound through (ST) has a queue of 10 cars=20 seconds. Phase 2 for northbound through (NT) has 9 cars=18 seconds. Phase 1 for Southbound left turn (SLT) has 8 cars=16 seconds. Phase 5 for northbound left turn (NLT) has 3 cars=6 seconds.

Therefore, a potential schedule is: ST at time +0 (the start of the schedule), NT at time +0, SLT at time +20, and NLT at time +20. That potential schedule has a score of: 10*0+9*0+8*20+3*20=220.

An alternate potential schedule is: ST at +0, SLT at +0, NT at +20 and NLT at +20. That potential schedule has a score of: 10*0+9*20+8*0+3*20=240.

Another alternate potential schedule is: NT at +0, NLT at +0, ST at +6 and SLT at +18. That potential schedule has a score of: 10*6+9*0+8*18+3*0=204.

The last schedule has the lowest score, i.e. the lowest overall waiting time and is selected.

Figure 13:
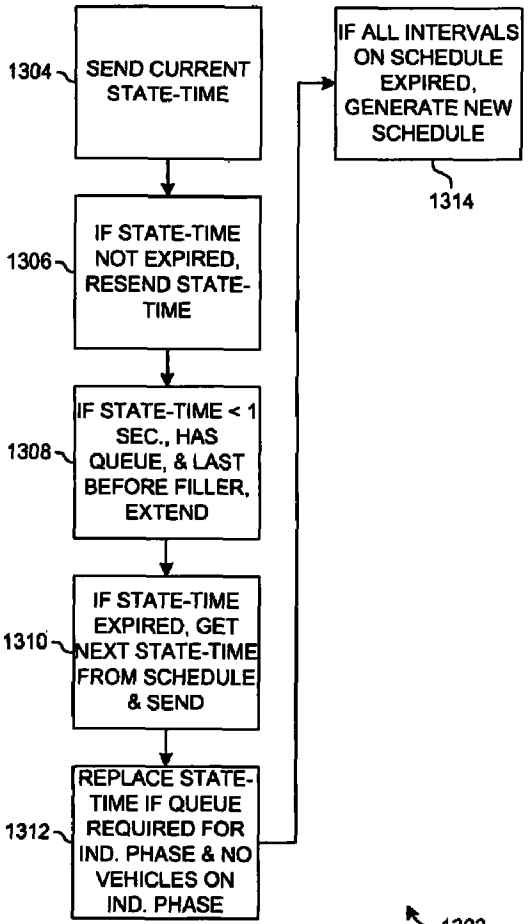
FIG. 13 is a flow diagram of a schedule determination system in accordance with an embodiment of the present invention.

FIG. 13 depicts an exemplary embodiment of the timer routine 1302 in the schedule system 822. In one example, the timer routine 1302 is part of the schedule system 822.

At step 1304, the current state and time are sent for the current state of the schedule. When the schedule begins, the current state and time are the first state and time. The state is transmitted for the duration, beginning at the state start time. This is referred to as the state-time interval.

At step 1306, if the current state-time interval has not expired, the state is resent for the duration. At step 1308, if the current state-time interval has less than one second left, the state is flagged as a last before filler state. If the queue length on any traffic lane for that state is half or more of a selected default length for that lane, then the current state-time interval is extended. In one example, the state-time interval is extended by increasing the ending time of the state by one second, but not later than the cutoff time and not later than a total duration longer than a maximum green time for that state. The detection zone for the individual traffic lane may be divided by detection segments in one embodiment. The queue then may be determined based upon the detection segments for that lane, and the selected default length can be based on one or more detection segments. In this example, if the current state-time interval has less than one second left, the state is flagged as a last before filler state, and if the queue on any lanes for that state is half or more than the number of detection segments for that lane, then the current state-time interval is extended.

At step 1310, if the current state-time interval has expired, the next state-time interval is retrieved from the schedule, and the state is transmitted for the duration. At step 1312, when a new state-time interval is retrieved from the schedule, and the state is configured to require a queue for a certain individual phase in order to be transmitted (e.g. the north through-north left turn overlap may be configured to require cars to be in the north left turn lane) and there are no vehicles in the traffic lane for that individual phase, the state is replaced by another state. The replacement state is selected based upon a configuration for that state. In one example, the state is replaced by the following scheduled state, that is the next state-time interval on the schedule. In another example, the state is replaced by the preceding scheduled state, that is the previously transmitted state on the schedule. In another example, the state is replaced by a modification of the state. For example, if the north through-north left turn state was originally scheduled, and there are no vehicles on the north left turn individual phase, then the north through-north left turn state is replaced by the north through-south through state. At step 1314, if all the state-time intervals on the schedule have expired, then the optimizer system 820 determines a new schedule.

Figure 14:
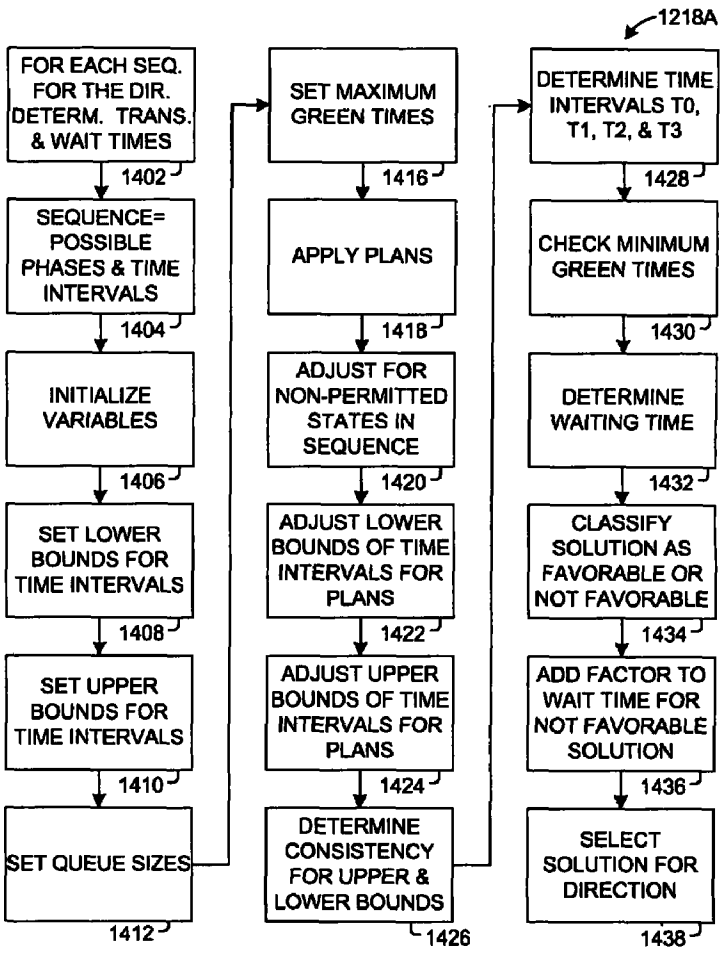
FIG. 14 is a flow diagram of state sequence determination system in accordance with an embodiment of the present invention.

FIG. 14 depicts an exemplary embodiment of a process for determining states and times for a schedule 1218A. The process includes a determination of transition times and waiting times for each individual phase of a state sequence. The transition times are based on internal phase determinations for the schedule calculation, where the first internal phase has a green time from time T0 to time T1 and is designated as phase01, the second internal phase has a green time from T0 to T2 and is designated as phase02, the third internal phase has a green time from T1 to T3 and is designated as internal phase13, and the fourth internal phase has a green time between T2 and T3 and has an internal phase designation as phase23. Thus, the transition times are designated as T0, T1, T2, and T3 for a sequence of states. A waiting time (W) also is determined for a sequence of states.

The state sequence determination includes other variables. Several of the variables include a lower bound and an upper bound. For example, the progressions (optionally, if used), plans, queues, maximum green time limits, minimum time limits, and waiting time factors are all included as variables in one example. In other examples, fewer than all those variables may be used. For example, a queue may be the only variable in one example, whereas queues and plans may be used in another example, and queues, plans, and progressions may be used in still yet another example.

Referring still to FIG. 14, for each permitted state sequence for a selected direction, the transition times and total waiting time for the state sequence are determined at step 1402 as depicted in exemplary steps 1404-1432. In a sequence of three states, the first state begins at time T0 seconds from the current time and lasts until time T1 seconds, the second state starts at time T1 and ends at time T2, and the third state starts at time T2 and ends at time T3. In a sequence with two states, for convenience, a notational non-permitted state is inserted. Therefore, T2 is constrained to equal T1, and no time is allocated to the notational state.

A sequence is identified by possible internal phases and internal time intervals at step 1404. The internal phases are used as variables to designate potential individual phase times. For example, internal phase01 is green from time T0 to time T1. Internal phase02 is green from time T0 to time T2. Internal phase13 is green from time T1 to time T3. Internal phase23 is green from time T2 to time T3. For example, if a sequence of states includes north through-south through, north through-north left turn overlap, and north left turn, internal phase01 is south through, internal phase02 is north through, internal phase13 is north left turn, and internal phase23 is south left turn. The internal assignment may be different for a two-state sequence. For example, for the north through-south through, north left turn-south left turn sequence, internal phase01 is north through, internal phase02 is south through, internal phase13 is north left turn, and internal phase23 is south left turn. However, the internal phase designations may be different for other embodiments.

The variables are initialized at step 1406. The lower bounds for the time intervals are set at step 1408, and the upper bounds for the time intervals are set at step 1410. The queue sizes are identified at step 1412. The maximum green times are set at step 1416, and one or more plans are applied to the calculation at step 1418.

At step 1420, the potential sequences are adjusted for non-permitted states. The lower and upper bounds of the time intervals are adjusted for the plans at steps 1422 and 1424, and the consistency for the upper and lower bounds of the time intervals are determined at step 1426. For example, if the upper bound of transition time T0 is less than the lower bound of the transition time T0 as derived from the plans, or if any of the other upper bounds for the transition times are lower than the lower bounds of the transition times as derived from the plans, then the sequence of states is skipped because the plan constraints are not consistent with the sequence.

The time intervals for the transition times for the internal phases (T0, T1, T2, and T3) are then calculated at step 1428. The minimum green times are checked at step 1430. If transition time T1 minus transition time T0 is greater than zero and less than the minimum green time for internal phase01 plus the light change time for internal phase01, the sequence is skipped. If the transition time T2 minus the transition time T0 is greater than zero and less than the minimum green time for internal phase02 plus the light change time for internal phase02, the sequence is skipped.

The total waiting time for the state sequence is determined at step 1432. In one example, the total wait time (W) is equal to the queue size for internal phase13 times the quantity of internal transition time T1 plus 1.1 added to the queue size for internal phase23 times the quantity of transition time T2 plus 1.1, where W=Q1*(T1+1.1) plus Q2*(T2+1.1).

The solution is classified as favorable or not favorable at step 1434. In one example, a solution is not favorable if the transition time for an internal phase in the state sequence is greater than an upper bound for a transition time required for progression for the internal phase. In another example, a solution is not feasible if a proposed interval for an internal phase is less than a lower bound derived from a clearance time required by the internal phase.

If the solution is classified as not favorable at step 1434, a penalty factor is added to the wait time for the solution at step 1436. At step 1438 the most favorable solution for the sequence of states for the main direction is selected. Similarly, the most favorable solution with the sequences of states is selected for the cross street direction.

In one example, a plurality of variables are assigned to progressions, plans, queues, waiting time factors, and maximum green time limits. These variables then are used in the calculations. Any step with a progression or progression data is optional for some embodiments, and progression variables would not be used.

In this example, the lower bounds for the transition times T0-T3 derived from the progressions are assigned the variables L0, L1, L2, and L3, respectively. L0 is the lower bound for transition time T0. In this example, L0 normally is zero. L1 is the progression-end for internal phase01. L2 is the progression-end for the internal phase02. L3 is the larger of the progression-ends for internal phase13 and internal phase 23.

The lower bounds for the differences between the transition times derived from the clearance times are assigned the variables L01, L02, L03, L12, L13, and L23. L01 is the clearance time for internal phase01. L02 is the clearance time for internal phase02. L12 is the minimum time for transition time T2 minus transition time T1. L03 is the minimum time for transition time T3 minus transition time T0. In this example, L12 and L03 initially are set at zero, but may be set to non-zero values when individual states in a state sequence or individual phases for a state are not permitted.

Upper bounds for the transition times T0-T3 are derived from the progressions and assigned the variables U0, U1, U2, and U3. The upper bounds derived from the progressions are determined by individual components assigned to the upper bounds of the progressions as follows: U0*a*, U0*b*, U1*a*, and U2*a*. Here, U0*a* is the progression-beginning for internal phase01. U0*b* is the progression-beginning for internal phase02. U1*a* is the progression-beginning for internal phase13. U2*a* is the progression-beginning for internal phase23. In one example, U0 is the lesser of U0*a* and U0*b*, U01 equals U1*a*, U2 is equal to U2*a*, and U3 is the cutoff time minus the calculation time (in seconds).

The queue sizes are assigned variables for the internal phases Q0, Q1, and Q2. Q0 is the queue size for internal phase01 plus the queue size for internal phase02. Q1 is the queue size for internal phase13. Q2 is the queue size for internal phase 23. In one example, the queue sizes for the through phases for the main directions are doubled. However, other examples exist.

The lower bounds for the transition time T0-T3 are assigned the variables PL0, PL1, PL2, and PL3. Upper bounds for the transition times T0-T3 are assigned the variables PU0, PU1, PU2, and PU3. Components for the plan upper bounds are assigned the variables PU0*a*, PU0*b*, PU1*a*, and PU2*a*. Components for the plan lower bounds are assigned the variable PL1*a*, PL2*a*, PL3*a*, and PL3*b*. Initially, the lower bounds are set to zero, and the upper bounds and their components are set to 9999.

Waiting time factors are assigned to each of the queues. Rh is the waiting time factor for the queue size of internal phase01. F0*b* is the waiting time factor for the queue size for internal phase02. F1*a* is the waiting time factor for the queue size for internal phase13. F2*a* is the waiting factor for the queue size for internal phase23.

The maximum green time limits are assigned the variables X01, X02, X13, and X23. In one example, X01 is the maximum green time for internal phase01 plus the light change time for internal phase01. X02 is the maximum green time for internal phase02 plus the light change time for internal phase02. X13 is the maximum green light time for internal phase13 plus the light change time for internal phase13. X23 is the maximum green time for internal phase23 plus the light change time for internal phase23. If L01 is larger than either X01 or X02, then L01 is equal to the smaller of X01 and X02. If L02 is larger than X02, then L02 is equal to X02. If L12 is smaller than X02 or X01, then L12 is equal to the larger of X02 and X13. If L13 is smaller than X13, then L13 is equal to X13. If L23 is smaller than either of X13 or X23, then L23 is equal to the larger of X13 and X23.

Next, the plans are applied to the transition times. If there is a plan for internal phase01, then PU0*a* is equal to the plan-beginning for internal phase01, and PL1*a* is equal to the plan-ending for internal phase01. If there is a plan for internal phase02, then PU0*b* is equal to the plan-beginning for internal phase02, and PL2*a* is equal to the plan-ending for internal phase02. If there is a plan for internal phase13, then PU1*a* is equal to the plan-beginning for internal phase13, and PL3*a* is equal to the plan-ending for internal phase13. If there is a plan for internal phase23, then PU2*a* is equal to the plan-beginning for internal phase23, and PL3*b* is equal to the plan-ending for internal phase23. PU0 is set to the smaller of PU0*a* and PU0*b*. PU1 equals PU1*a*, PU2 equals PU2*a*, and PU3 is equal to the cutoff time minus the calculation time (in seconds). PU0 equals zero, PU1 equals PU1*a*, PU2 equals PL2*a*, and PL3 equals the larger of PL3*a* and PL3*b*.

The sequence is adjusted for non-permitted states in the sequence. If a state in the sequence is not permitted, then the time variables indicating its beginning and end must be equal. Therefore, any lower bound for one non-permitted state must be equal to the lower bound of a permitted state. Similarly, the upper bound for a non-permitted state must be equal to an upper bound of a permitted state. Any of the lower bounds that would require that they be different would cause the sequence to be skipped. For example, if the first state is not permitted, then L0 and L1 are set to the greater of L0 and L1, U0 and U1 are set to the lesser of U0 and U1, L01 and L02 are set to be the greater of L01 and L02, L03 and L13 are set to be the greater of L03 and L13, PL0 and PL1 are set to be the greater of PL0 and PL1, PU0 and PU1 are set to be the lesser of PU0 and PU1, and if L01 is greater than zero, the sequence is skipped.

The lower bounds for the plans are adjusted to be consistent. Therefore, if PL1 is less than PL0, then PL1 equals PL0. If PL2 is less than PL1, PL2 is set to equal PL1. If PL3 is less than PL2, then PL3 is set to equal PL2.

The upper bounds for the plans are adjusted to be consistent. Therefore, if PU2 is greater than PU3, then PU2 is set to equal PU3. If PU1 is greater than PU2, then PU1 is set to equal PU2. If PU0 is greater than PU1, then PU0 is set to equal PU1.

The consistency between the upper and lower bounds for the plans is checked. If PU0 is less than PL0 or if PU1 is less than PL1 or if PU2 is less than PL2 or if PU3 is less than PL3, the sequence is skipped because the plan constraints are not consistent with the sequence.

The final time intervals then are calculated. Initially, time interval T0 is set to zero. If T0 is less than PL0, then T0 is set to PL0. T1 is set to the larger of L1 and T0 plus L01. If T1 is less than PL1, then T1 is equal to PL1. Otherwise, if T1 is greater than P1, then T1 is set to equal P1. T2 is the largest of L2, T0 plus L02, and T1 plus L12. If T2 is less than PL2, then T2 equals PL2. Otherwise, if T2 is greater than PU2, then T2 equals PU2. T3 is equal to the largest of L3, T0 plus L03, T1 plus L13, and T2 plus L23.

The transition times are then adjusted for the minimum green time periods. In one example the minimum green times are adjusted for the main phases, such as internal phase13 and internal phase23. If T3 minus T1 is greater than zero and less than the minimum green time for internal phase13 plus the change time for internal phase13, and if T3 is less than or equal to PU1 and PU2, then set T1 and T2 equal to T3. Otherwise skip the sequence. If T3 minus T2 is greater than zero and less than the minimum green time for internal phase23 plus the light change time for internal phase23, and if T3 is less than or equal to PU2, then set T2 equal to T3. Otherwise skip the sequence. If T3 is less than PL3, then T3 is equal to PL3. Otherwise, if T3 is greater than PU3, then T3 is equal to PU3.

Next, the minimum green times are checked, such as for internal phase01 and internal phase02. If T1 minus T0 is greater than zero and less than the minimum green time for internal phase01 plus the light change time for internal phase01, then skip the sequence. If T2 minus T0 is greater than zero and less than the minimum green time for internal phase02 plus the light change time for internal phase02, then skip the sequence.

Next, the waiting time is calculated. In one example, the waiting time is calculated according to the following: W=Q1*(T1+1.1)+Q2*(T2+1.1).

Next, the solution is classified for feasibility. In one example, a solution is feasible if it meets the following constraint: T1 is less than or equal to U1, T2 is less than or equal to U2, T1 minus T0 is greater than or equal to L01, T2 minus T0 is greater than or equal to L02, T3 minus T0 is greater than or equal to L03, T2 minus T1 is greater than or equal to L12, T3 minus T1 is greater than or equal to L13, and T3 minus T2 is greater than or equal to T3.

If a solution is not feasible, a penalty factor is added to the waiting time. In one example, if T1 is greater than U1*a*, then W=W+F1*a**(T1−U1*a*+1.1). If T1 is greater than U1*b*, then W=W+F1*b**(T1−U1*b*+1.1).

The non-favorable and favorable solutions are classified by the lowest waiting time factor and their transition times. The most favorable solution is selected as the more favorable solution with the lowest waiting time and the shortest transition times. In case of a tie, the solution calculated first is selected. Solutions are calculated in one example based upon a configuration. For example, a configuration indicates the order in which states and sequences of states are calculated for main directions and cross street directions.

In another example, the schedule is determined for an intersection that has individual phases for northbound through (NT), northbound left turn (NL), southbound through (ST), eastbound through (ET), and westbound through (WT). The main direction is selected as northbound through and southbound through. Permitted states in this example are NT-ST, NT-NL, and ET-WT. One permitted state sequence is northbound leading left with northbound left turn overlap, where NL-southbound left turn (SL) is not permitted. This effectively limits the possible sequence to NT-NL then NT-southbound through (ST). A second permitted state sequence is northbound lagging left with northbound left turn overlap. In this sequence, NL-SL is not permitted. This effectively limits the sequence to NT-ST then NT-NL. A third permitted state sequence is east-west pure lag. In this sequence, eastbound left turn (EL)-westbound left turn (WL) is not permitted. This effectively limits the sequence to ET-WT.

Minimum green times for internal phases are configured as NT (5 seconds), ST (5 seconds), NL (3 seconds), ET (2 seconds), and WT (2 seconds). Maximum green times for internal phases are NT (20 seconds), ST (20 seconds), NL (40 seconds), ET (80 seconds), and WT (80 seconds). The change light time for all internal phases is 5 seconds.

In this example, the calculation time is 08:21:15. For NT, the earliest plan is 8:21:20 to 8:21:35. The next earliest plan is 8:22:50 to 8:23:05. For ST, the earliest plan is 8:22:18 to 8:22:33. The next earliest plan is 8:23:48 to 8:24:03.

There are no progressions. Therefore, there are no gaps between progressions.

WT has a queue length of 1 vehicle. There are no other queues.

Next, the routine checks for gaps between plans. The earliest plan is NT 8:21:20 to 8:21:35. The next earliest plan is ST 8:22:18 to 8:22:33, which starts 43 seconds after the earliest plan. Therefore, the earliest NT plan is the current plan, and the next plan is ST starting at 8:22:18.

Next the cutoff time is determined. The earliest next plan is ST starting at 8:22:18. Subtracting the change time (5 seconds) gives 8:22:13 as the cutoff time.

Next, the clearance time is determined. WT has 1 car. So, its clearance time is 1×2.1+1.1=3.2 seconds, rounded to 3. The minimum green time for WT is 2. So, the clearance time is not increased. Adding the change time of 8 results in a clearance time of 11.

The beginning times for progressions and plans are adjusted. Here, the NT plan becomes 8:21:13 to 8:21:35. Since 8:21:13 is before the calculation time, it becomes 8:21:15 to 8:21:35.

Next, the sequences and times are determined for the main direction. The permitted northbound-southbound sequences are NL-SL (not permitted), NT-NL, NT-ST (northbound lead northbound with left turn overlap) and NT-ST, NT-NL, NL-SL (not permitted) (northbound lag northbound with left turn overlap).

For the northbound lead with northbound left turn overlap sequence, the internal phases are set: internal phase01=SL, internal phase02=NL, internal phase13=NT, internal phase23=ST. For the lower bounds, there are no queues or progressions for any of these internal phases, so all Ls are 0. For the upper bounds, there are no progressions for any of these internal phases, so all U's=9999, except U3=cutoff time minus calculation time, which is equal to 57. In this example, the cutoff time is 57 rather than 58 because a plan time or calculation time was slightly larger than the hours, minutes, and seconds. That is, it included fractions of seconds and was rounded down. There are no queues for these internal phases, so all of the F's are 0.

For the queue sizes, there are no queues for these internal phases. So, all Q's are 0.

The maximum green times are set as follows: X01=40+3=43; X02=40+5=48; X13=20+5=25; and X23=20+5=25. All of the L's are smaller than the X's, so no adjustment is needed.

Next, the plans are applied. There is a plan for NT (internal phase13), so PU1*a*=8:21:15−8:21:15=0, and PL3*a*=8:21:35−8:21:15=20. This makes PU1=0, and PL3=20. There are no other plans. So, the other PL's are initially 0, and the other PU's are 9999, except for PU3=cutoff time minus calculation time, which is 57.

Next, the variables are adjusted for non-permitted states in the sequence. The first state is not permitted, but the adjustments don't change anything.

The lower bounds are adjusted to be consistent: PL0=0, PL1=0, PL2=0, PL3=20. The upper bounds also are adjusted to be consistent: PU0=0, PU1=0, PU2=57, PU3=57.

The consistency is checked between upper and lower bounds for plans. The PL's are each less than or equal to their respective PU's. So, they are consistent.

The transition times are calculated next. T0=0. T1=larger of 0 and 0, which=0. T2=largest of 0, 0+0, and 20+0, which=20. T3=largest of 0, 0+0, 20+0, so=20.

Then, the waiting time is calculated. W=0 since all the Q's are 0.

The solution is classified for feasibility. Here, all the inequalities are satisfied. So, the solution is classified as feasible.

The state sequences result as follows. For the northbound lag northbound left turn overlap, internal phase01=ST, internal phase02=NT, internal phase13=NL, and internal phase23=SL. There are no queues or progressions for any of these internal phases, so all L's are 0. There are no progressions for any of these internal phases, so all U's=9999, except U3=cutoff time minus calculation time, which=57. There are no queues for these internal phases, so all of the F's are 0.

There are no queues for these internal phases, so all Q's are 0. The maximum green times are X01=20+5=25; X02=20+5=25; X13=40+5=48; and X23=40+3=43. All the L's are smaller than the X's, so no adjustment is needed.

The plans are applied. There is a plan for NT (internal phase02), so PU0*b*=0, and PL2*a*=20. So PU0=0, PU3=57, the other PU's are 9999, PL2=20, and the other PL's are 0. The states are adjusted for non-permitted states in the sequence. The third state is not permitted, so adjustments are: X23=0; PL3=20; and PU2=57.

The lower bounds do not need to be adjusted to be consistent. The upper bounds are adjusted to be consistent: PU1 is set to 57.

Next, the consistency is checked between upper and lower bounds for plans. All of the PL's are less than or equal to the corresponding PU's, so they are consistent.

Next, the transition times are calculated. T0=0; T1=larger of 0 and 0+0, so=0; T2=largest of 0, 0+0, and 0+0, so=0; T2<PL2, so T2 is set to 20; and T3=largest of 0, 0+0, 0+0, and 20+0, so=20.

Next, the waiting time is calculated. W=0 since all Q's are 0.

Next, the solution is classified for feasibility. All the inequalities are satisfied, so the solution is feasible.

Both feasible solutions have a waiting time of 0. So, the first one is used (northbound lead with northbound left turn overlap).

Next, the states and state times are determined for the cross direction. The only permitted sequence for the eastbound-westbound direction is east-west pure lag: ET-WT, EL-WL. The internal phases are set as internal phase01=ET, internal phase02=WT, internal phase13=EL, internal phase23=WL.

The lower bounds are determined. L0, L2, and L3=0 because there are no progressions. L01=0; L02=3 (for the queue of 1 car)+5 (for changing time)=8; L12=0; L03=0; L13=0; and L23=0.

The upper bounds are determined. There are no progressions for these internal phases, so all the U's=9999, except for U3=cutoff time−end of scheduling for main=57−20=37.

The F's=0, except for F0*b*=1. The queue sizes are Q0=0+1=1, Q1=0, and Q2=0.

The maximum green times are set and applied. X01=80+5=85; X02=80+5=85; X13=80+5=85; and X23=80+5=85. None of the L's are greater than the X's, so no adjustment is needed.

The plans are applied next. There are no plans for this direction, so all the PL's=0, and all the PU's=9999, except for PU3=37 (=cutoff time−calculation time).

The sequence is adjusted for non-permitted states in the sequence. This is a two-state sequence, so the notional second state is non-permitted, and the notionally third/real second state is not permitted. Adjustments are X13=0; X23=0; PU1 and PU2=37.

The lower bounds are adjusted for plans to be consistent. The lower bounds are all 0, so there is no change. The upper bounds for the plans are adjusted to be consistent, so PU0=37.

Next, the consistency is checked between the upper and lower bounds for the plans. All plan lower bounds are less than their corresponding plan upper bounds, so they are consistent.

Next, the transition times are determined. T0=0; T1=larger of 0 and 0+0, so=0; T2=largest of 0, 0+8, and 0+0, so=8; and T3=largest of 0, 0+0, 0+0, and 8+0=8.

Next, the waiting time is determined. W=0×(0+1.1)+0×(8+1.1)=0.

The solution is classified for feasibility. All the inequalities are satisfied, so the solution is feasible.

Since this is the only solution for the cross direction, it is the solution chosen. Therefore, the scheduled states are: NT-ST 8:21:15 to 8:21:35 and ET-WT 8:21:35 to 8:21:43. The last scheduled state ends before the cutoff time minus light change time (8:22:13*l*-5 seconds=8:22:08), so a filler state is added for NT-ST 8:21:43 to 8:22:13. Thus, the final scheduled state list is: NT-ST 8:21:15 to 8:21:35; ET-WT 8:21:35 to 8:21:43 (flagged as "last"); and NT-ST 8:21:43 to 8:22:13 (flagged as "filler").

In another example, a schedule is determined for an intersection that has all eight possible internal phases: NT, NL, ST, SL, ET, EL, WT, WL. All the states are allowed: NT-ST, NT-NL, ST-SL, NL-SL, ET-WT, ET-EL, WT-WL, and EL-WL. The main direction is northbound-southbound. Sequences allowed are: northbound lead with northbound left turn overlap (NL-SL, NT-NL, NT-ST), northbound lag with northbound left turn overlap (NT-ST, NT-NL, NL-SL), west lead lag east (WT-WL, ET-WT, ET-EL), and east lead lag west (ET-EL, ET-WT, WT-WL). Minimum green times (in seconds) are: NT 8, ST 5, NL 3, SL 3, ET 3, WT 3, WL 2, EL 2. Maximum green times (in seconds) are: NT 40, ST 40, NL 20, SL 20, ET 20, WT 25, WL 15, EL 15. Change times (in seconds) are: NT 5, ST 5, NL 5, SL 5, ET 8, WT 8, WL 8, EL 8.

The calculation time is 15:01:25. Plans include the following: NT 15:01:30 to 15:01:40: becomes begin 5, end 15; NT 15:03:00 to 15:03:10: becomes begin 95, end 105; ST 15:01:30 to 15:01:40: becomes begin 5, end 15; and ST 15:03:00 to 15:03:10: becomes begin 95, end 105. Progressions include: NT 15:01:26 to 15:01:37 (becomes begin 1, end 12), 5 cars, clear 11; and ET 15:01:39 to 15:01:44 (becomes begin 14, end 19), 2 cars, clear 5. Queues include: NT 6, NL 3, ST 1, SL 2, ET 2, EL 1, WT 4, and WL 1. There are no gaps between progressions, so all progressions are current.

Next, gaps between plans are checked. Te NT 15:01:30 and ST 15:01:30 are the earliest plans. The NT 15:03:00 and ST 15:03:00 plans are more than 20 seconds away from those. So, they are the next plans.

The cutoff time is 15:03:00 minus 5 seconds, or 15:02:55. The clearance times are: NT=(6×2.1) rounded off+11=13+11=24+5=29; NL=(3×2.1+1.1) rounded off=7+5=12; ST=3, increased to minimum green time of 5+5=10; SL=5+5=10; ET=5+8=13; EL=3+8=11; WT=9+8=17; and WL=3+8=11.

The beginning times are adjusted for progressions and plans. Progressions become: NT 0 to 12; and ET 6 to 19. Plans become NT 0 to 15; and ST 0 to 15.

The desired sequences and times are calculated as follows. For the main direction northbound lead with northbound left turn overlap, internal phase01=SL, internal phase02=NL, internal phase13=NT, and internal phase23=ST.

The lower bounds are: L0=0; L1=0 (no progression for SL); L2=0; L3=larger of 12 and 0=12; L01=10; L02=12; L12=0; L03=0; and L13=29; and L23=10.

The upper bounds are adjusted: U0*a*=9999; U0*b*=9999; U1*a*=0; U2*a*=9999; F0*a*=2; F0*b*=3; F1*a*=12; F2*a*=2; U0=9999; U1=0; U2=9999; and U3=90.

The queue sizes are adjusted: Q0=3+2=5; Q1=6×2=12; and Q2=1×2=2.

Maximum green times are adjusted: ; X01=20+5=25; X02=20+5=25; X13=40+5=45; X23=40+5=45; No adjustments to the L's are needed The plans are applied. There is a plan for internal phase13, so PU1*a*=0 and PL3*a*=15. There is a plan for internal phase23, so PU2*a*=0 and PL3*b*=15. PU0=9999; PU1=0; PU2=0; PU3=90; PL0=0; PL1=0; PL2=0; and PL3=15.

The plans are not adjusted for non-permitted states since all states are permitted. No adjustment for the lower bounds is needed for plans to be consistent. The upper bounds for the plans are adjusted to be consistent: PU0=0.

The consistency is checked between upper and lower bounds for plans. Each of the PL's is less than or equal to the corresponding PU, so they are consistent.

The transition times are determined. T0=0; T1=larger of 0, and 0+10, so=10; T1>PU1, so T1 is set to PU1=0; T2=largest of 0, 0+12, 10+0, so=12; T2>PU2, so T2 is set to PU2=0; and T3=largest of 12, 0+0, 0+29, and 0+10, so=29.

The waiting time is determined. W=12×(0+1.1)+2×(0+1.1)=15.4.

The solution is classified for feasibility. T1−T0<L01, so the solution is not feasible.

If the solution is not feasible, add a penalty to W. T1<=U1*a*, so a penalty is not added. T1<=U1*b*, so a penalty is not added.

Next, the sequence are determined for the northbound lag northbound left turn overlap. Internal phase01=ST, internal phase02=NT, internal phase13=NL, and internal phase23=SL.

The lower bounds are set. L0=0; L1=0; L2=12; L3=larger of 0 and 0, so=0; L01=0; L02=11; L12=0; L03=0; L13=0; and L23=0.

The upper bounds are set. U0*a*=9999; U0*b*=0; U1*a*=9999; U2*a*=9999; F0*a*=1×2=2; F0*b*=6×2=12; F1*a*=3; F2*a*=2; U0=0; U1=9999; U2=9999; and U3=90.

The queue sizes are set. Q0=6×2+1×2=14; Q1=3; and Q2=2.

The maximum green times are set. X01=45; X02=45; X13=25; and X23=25. All the L's are less than or equal to their corresponding X's, so no adjustments are needed.

The plans are applied. There is a plan for internal phase01 (NT), so PU0*a*=0, and PL1*a*=15. There is a plan for internal phase02 (ST), so PU0*b*=0, and PL2*a*=15. PU0=0; PU1=9999; PU2=9999; PU3=90; PL0=0; PL1=15; PL2=15; and PL3=0.

The plans are adjusted for non-permitted states in sequence. All of the states are permitted, so no adjustment is needed.

The lower bounds for plans are adjusted to be consistent. Here, PL3=15.

The upper bounds for plans are adjusted to be consistent: PU2=90; and PU1=90.

The consistency is checked between upper and lower bounds for plans. Each PL is less than or equal to its corresponding PU, so they are consistent.

The transition times are determined. T0=0; T1=larger of 0 and 0+0, so=0; T1 <PL1, so T1 is set to 15; T2=largest of 0, 0+11, 15+0, so=15; T3=largest of 0, 0+0, 15+0, so=15.

The waiting time is determined. W=3×(15+1.1)+2×(15+1.1)=80.5.

The solution is classified for feasibility. All the inequalities are satisfied, so the solution is feasible.

Next, the variables are determined for the northbound lag with northbound left turn overlap sequence. Internal phase01=ST, internal phase02=NT, internal phase13=NL, and internal phase23=SL.

The lower bounds are set. L0=0; L1=0; L2=12; L3=0; L01=10; L02=29; L12=0; L03=0; L13=3; and L23=0.

The upper bounds are set. U0*a*=9999; U0*b*=0; U1*a*=9999; U2*a*=9999; F0*a*=1×2=2; F0*b*=6×2=12; F1*a*=3; F2*a*=2; U0=0; 1U1=9999; 1U2=9999; and 1U3=60.

The queue sizes are set. Q0=1×2+6×2=14; Q1=3; and Q2=2.

The maximum green times are set. X01=45; X02=45; X13=25; and X23=25. Each L is less than or equal to its corresponding X's, so no adjustment is needed.

The plans are applied. There is a plan for internal phase01 (ST), so PU0*a*=0, and PL1*a*=15. There is a plan for internal phase02 (NT), so PU0*b*=0, and PL2*a*=15. PU0=0; PU1=9999; PU2=9999; PU3=90; PL0=0; PL1=15; PL2=15; and PL3=larger of 0 and 0, so=0.

The plans are adjusted for non-permitted states in the sequence. All of the states are permitted, so no adjustment is needed.

The lower bounds for plans are adjusted to be consistent. PL3<PL2, so PL3 is set to 15.

The upper bounds for plans are adjusted to be consistent. PU2>PU3, so PU2 is set to 90; PU1>PU2, so PU1 is set to 90.

The consistency is checked between upper and lower bounds for plans. Each PL is less than or equal to its corresponding PU, so they are consistent.

The transition times are determined. T0=0; T1=larger of 0, and 0+10, so=10; T1<PL1, so T1 is set to 15; T2=largest of 12, 0+29, 15+0, so=29; and T3=largest of 0, 0+0, 15+3, 29+0, so=29.

The waiting time is determined. W=3×(15+1.1)+2×(29+1.1)=45.3+60.2=105.5.

The solution is classified for feasibility. All the inequalities are satisfied, so the solution is feasible.

There is a feasible solution. So, the best feasible solution is used: northbound lag with northbound left turn overlap. Northbound lead with northbound left turn overlap is ignored since it is not feasible.

The states for the cross street direction then are determined. The progression for ET has its end reduced to 19−29=−10, so its car count is added to the queue for ET, making that 7, with a clearance time of 16+8 (changing time)=24. Internal phase01=WL, internal phase02=WT, internal phase13=ET, and internal phase23=EL.

The lower bounds are set. L0=0; L1=0; L2=0; L3=0; L01=11; L02=17; L12=0; L03=0; L13=24; and L23=11.

The upper bounds are set. U0*a*=9999; U0*b*=9999; U1*a*=9999; U2*a*=9999; F0*a*=1; F0*b*=4; F1*a*=7; F2*a*=1; U0=9999; 1U1=9999; 1U2=9999; and 1U3=61 (cutoff time minus calculation time minus end of main street scheduling).

The queue sizes are set. Q0=4+1=5; Q1=7; and Q2=1.

The maximum green times are set. X01=15+8=23; X02=25+8=33; X13=20+8=28; and X23=15+8=23. No adjustments to the L's is needed.

The plans are applied. There are no plans for any of these internal phases. So, all the PL's=0, and all the PU's=9999, except for PU3=61.

The plans are adjusted for non-permitted states in the sequence. All states are permitted, so no adjustments are needed.

The lower bounds for plans are adjusted to be consistent. No adjustments are made.

The upper bounds for plans are adjusted to be consistent. PU2=61; PU1=61; and PU0=61.

The consistency is checked between upper and lower bounds for plans. Each PL is less than or equal to its corresponding PU, so they are consistent.

The transition times are determined. T0=0; T1=larger of 0, and 0+11, so=11; T2=largest of 0, 0+17, 11+0, so=17; and T3=largest of 0, 0+0, 11+24, 17+11, so=35.

The waiting time is determined. W=5×(11+1.1)+1×(17+1.1)=78.6.

The solution is classified for feasibility. All the inequalities are satisfied, so the solution is feasible.

Next, the east-west lead lag sequence is calculated. Internal phase01=EL, internal phase02=ET, internal phase13=WT, and internal phase23=WL.

The lower bounds are set. L0=0; L1=0; L2=0; L3=0; L01=11; L02=24; L12=0; L03=0; L13=17; and L23=11.

The upper bounds are set. U0*a*=9999; U0*b*=9999; U1*a*=9999; U2*a*=9999; F0*a*=1; F0*b*=7; F1*a*=4; F2*a*=1; U0=9999; 1U1=9999; 1U2=9999; and 1U3=61.

The queue sizes are set. Q0=8; Q1=4; and Q2=1.

The maximum green times are set. X01=15+8=23; X02=20+8=28; X13=25+8=33; and X23=15+8=23. No adjustments to the L's are made.

The plans are applied. There are no plans for these internal phases. So, all the PL's=0, and the PU's=9999 except for PU3=61.

The plans are adjusted for non-permitted states in the sequence. All states are permitted, so there are no adjustments.

The lower bounds for plans are adjusted to be consistent. No adjustments are made.

The upper bounds for plans are adjusted to be consistent. PU2=61; PU1=61; and PU0=61.

The transition times are determined. T0=0; T1=larger of 0, and 0+11, so=11; T2=largest of 0, 0+24, and 11+0, so=24; and T3=largest of 0, 0+0, 11+17, and 24+11, so=35.

The waiting time is determined. W=4×(11+1.1)+1×(24+1.1)=73.5.

The solution is classified for feasibility. All the inequalities are satisfied, so the solution is feasible.

The best feasible solution is east-west lead lag, with a W of 73.5.

The states and time are converted into absolute times. The main street direction states are: NT-ST 15:01:25 to 15:01:40; NT-NL 15:01:40 to 15:01:54; and NL-SL is skipped, since T3=T2 for this solution.

The cross states are: ET-EL 15:01:54 to 15:02:05; ET-WT 15:02:05 to 15:02:18; and WT-WL 15:02:18 to 15:02:29.

The end of the last scheduled state (15:02:29) is less than the cutoff time minus change time (15:02:55−5 seconds=15:02:50), so a filler state is added: NT-ST 15:02:29 to 15:02:55.

The final list of scheduled states is: NT-ST 15:01:25 to 15:01:40; NT-NL 15:01:40 to 15:01:54; ET-EL 15:01:54 to 15:02:05; ET-WT 15:02:05 to 15:02:18; WT-WL 15:02:18 to 15:02:29 (flagged as "last"); and NT-ST 15:02:29 to 15:02:55 (flagged as "filler").

Figure 15:
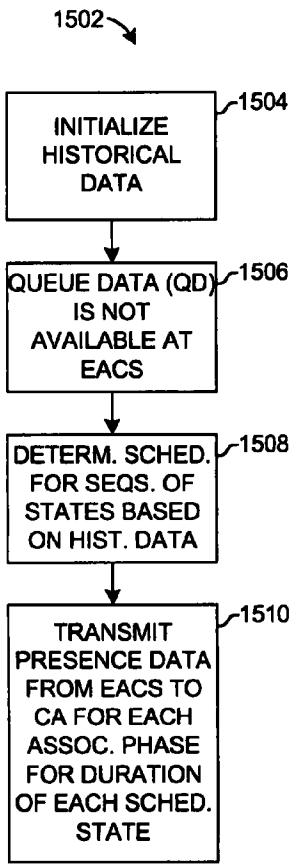
FIG. 15 is a flow diagram of an emergency mode in accordance with an embodiment of the present invention.

FIG. 15 depicts an exemplary embodiment of an emergency mode 1502. The emergency mode may be used, for example, when the external adaptive control system 802 is not receiving detector data (or valid detector data) from one or more detectors. This may occur, for example, when a video camera is occluded or otherwise not able to transmit video data to the external adaptive control system 802, when another detector type is not operational, or when the communication from the detector is not successful. In this embodiment, the external adaptive control system 802 is configured to store traffic flow data in its memory for a configurable time frame.

In one embodiment, the emergency mode is part of the optimizer system 820. In this embodiment, the optimizer system 820 receives a signal or communication from the detector manager 824 or otherwise by the processor 820 that detector data is not available for one or more detectors. Consequently, queue data cannot be determined for the individual phase or phases corresponding to the detector or detectors for which detector data is not received.

In one example, the external adaptive control system 802 stores light state data identifying each individual phase that received a right-of-way and the time and duration of the right-of-way. The light state data is collected for a selected time frame, such as an hour, a range of time, a day, a week, a month, and/or another period of time. The light state data is saved, rather than or in addition to the states transmitted from the external adaptive control system to the signal controller assembly, in case the light states at the signal controller assembly are different than the states sent by the external adaptive control system. This may occur, for example, when an emergency vehicle overrides the signals or a pedestrian crossing is activated. Other examples exist.

The emergency mode determines the number of vehicles for a selected time frame from the historical data and uses that historical number of vehicles as the queue data to determine a schedule. The historical data may be selected from the same time frame or a similar time frame as the current day and time, such as fifteen minute increments or other time increments, from one or more prior days, weeks, months, or another selected time frame. For example, if one or more detectors are not operational or the external adaptive control system otherwise is not receiving detector data on a Wednesday, the selected time increment for the same time of day for each of the previous five work days may be considered. Alternately, the selected time increment for the same time of day for each Wednesday of the previous four weeks may be considered. The highest number of vehicles for that selected time increment may be used. Alternately, the historical data for the selected time increment may be averaged or normalized. Other examples exist.

Alternately or additionally, the external adaptive control system 802 stores queue data, including queue lengths for each individual phase for the time frame. Optionally, the external adaptive control system 802 stores the schedule data for each state for the corresponding duration and times of day. For example, the external adaptive control system 802 can store the states for each individual phase for each traffic movement at the intersection based upon the corresponding time of day. Optionally, the external adaptive control system 802 also stores the progressions, including a number of vehicles for each approach to the intersection, for the selectable time period. Therefore, the external adaptive control system 802 has a record of each of the traffic movements at the intersection for the selectable period of time and the traffic flow through the intersection from other intersections in the traffic network for the configurable period of time.

Referring again to FIG. 15, the emergency mode 1502 starts by initializing the historical data stored in the external adaptive control system 802 at step 1504. Here, the queue data is not available at step 1506, for example because the detector is not transmitting detector data. As discussed above, the light state is collected for a time frame, such as for a day, a week, a month, or another time frame. The light state data is selected for a corresponding time increment as the current day and time for the selected time frame. Therefore, instead of using the real-time queue data derived from the detector, the optimizer system 820 uses corresponding light state data from the configured time frame.

The optimizer system 820 determines the schedule with one or more states having one or more individual phases based upon the historical data at step 1508. The states may be grouped as state sequences.

The presence data then is transmitted from the external adaptive control system 802 to the signal controller assembly 302A at step 1510 for each associated individual phase for the duration of each scheduled state.

Figure 16:
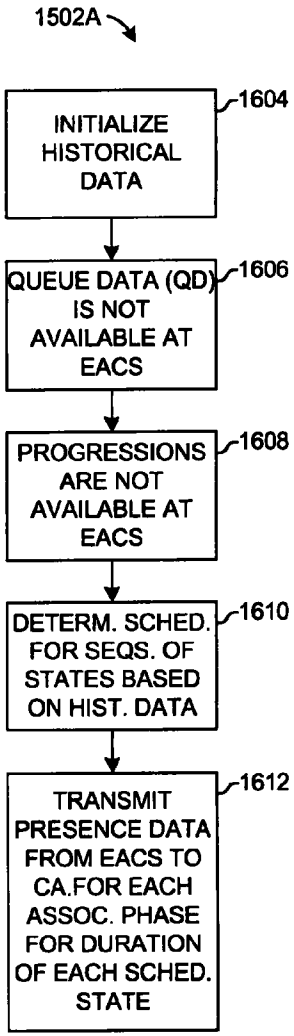
FIG. 16 is a flow diagram of another emergency mode in accordance with an embodiment of the present invention.

Referring now to FIG. 16, the emergency mode 1502A initializes the historical data at step 1604. The queue data is not available at step 1606, and the progressions are not available at step 1608. At step 1610, the optimizer system 820 determines the schedule for one or more sequences of one or more states each having one or more individual phases based on historical data described above. The historical data includes the light status data and prior progression data. At step 1612, the external adaptive control system 802 transmits the presence data to the signal controller assembly 302A for each associated individual phase for the duration of each scheduled state.

Figure 17:
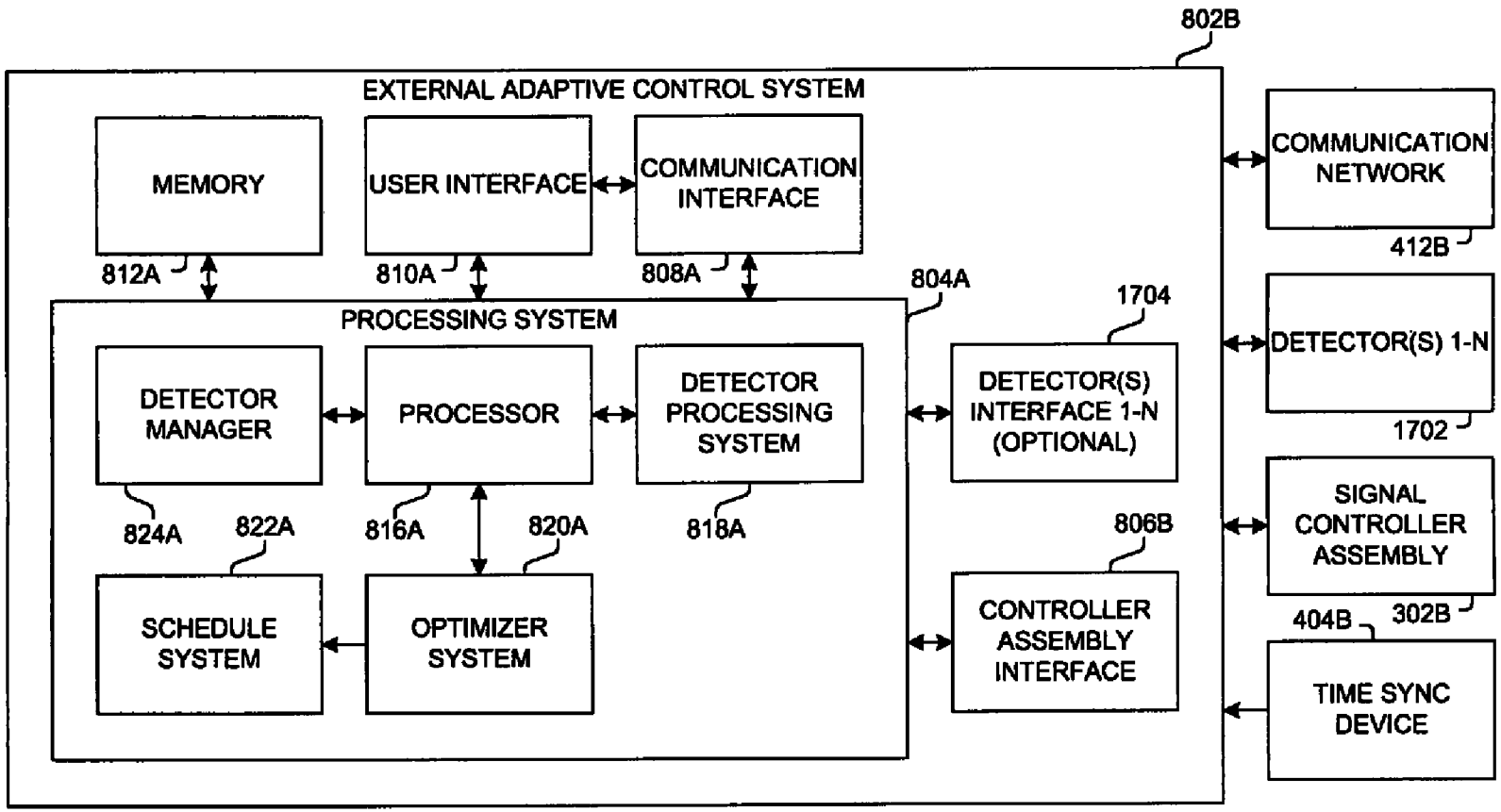
FIG. 17 is a block diagram of another external adaptive control system.

FIG. 17 depicts an exemplary embodiment of an external adaptive control system 802B in communication with one or more detectors 1702. In this embodiment, the detectors 1702 may be loop detectors, puck (magnetic) detectors, video detectors, microwave detectors, another type of detector, or a combination of detectors. The detectors 1702 transmit detector data for detecting one or more vehicles to the external adaptive control system 802B. In the example of loop detectors, the detection data still is considered to be transmitted to the external adaptive control system 802B for ground true logic.

In this embodiment, the external adaptive control system 802B includes a detector interface 1704 that receives the detector data from the detectors 1702.

The detector processing system 818A operates on the processor 816A and receives raw detector data from the detectors 1702. One or more types of detectors may be used. The detector processing system 818A converts the raw detector data from the detectors into one or more queue counts for one or more individual phases and reports the queue counts to the detector manager 824A, for example as queue data. The detector processing system 818A also converts the raw detector data from the detectors into one or more traffic counts of vehicles passing through the intersection for one or more individual phases and reports the traffic counts to the detector manager 824A, for example as traffic count data.

In one embodiment, the detector processing system 818A receives detector data transmitted by the detectors 1702 through the detector interface 1704. The detector processing system 818A also may process detector data received from other devices, including other external adaptive control systems, user computers, and/or other processors.

The detector processing system 818A processes the detector data to determine one or more queue lengths for one or more traffic lanes for one or more individual phases at an intersection. For example, the detector processing system 818A processes detector data for a particular detector or set of detectors for a particular detection zone at an intersection. The detection zone may include one or more individual traffic lanes and one or more individual phases. For an eight phase intersection, the detector processing system 818A receives detector data corresponding to eight individual phases, each with one or more traffic lanes, and processes the detector data to determine the queue lengths for each of the traffic lanes for each of the eight individual phases.

The detector processing system 818A also may receive and process detector data from fewer than all individual phases at the intersection. For example, the detector processing system 818A may process detector data for only four individual phases at the intersection.

The detector processing system 818A determines a queue length, i.e. a number of vehicles waiting for a right-of-way for an individual phase at an intersection. The detector processing system 818A also determines a through traffic count, which is a number of vehicles passing through the intersection for a particular individual phase during a right-of-way. The detector processing system 818A also determines a left turning traffic count passing through the intersection for individual phases during a right-of-way. The term "traffic count" means a through traffic count and/or a left turning traffic count, depending on the one or more individual phases receiving the right-of-way. Therefore, for a northbound left turn overlap state, the traffic count includes both the through traffic count for the northbound through individual phase and the left turn traffic count for the northbound left turn individual phase. However, the traffic counts may be transmitted separately to downstream intersections corresponding to the individual phase. For example, the portion of the traffic count allocated to the northbound through direction, which is the through traffic count, may be transmitted only to the intersection downstream of the northbound through individual phase. Similarly, the portion of the traffic count allocated to the northbound left turn individual phase, which is the left turn traffic count, may be transmitted only to the intersection downstream of the northbound left turn individual phase. In another embodiment, both portions of the traffic count are transmitted to all downstream intersections for each individual phase. In another embodiment, all traffic counts are transmitted to all downstream intersections for each individual phase, but the portion of the corresponding traffic count for the corresponding individual phase is separately identified to the corresponding downstream intersection.

The detector manager 824A receives queue counts and/or queue data for one or more individual phases from the detector processing system 818A, and stores the queue counts in memory, for example as queue data and/or as one or more objects. The optimizer system 820A may then query the queue data. The detector manager 824A also receives traffic counts and/or traffic count data of vehicles exiting the intersection for one or more individual phases from the detector processing system 818A and stores the traffic counts in memory, for example as traffic count data and/or as one or more objects. The optimizer system 820A may then query the traffic count data. Since one or more types of detectors may be present at an intersection, the detector manager 824A may receive queue data identifying queue counts, queue data, traffic counts, and/or traffic count data from the detector processing system for one or more types of detectors.

The detector manager 824A also manages connections to the detectors. The detector manager 824A determines when detector data is not being received from one or more detectors at the intersection. In the example of FIG. 17, the detector manager 824A determines when detector data is not being received from one or more detectors 1702. The detector manager 824A notifies the optimizer system 820A when detector data is not being received from one or more detectors. In one example, the detector manager 824A transmits a communication to the optimizer system 820A indicating the detector data is not being received from one or more detectors. Alternately, the detector manager 824A notifies the processor 816A when detector data is not being received from one or more detectors. In one example, the detector manager 824A transmits a communication to the processor 816A indicating the detector data is not being received from one or more detectors. Alternately or additionally, the detector manager 824A stores the queue data for the queue lengths and/or traffic count data for the traffic counts in memory and/or transmits a communication or other signal to the optimizer system 820A and/or the processor 816A with the queue data and/or traffic count data.

The optimizer system 820A then uses the detector data for the queue lengths for one or more individual phases at the intersection. The detector data is queue data for this embodiment. Other components in the external control system 802B operate the same as the similar components identified in FIG. 8.

Figure 18:
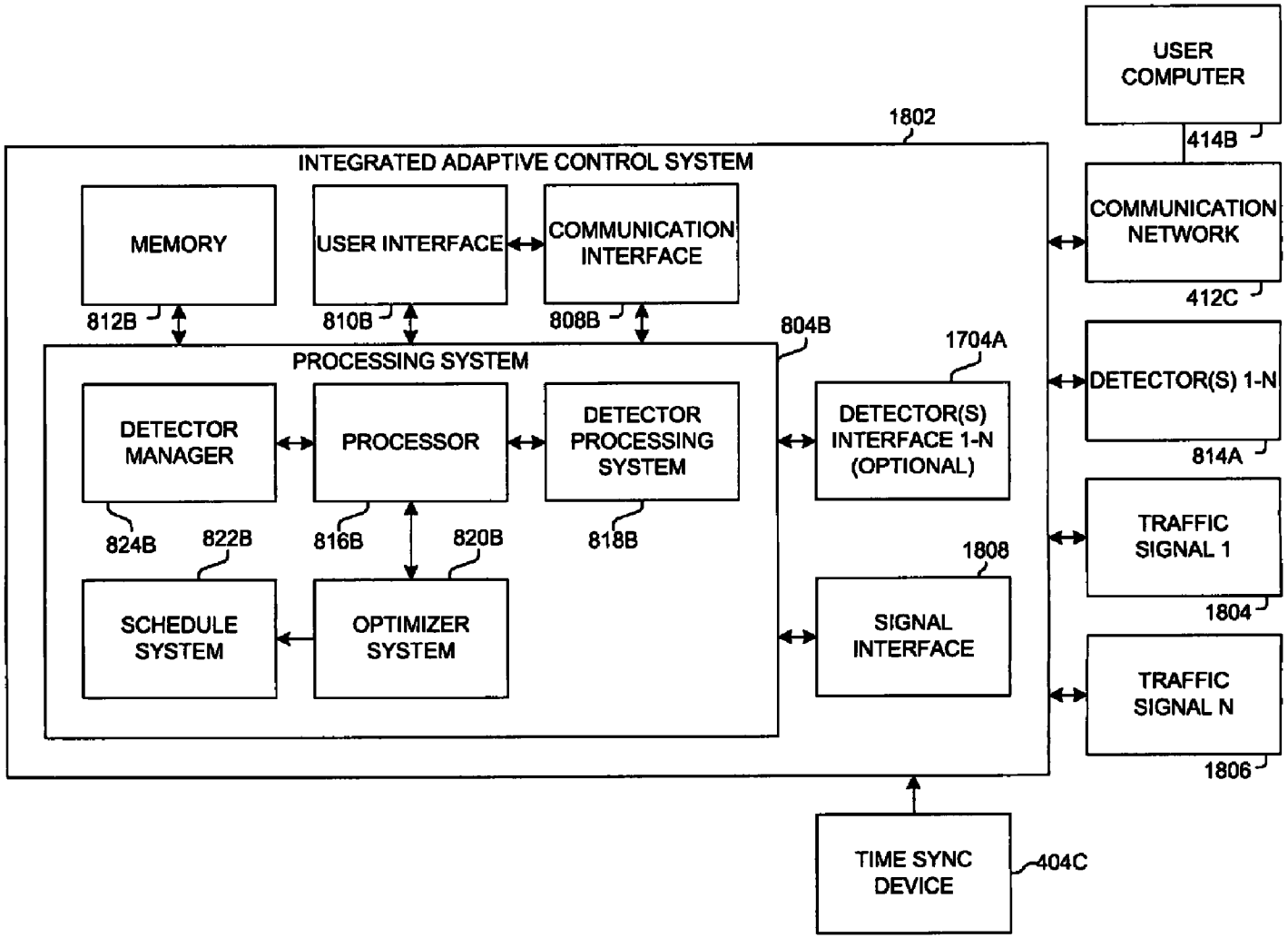
FIG. 18 is a block diagram of an integrated adaptive signal controller system in accordance with an embodiment of the present invention.
Figure 19:
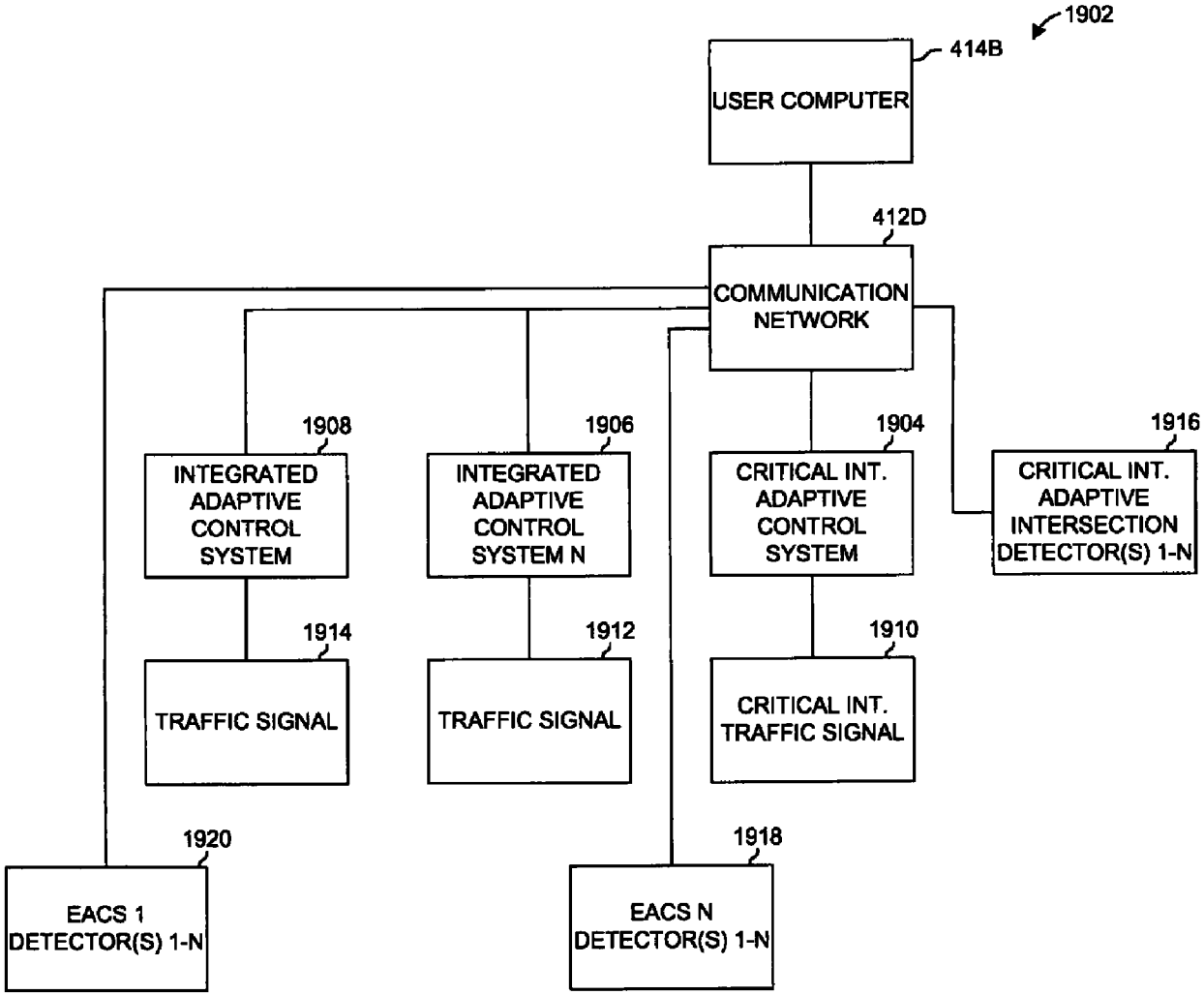
FIG. 19 is a block diagram of an integrated controller network in an embodiment of the present invention.

FIGS. 18-19 depict exemplary embodiments of an integrated adaptive signal controller system in a traffic network. In this embodiment, the integrated adaptive signal controller system 1802 does not transmit presence data to a signal controller assembly. In this embodiment, the integrated adaptive signal controller system is a signal controller assembly and transmits one or more control signals to the traffic signals at the intersection to control the indicators of the traffic signal.

In this embodiment, the integrated adaptive signal controller system 802 determines a non-linear schedule or a variable schedule having one or more states each having one or more individual phases. Each state has a start time and a duration, which are variable and dynamically determined. One or more states may be grouped as one or more sequences. The states have a non-linear state order and are not referenced to a fixed point. The schedule does not have a cycle as identified in conventional systems. The schedule has a variable period determined by the traffic flow as discussed above with respect to the external adaptive control systems. Therefore, the integrated adaptive signal controller system 1802 can determine any dynamic state for any dynamic order and control the associated traffic intersection accordingly.

In the embodiments of FIGS. 18 and 19, the integrated adaptive signal controller system 1802 includes components similar to the components of FIGS. 8 and 17. For example, the processing system 804B with the processor 816B, the detectors interface 1704A, and the communication interface 808B operate similarly to the systems of FIGS. 8 and 17. Optionally, the system may have a video processing system as in FIG. 8. The optimizer system 820B determines a non-linear schedule having a one or more states each having one or more individual phase, where each state has a state start time and a duration, similar to the systems of FIGS. 8 and 17. However, the processing system 804B of FIG. 18 does not generate presence data to a signal controller assembly. Instead, the processing system 804B directly controls traffic signal one 1804 through traffic signal N 1806 through the signal interface 1808. Therefore, the processing system 804B transmits a control signal through the signal interface 1808 causing traffic signal one 1804 to actuate a particular signal indicator, such as a red, a yellow, or green light or a green arrow.

FIG. 19 depicts such an integrated adaptive signal controller system in a traffic network 1902. In the embodiment of FIG. 19, a traffic network 1902 includes multiple intersections. The traffic network 1902 includes multiple integrated adaptive control systems 1904-1908, each controlling a traffic signal 1910-1914 and each having detectors 1-N 1916-1920.

One integrated adaptive control system is designated as the critical integrated adaptive control system 1904 at the critical intersection, which controls the critical intersection traffic signal 1910. Therefore, the critical intersection integrated adaptive control system 1904 has one or more plans for a direction or one or more coordinated directions, and it transmits its plans to the other integrated adaptive signal control systems 1906-1908. The other integrated adaptive control systems 1906-1908 use the one or more plans from the critical intersection integrated adaptive control system 1904 to determine their plans. Each of the integrated adaptive control systems 1904-1908 then use the plans to locally determine their respective schedules. In some instances, the integrated adaptive control systems 1904-1908 use one or more of the plans, local queues, progressions, and/or maximum and/or minimum green light times to determine schedules for their respective traffic signals 1910-1914.

In another example, the integrated adaptive control systems 1904-1908 transmit progressions and receive progressions through a communication network 412D. In another example, each integrated adaptive control system 1404-1408 receives detector data, such as video data, from its respective detectors 1-N 1906-1920 through the communication network 412D. Alternately, a local communication network or a portion of the communication network 412D may be used to communicate between the integrated adaptive control systems 1904-1908 and their respective detectors 1-N 1916-1920.

In another embodiment, the user computer 414B is used to transmit configuration data to one or more of the integrated adaptive control systems 1904-1908. In addition, in another embodiment, the user computer 414B monitors traffic flows at one or more intersections by receiving and viewing the video data from one or more of the cameras 1916-1920.

In other respects, the integrated adaptive control systems 1904-1908 determine one or more schedules in a manner similar to the optimizer system and schedule system of FIGS. 8 and 17. Other examples exist.

Figure 20:
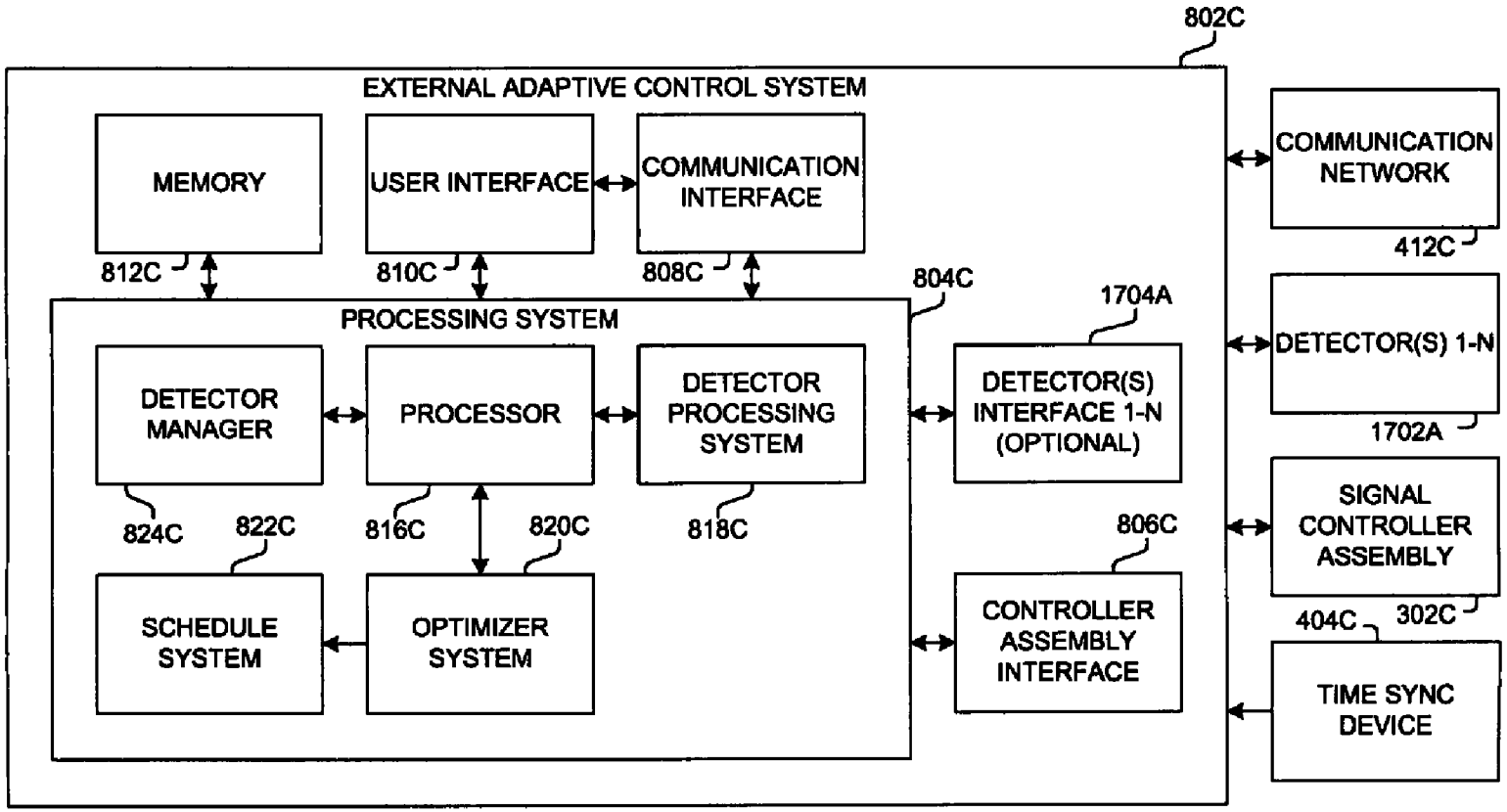
FIG. 20 is a block diagram of another external adaptive control system in an embodiment of the present invention.

FIG. 20 depicts another external adaptive control system 802C. The external adaptive control system 802C operates similarly to the external adaptive control systems 802-802A, except the optimizer system 820C generates a timing plan with a cycle length for a cycle instead of a non-linear variable schedule having a period. For example, the optimizer system 820C determines a timing plan with a cycle length for a cycle based on one or more plans, one or more queue lengths for one or more individual phases of a corresponding intersection, and/or one or more progressions.

The timing plan is distinguished from the non-linear variable schedule, since the timing plan is linear for a cycle. The timing plan includes phase splits for individual signal phases for a cycle. A phase split or individual phase split is the portion of the cycle length allocated to an individual phase. A signal phase or individual signal phase is a right of way for an individual phase. Similarly, a cycle length is distinguished from a period, since the cycle length is for a linear cycle with a fixed reference point. Therefore, the optimizer system 820C generates a timing plan comprising a plurality of signal phases, each signal phase having a phase split and corresponding to an individual phase at an intersection. The schedule system 822C transmits signals to the signal controller assembly 302C through the controller assembly interface 806C for the individual phases of the timing plan. The "plan" in this example may be referred to as a "scheduling plan" to distinguish it from the "timing plan."

Figure 21:
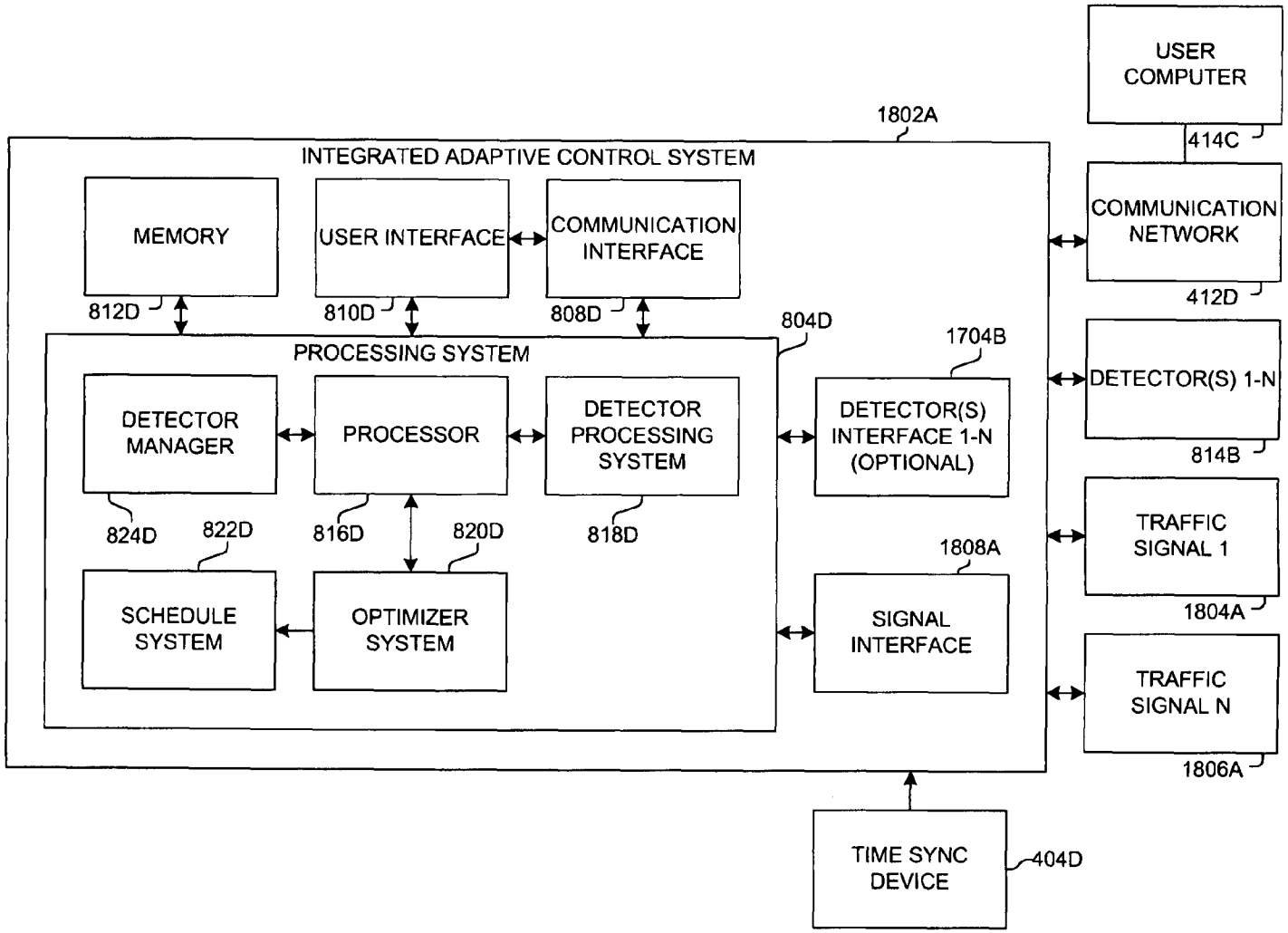
FIG. 21 is a block diagram of another integrated control system in an embodiment of the present invention.

FIG. 21 depicts another integrated adaptive control system 1802A. The integrated adaptive control system 1802A operates similarly to the integrated adaptive control system 1802 of FIG. 18, except the optimizer system 820D generates a timing plan with a cycle length for a cycle instead of a non-linear variable schedule having a period. For example, the optimizer system 820D determines a timing plan with a cycle length for a cycle based on one or more plans, one or more queue lengths for one or more individual phases of a corresponding intersection, and/or one or more progressions.

The timing plan is distinguished from the non-linear variable schedule, since the timing plan is linear for a cycle. The timing plan includes phase splits for individual signal phases for a cycle. Similarly, a cycle length is distinguished from a period, since the cycle length is for a linear cycle with a fixed reference point. The schedule system 822D transmits control signals to the traffic signals 1804A and/or 1804B through the signal interface 1808A for the individual phases of the timing plan. The "plan" in this example may be referred to as a "scheduling plan" to distinguish it from the "timing plan."

Combinations and/or sub-combinations of the systems and/or components described herein may be made. Combinations and/or sub-combinations of the methods and/or systems and/or components and/or methods described herein may be made.

Those skilled in the art will appreciate that variations from the specific embodiments disclosed above are contemplated by the invention. The invention should not be restricted to the above embodiments, but should be measured by the following claims.

What is claimed is:

1. A method for controlling traffic movements for a plurality of traffic intersections each having a volume of traffic comprising:

determining a critical intersection having a most conflicting volume from among the volumes;

determining a plan at an adaptive control system with at least one guaranteed green time and at least one minimum green duration for at least one direction of traffic movement at the critical intersection and a period for the plan;

determining other plans with other guaranteed green times and other minimum green durations for other intersections based on the at least one guaranteed green time and the at least one minimum green duration at the critical intersection and an expected travel time between the critical intersection and the other intersections, each other plan having another period;

determining at least one non-linear schedule for the critical intersection at the adaptive control system based on the at least one guaranteed green time, the at least one minimum green duration, the period, and queue lengths for individual phases at the critical intersection;

determining other non-linear schedules for the other intersections based on the other guaranteed green times, the other minimum green durations, the other periods, and other queue lengths for other individual phases at the other intersections;

controlling at least one traffic signal at the critical intersection according to the at least one non-linear schedule; and controlling other traffic signals at the other intersections according to the other non-linear schedules.

2. The method of claim 1 wherein:

determining the at least one non-linear schedule at the adaptive control system comprises determining the at least one non-linear schedule at an external adaptive control system; and controlling the at least one traffic signal according to the at least one non-linear schedule comprises controlling at least one traffic signal controller assembly in a fully actuated mode at the critical intersection by the external adaptive control system according to the at least one non-linear schedule.

3. The method of claim 1 wherein:

determining the at least one non-linear schedule at the adaptive control system comprises determining the at least one non-linear schedule at an integrated adaptive control system; and controlling the at least one traffic signal according to the at least one non-linear schedule comprises transmitting control signals to the traffic signal from the integrated adaptive control system to control indicators of the traffic signal.

4. The method of claim 1 wherein:

determining the other non-linear schedules comprises determining the other non-linear schedules at external adaptive control systems; and controlling the other traffic signals according to the other non-linear schedules comprises controlling traffic signal controller assemblies at the other intersections by the external adaptive control systems according to the other non-linear schedules.

5. The method of claim 1 wherein:

determining the other non-linear schedules comprises determining the other non-linear schedules at integrated adaptive control systems; and controlling the other traffic signals according to the other non-linear schedules comprises transmitting control signals to the other traffic signals from the integrated adaptive control systems to control indicators of the other traffic signal.

6. The method of claim 1 wherein the adaptive control system comprises historical data comprising prior light states generated at the at least one traffic signal for particular individual phases for a configured time frame, and wherein the adaptive control system is configured to receive detector data and to process the detector data to determine the queue lengths, and the method further comprises:

determining when at least some detector data is not received at the adaptive control system; and determining the at least one non-linear schedule at the adaptive control system based on the plan, and at least some of the historical data, the at least some historical data used in place of at least some queue lengths for the not received detector data.

7. The method of claim 1 wherein the adaptive control system is configured to receive detector data and to process the detector data to determine the queue lengths, the method further comprising:

storing a plurality of light states generated at the traffic signal for particular individual phases for a configured time frame in memory at the adaptive control system; and when at least some of the detector data is not received at the external adaptive control system, processing at least some of the historical data in place of at least some of the detector data in an emergency mode to determine the non-linear schedule.

8. The method of claim 1 wherein determining the plan comprises:

determining a number of vehicles per second passing through the critical intersection in the at least one direction of traffic movement during a prior period;

multiplying the number of vehicles per second by the prior period to determine an expected number of vehicles to pass through the critical intersection in the selected direction during the plan; and multiplying a clearance time by the expected number of vehicles to determine the minimum green duration for the plan.

9. The method of claim 1 wherein determining the plan comprises determining the guaranteed green time to be a starting time of the plan.

10. The method of claim 1 wherein determining the plan comprises:

determining a number of vehicles per second passing through the critical intersection in the at least one direction of traffic movement during a time frame the at least one direction of traffic movement has a right-of-way in a prior period;

multiplying the number of vehicles per second by the prior period to determine an expected number of vehicles to pass through the critical intersection in the selected direction during the plan; and multiplying a clearance time by the expected number of vehicles to determine the minimum green duration for the plan.

11. The method of claim 1 wherein determining the period comprises:

reducing the period from a prior period by a first selected time amount when a non-selected direction of traffic movement at the critical intersection has more than enough time during the prior period to clear traffic for at least one corresponding individual phase in the non-selected direction; and increasing the period from the prior period by a second selected time amount when the non-selected direction of traffic movement at the critical intersection does not have than enough time during the prior period to clear the traffic for the at least one corresponding individual phase in the non-selected direction.

12. The method of claim 1 wherein determining the period comprises:

reducing the period from a prior period by a first selected time amount when the selected direction of traffic movement at the critical intersection has more than enough time during the prior period to clear traffic for at least one corresponding individual phase in the selected direction; and increasing the period from the prior period by a second selected time amount when the selected direction of traffic movement at the critical intersection does not have than enough time during the prior period to clear the traffic for the at least one corresponding individual phase in the selected direction.

13. The method of claim 1 wherein:

determining the plan further comprises determining at least one second guaranteed green time and at least one second minimum green duration for a coordinated direction of traffic movement at the critical intersection; and determining the at least one non-linear schedule for the critical intersection at the adaptive control system comprises determining the at least one non-linear schedule based on the queue lengths and the plan with the at least one guaranteed green time, the at least one green duration, the at least one second guaranteed green time, the at least one second minimum green duration, and the period for the plan.

14. The method of claim 1 wherein:

determining the other plans further comprises determining, for each corresponding other plan, a corresponding other guaranteed green time, a corresponding other green duration, at least one second corresponding guaranteed green time, and at least one second corresponding minimum green duration for a coordinated direction of traffic movement at a corresponding intersection, each corresponding other plan having a corresponding other period; and determining the other non-linear schedules for the other intersections at the other adaptive control system comprises, for each other non-linear schedule, determining the other non-linear schedule based on corresponding queue lengths at the corresponding intersection and the corresponding other plan.

15. The method of claim 1 further comprising:

receiving progression data at the adaptive control system for at least one progression, the progression data comprising at least one number of vehicles approaching the critical intersection and at least one progression time for the at least one number of vehicles approaching the critical intersection; and determining the at least one non-linear schedule at the adaptive control system based on the plan, the queue lengths, and the progression data.

16. The method of claim 1 further comprising transmitting the plan from the at least one adaptive control system to the other adaptive control systems.

17. The method of claim 1 further comprising:

determining the non-linear schedule by determining first states, first state start times, and first state durations for a main direction;

determining second states, second state start times, and second state durations for a cross street direction; and ordering the first states and second states in a variable order.

18. The method of claim 1 further comprising determining the non-linear schedule by:

establishing a start time for the non-linear schedule and an end time for the non-linear schedule;

determining a first partial schedule by marking time occupied by coordinated phases as committed;

for each individual phase with an unaccounted queue, determine a plurality of potential schedules from the first partial schedule by fitting the unaccounted individual phase into areas where no non-compatible phase already exists;

applying a scoring function to each potential schedule, the scoring function comprising multiplying each queue length for each unaccounted individual phase by a waiting time for the unaccounted individual phase and summing each multiplied queue length and waiting time to obtain a score for each potential schedule;

selecting the potential schedule with a lowest score as the non-linear schedule;

filling at least one empty area in the schedule with at least one compatible individual phase; and generating the non-linear schedule from the potential schedule with the lowest score and the at least one compatible individual phase.

19. The method of claim 1 further comprising:

determining a plurality of potential solutions for a main direction and a cross street direction for the non-linear schedule based on the queue lengths at the critical intersection, each potential solution having transition times and waiting times for a plurality of potential state sequences;

selecting a solution for each direction having a lowest waiting time and a shortest transition time; and generating the non-linear schedule with the selected main street solution and the selected cross street solution.

20. A method for controlling traffic movements for a plurality of traffic intersections each having a volume of traffic comprising:

determining a critical intersection having a most conflicting volume from among the volumes;

determining at least one guaranteed green time and at least one minimum green duration for at least one direction of traffic movement at the critical intersection and a period between at least one guaranteed green time at the critical intersection and a next guaranteed green time for the at least one direction of traffic movement at the critical intersection;

determining at least one other guaranteed green time and at least one other minimum green duration for at least one other intersection based on the at least one guaranteed green time and the at least one minimum green duration at the critical intersection and an expected travel time between the critical intersection and the at least one other intersection;

determining at least one non-linear schedule for the critical intersection based on the at least one guaranteed green time, the at least one minimum green duration, the period, and queue lengths for individual phases at the critical intersection;

determining at least one other non-linear schedule for the at least one other intersection based on the at least one other guaranteed green time, the at least one other minimum green duration, and other queue lengths at the at least one other intersection;

controlling at least one traffic signal at the critical intersection according to the at least one non-linear schedule; and controlling at least one other traffic signal at the at least one other intersection according to the at least one other non-linear schedule.

21. The method of claim 20 wherein:

determining the at least one non-linear schedule comprises determining the at least one non-linear schedule at an external adaptive control system; and controlling the at least one traffic signal according to the at least one non-linear schedule comprises controlling at least one traffic signal controller assembly at the critical intersection by the external adaptive control system according to the at least one non-linear schedule.

22. The method of claim 20 wherein:

determining the at least one non-linear schedule comprises determining the at least one non-linear schedule at an integrated adaptive control system; and controlling the at least one traffic signal according to the at least one non-linear schedule comprises transmitting control signals from the integrated adaptive control system to the traffic signal to control indicators of the traffic signal.

23. The method of claim 20 wherein:

determining the at least one other non-linear schedule comprises determining the at least one other non-linear schedule at least one other external adaptive control system; and controlling the at least one other traffic signal according to the at least one other non-linear schedule comprises controlling at least one other traffic signal controller assembly at the at least one other intersection by the at least one other external adaptive control system according to the at least one other non-linear schedule.

24. The method of claim 20 wherein:

determining the at least one other non-linear schedule comprises determining the at least one other non-linear schedule at least one other integrated adaptive control system; and controlling the at least one other traffic signal according to the at least one other non-linear schedule comprises transmitting control signals to the at least one other traffic signal from the at least one integrated adaptive control system to control indicators of the at least one other traffic signal.

25. The method of claim 20 further comprising:

determining the at least one non-linear schedule at an adaptive control system comprising prior light states generated at the at least one traffic signal for particular individual phases for a configured time frame, wherein the adaptive control system is configured to receive detector data and to process the detector data to determine the queue lengths;

determining when at least some detector data is not received at the adaptive control system; and determining the at least one non-linear schedule at the adaptive control system based on the plan, and at least some of the historical data, the at least some historical data used in place of at least some queue lengths for the not received detector data.

26. The method of claim 20 further comprising:

determining the at least one non-linear schedule at an adaptive control system configured to receive detector data and to process the detector data to determine the queue lengths;

storing a plurality of light states generated at the traffic signal for particular individual phases for a configured time frame in memory at the adaptive control system; and when at least some of the detector data is not received at the external adaptive control system, processing at least some of the historical data in place of at least some of the detector data in an emergency mode to determine the non-linear schedule.

27. A method for controlling traffic movements for a plurality of traffic intersections each having a volume of traffic comprising:

determining a critical intersection having a most conflicting volume from among the volumes;

determining at least one guaranteed green time and at least one minimum green duration for at least one direction of traffic movement at the critical intersection;

determining other guaranteed green times and other minimum green durations for other intersections based on the at least one guaranteed green time and the at least one minimum green duration at the critical intersection and an expected travel time between the critical intersection and the other intersections;

determining at least one non-linear schedule for the critical intersection based at least on the at least one guaranteed green time and the at least one minimum green duration;

determining other non-linear schedules for the other intersections based on the other guaranteed green times and other minimum green durations;

controlling at least one traffic signal at the critical intersection according to the at least one non-linear schedule; and controlling other traffic signals at the other intersections according to the other non-linear schedules.

28. The method of claim 27 wherein:

controlling the at least one signal at the critical intersection comprises controlling at least one traffic signal controller assembly at the critical intersection by at least one external adaptive control system according to the at least one non-linear schedule.

29. The method of claim 27 wherein:

controlling other traffic signals at other intersections comprises controlling other traffic signal controller assemblies at the other intersections by other external adaptive control systems according to the other non-linear schedules.

30. The method of claim 27 further comprising:

determining the at least one non-linear schedule at an adaptive control system comprising prior light states generated at the at least one traffic signal for particular individual phases for a configured time frame, wherein the adaptive control system is configured to receive detector data and to process the detector data to determine the queue lengths;

determining when at least some detector data is not received at the adaptive control system; and determining the at least one non-linear schedule at the adaptive control system based on the plan, and at least some of the historical data, the at least some historical data used in place of at least some queue lengths for the not received detector data.

31. The method of claim 27 further comprising:

determining the at least one non-linear schedule at an adaptive control system configured to receive detector data and to process the detector data to determine the queue lengths;

storing a plurality of light states generated at the traffic signal for particular individual phases for a configured time frame in memory at the adaptive control system; and when at least some of the detector data is not received at the external adaptive control system, processing at least some of the historical data in place of at least some of the detector data in an emergency mode to determine the non-linear schedule.

32. A system for controlling traffic movements for a plurality of traffic intersections each having a volume of traffic, the system comprising:

an adaptive control system at a critical intersection having a most conflicting volume from among the volumes and configured to:

determine a plan with at least one guaranteed green time and at least one minimum green duration for at least one direction of traffic movement at the critical intersection and a period for the plan;

determine at least one non-linear schedule for the critical intersection based on the at least one guaranteed green time, the at least one minimum green duration, the period, and queue lengths for individual phases at the critical intersection; and control at least one traffic signal at the critical intersection according to the at least one non-linear schedule; and a plurality of other adaptive control systems, each other adaptive control system configured to:

determine a corresponding plan, each corresponding plan comprising a corresponding guaranteed green time and a corresponding minimum green duration for a corresponding intersection based on the at least one guaranteed green time and the at least one minimum green duration at the critical intersection and an expected travel time between the critical intersection and the corresponding intersection, each corresponding plan having a corresponding period;

determine a corresponding non-linear schedule for the corresponding intersection based on the corresponding plan and corresponding queue lengths for corresponding individual phases for the corresponding intersection, each corresponding non-linear schedule comprising another plurality of corresponding states having a corresponding state order, each corresponding state having a corresponding state start time and a corresponding state duration; and control a corresponding traffic signal at the corresponding intersection according to the corresponding non-linear schedule.

33. The system of claim 32 wherein:

the adaptive control system comprises an external adaptive control system; and the external adaptive control system is configured to control the at least one traffic signal at the critical intersection by controlling at least one traffic signal controller assembly in a fully actuated mode at the critical intersection according to the at least one non-linear schedule.

34. The system of claim 32 wherein:

the adaptive control system comprises an integrated adaptive control system; and the integrated adaptive control system is configured to determine the at least one non-linear schedule and control the at least one traffic signal at the critical intersection by transmitting control signals to the traffic signal to control indicators of the traffic signal.

35. The system of claim 32 wherein:

each other adaptive control system comprises an external adaptive control system configured to determine the corresponding non-linear schedule; and each external adaptive control system is configured to control the corresponding traffic signal according to the corresponding non-linear schedule by controlling a corresponding traffic signal controller assembly at the corresponding intersection according to the corresponding non-linear schedule.

36. The system of claim 32 wherein:

each other adaptive control system comprises an external adaptive control system configured to determine the corresponding non-linear schedule; and each integrated adaptive control system is configured to determine the corresponding non-linear schedule and control the corresponding traffic signal at the corresponding intersection by transmitting control signals to the corresponding traffic signal to control indicators of the corresponding traffic signal.

37. The system of claim 32 wherein:

the adaptive control system comprises historical data comprising prior light states generated at the at least one traffic signal for particular individual phases for a configured time frame; and the adaptive control system is configured to:

receive detector data and to process the detector data to determine the queue lengths;

determine when at least some detector data is not received at the adaptive control system; and determine the at least one non-linear schedule at the adaptive control system based on the plan, and at least some of the historical data, the at least some historical data used in place of at least some queue lengths for the not received detector data.

38. The system of claim 32 wherein the adaptive control system is configured to:

receive detector data and to process the detector data to determine the queue lengths;

store a plurality of light states generated at the traffic signal for particular individual phases for a configured time frame in memory at the adaptive control system; and when at least some of the detector data is not received at the adaptive control system, process at least some of the historical data in place of at least some of the detector data in an emergency mode to determine the non-linear schedule.

39. The system of claim 32 wherein the adaptive control system is configured to determine the plan by:

determining a number of vehicles per second passing through the critical intersection in the at least one direction of traffic movement during a prior period;

multiplying the number of vehicles per second by the prior period to determine an expected number of vehicles to pass through the critical intersection in the selected direction during the plan; and multiplying a clearance time by the expected number of vehicles to determine the minimum green duration for the plan.

40. The system of claim 32 wherein the adaptive control system is configured to determine the plan by:

determining a number of vehicles per second passing through the critical intersection in the at least one direction of traffic movement during a time frame the at least one direction of traffic movement has a right-of-way in a prior period;

multiplying the number of vehicles per second by the prior period to determine an expected number of vehicles to pass through the critical intersection in the selected direction during the plan; and multiplying a clearance time by the expected number of vehicles to determine the minimum green duration for the plan.

41. The system of claim 32 wherein the adaptive control system is configured to determine the plan by determining the guaranteed green time to be a starting time of the plan.

42. The system of claim 32 wherein the adaptive control system is configured to determine the period by:

reducing the period from a prior period by a first selected time amount when a non-selected direction of traffic movement at the critical intersection has more than enough time during the prior period to clear traffic for at least one corresponding individual phase in the non-selected direction; and increasing the period from the prior period by a second selected time amount when the non-selected direction of traffic movement at the critical intersection does not have than enough time during the prior period to clear the traffic for the at least one corresponding individual phase in the non-selected direction.

43. The system of claim 32 wherein the adaptive control system is configured to determine the period by:

reducing the period from a prior period by a first selected time amount when the selected direction of traffic movement at the critical intersection has more than enough time during the prior period to clear traffic for at least one corresponding individual phase in the selected direction; and increasing the period from the prior period by a second selected time amount when the selected direction of traffic movement at the critical intersection does not have than enough time during the prior period to clear the traffic for the at least one corresponding individual phase in the selected direction.

44. The system of claim 32 wherein the adaptive control system is configured to determine the non-linear schedule by determining first states, first state start times, and first state durations for a main direction, determining second states, second state start times, and second state durations for a cross street direction, and ordering the first states and second states in the variable order.

45. The system of claim 32 wherein the adaptive control system is configured to determine the non-linear schedule by:

establishing a start time for the non-linear schedule and an end time for the non-linear schedule;

determining a first partial schedule by marking time occupied by coordinated phases as committed;

for each individual phase with an unaccounted queue, determine a plurality of potential schedules from the first partial schedule by fitting the unaccounted individual phase into areas where no non-compatible phase already exists;

applying a scoring function to each potential schedule, the scoring function comprising multiplying each queue length for each unaccounted individual phase by a waiting time for the unaccounted individual phase and summing each multiplied queue length and waiting time to obtain a score for each potential schedule;

selecting the potential schedule with a lowest score as the non-linear schedule;

filling at least one empty area in the schedule with at least one compatible individual phase; and generating the non-linear schedule from the potential schedule with the lowest score and the at least one compatible individual phase.

46. The system of claim 32 wherein the adaptive control system is configured to determine a plurality of potential solutions for a main direction and a cross street direction based on the queue lengths, each potential solution having transition times and waiting times for a plurality of potential state sequences, to select a solution for each direction having a lowest waiting time and a shortest transition time, and to generate the non-linear schedule with the selected main street solution and the selected cross street solution.

47. The system of claim 32 wherein the adaptive control system is configured to:

determine the plan by determining at least one second guaranteed green time and at least one second minimum green duration for a coordinated direction of traffic movement at the critical intersection; and determine the at least one non-linear schedule for the critical intersection at the adaptive control system by determining the at least one non-linear schedule based on the queue lengths and the plan with the at least one guaranteed green time, the at least one green duration, the at least one second guaranteed green time, the at least one second minimum green duration, and the period for the plan.

48. The system of claim 32 wherein the adaptive control system is configured to:

determine the other plans by determining, for each corresponding other plan, a corresponding other guaranteed green time, a corresponding other green duration, at least one second corresponding guaranteed green time, and at least one second corresponding minimum green duration for a coordinated direction of traffic movement at a corresponding intersection, each corresponding other plan having a corresponding other period; and determine the other non-linear schedules for the other intersections by determining, for each other non-linear schedule, the other non-linear schedule based on corresponding queue lengths at the corresponding intersection and the corresponding other plan.

49. A system for controlling traffic movements for a plurality of traffic intersections each having a volume of traffic, the system comprising:

an adaptive control system configured to:

determine a critical intersection having a most conflicting volume from among the volumes;

determine a plan with at least one guaranteed green time and at least one minimum green duration for at least one direction of traffic movement at the critical intersection and a period for the plan;

determine at least one non-linear schedule for the critical intersection based on the at least one guaranteed green time, the at least one minimum green duration, the period, and queue lengths for individual phases at the critical intersection; and control at least one traffic signal at the critical intersection according to the at least one non-linear schedule; and at least one other adaptive control system configured to:

determine at least one other guaranteed green time and at least one other minimum green duration for at least one other intersection based on the at least one guaranteed green time and the at least one minimum green duration at the critical intersection and an expected travel time between the critical intersection and the at least one other intersection;

determine at least one other non-linear schedule for the at least one other intersection based on the at least one other guaranteed green time, the at least one other minimum green duration, and other queue lengths at the at least one other intersection; and control at least one other traffic signal at the at least one other intersection according to the at least one other non-linear schedule.

50. The system of claim 49 wherein:

the adaptive control system comprises an external adaptive control system; and the external adaptive control system is configured to control the at least one traffic signal at the critical intersection by controlling at least one traffic signal controller assembly at the critical intersection according to the at least one non-linear schedule.

51. The system of claim 49 wherein:

the adaptive control system comprises an integrated adaptive control system; and the integrated adaptive control system is configured to determine the at least one non-linear schedule and control the at least one traffic signal at the critical intersection by transmitting control signals to the traffic signal to control indicators of the traffic signal.

52. The system of claim 49 wherein:

the at least one other adaptive control system comprises at least one external adaptive control system configured to determine the at least one other non-linear schedule; and the at least one external adaptive control system is configured to control the at least one other traffic signal according to the at least one other non-linear schedule by controlling at least one other traffic signal controller assembly at the at least one other intersection according to the at least one other non-linear schedule.

53. The system of claim 49 wherein:

the at least one other adaptive control system comprises at least one integrated adaptive control system configured to determine the at least one other non-linear schedule; and the at least one integrated adaptive control system is configured to determine the at least one other non-linear schedule and control the at least one other traffic signal at the at least one other intersection by transmitting control signals to the at least one other traffic signal to control indicators of the at least one other traffic signal.

54. The system of claim 49 wherein:

the adaptive control system comprises prior light states generated at the at least one traffic signal for particular individual phases for a configured time frame; and the adaptive control system is configured to:

receive detector data and to process the detector data to determine the queue lengths;

determine when at least some detector data is not received at the adaptive control system; and determine the at least one non-linear schedule at the adaptive control system based on the plan, and at least some of the historical data, the at least some historical data used in place of at least some queue lengths for the not received detector data.

55. The system of claim 49 wherein the adaptive control system is configured to:

receive detector data and to process the detector data to determine the queue lengths;

store a plurality of light states generated at the traffic signal for particular individual phases for a configured time frame in memory at the adaptive control system; and when at least some of the detector data is not received at the external adaptive control system, process at least some of the historical data in place of at least some of the detector data in an emergency mode to determine the non-linear schedule.

56. A system for controlling traffic movements for a plurality of traffic intersections each having a volume of traffic, the system comprising:

an adaptive control system at a critical intersection having a most conflicting volume from among the volumes and configured to:

determine at least one guaranteed green time and at least one minimum green duration for at least one direction of traffic movement at the critical intersection;

determine at least one non-linear schedule for the critical intersection based at least on the at least one guaranteed green time and the at least one minimum green duration; and control at least one traffic signal at the critical intersection according to the at least one non-linear schedule; and a plurality of other adaptive control systems, each configured to:

determine another guaranteed green time and other minimum green duration for another intersection based on the at least one guaranteed green time and the at least one minimum green duration at the critical intersection and an expected travel time between the critical intersection and the other intersection;

determine another non-linear schedule for the other intersection based on the other guaranteed green time and other minimum green duration; and control another traffic signal at the other intersection according to the other non-linear schedule.

57. The system of claim 56 wherein:

the adaptive control system comprises an external adaptive control system; and the external adaptive control system is configured to control the at least one traffic signal at the critical intersection by controlling at least one traffic signal controller assembly at the critical intersection according to the at least one non-linear schedule.

58. The system of claim 56 wherein:

each other adaptive control system comprises an external adaptive control system; and each external adaptive control system is configured to control the other traffic signal according to the other non-linear schedule by controlling a corresponding traffic signal controller assembly at the other intersection according to the other non-linear schedule.

59. The system of claim 56 wherein:

the adaptive control system comprises prior light states generated at the at least one traffic signal for particular individual phases for a configured time frame; and the adaptive control system is configured to:

receive detector data and to process the detector data to determine the queue lengths;

determine when at least some detector data is not received at the adaptive control system; and determine the at least one non-linear schedule at the adaptive control system based on the plan, and at least some of the historical data, the at least some historical data used in place of at least some queue lengths for the not received detector data.

60. The system of claim 56 wherein the adaptive control system is configured to:

receive detector data and to process the detector data to determine the queue lengths;

store a plurality of light states generated at the traffic signal for particular individual phases for a configured time frame in memory at the adaptive control system; and when at least some of the detector data is not received at the external adaptive control system, process at least some of the historical data in place of at least some of the detector data in an emergency mode to determine the non-linear schedule.

* * * * *

UNITED STATES PATENT AND TRADEMARK OFFICE

CERTIFICATE OF CORRECTION

PATENT NO. : 8,050,854 B1
APPLICATION NO. : 12/236701
DATED : November 1, 2011
INVENTOR(S) : Reggie Chandra et al.

It is certified that error appears in the above-identified patent and that said Letters Patent is hereby corrected as shown below:

In column 11, line 45, change “in” to --In--.

In column 27, line 43, change “optimizer system 822” to --optimizer system 820--;
line 44, change “optimizer system 822” to --optimizer system 820--; and
line 53, change “stat” to --state--.

In column 55, claim 11, line 12, delete “than”.

In column 56, claim 12, line 12, delete “than”.

In column 62, claim 42, line 12, delete “than”; and
claim 43, line 12, delete “than”.

Signed and Sealed this
Twelfth Day of June, 2012

David J. Kappos

David J. Kappos
*Director of the United States Patent and Trademark Office*